US005882813A

United States Patent [19]

Matsushima et al.

[11] Patent Number: 5,882,813

[45] Date of Patent: Mar. 16, 1999

[54] ELECTROPHOTOGRAPHIC PHOTORECEPTOR

[75] Inventors: Yoshimasa Matsushima; Tohru Kobayashi; Hiroshi Sugiyama; Yoko Takahashi; Toshimitsu Hagiwara, all of Kanagawa, Japan

[73] Assignee: Takasago International Corporation, Tokyo, Japan

[21] Appl. No.: 893,000

[22] Filed: Jul. 15, 1997

[30] Foreign Application Priority Data

| | | | |
|---|---|---|---|
| Jul. 15, 1996 | [JP] | Japan | 8-202736 |
| Sep. 30, 1996 | [JP] | Japan | 8-276873 |
| Dec. 18, 1996 | [JP] | Japan | 8-353817 |
| Jan. 27, 1997 | [JP] | Japan | 8-925756 |

[51] Int. Cl.[6] ..... G03G 5/047

[52] U.S. Cl. ..... 430/59; 430/83

[58] Field of Search ..... 430/58, 59, 83

[56] References Cited

U.S. PATENT DOCUMENTS

| | | | |
|---|---|---|---|
| 5,486,439 | 1/1996 | Sakakibara et al. | 430/59 |
| 5,567,560 | 10/1996 | Hagiwara et al. | 430/59 |

*Primary Examiner*—John Goodrow
*Attorney, Agent, or Firm*—Sughrue, Mion, Zinn, Macpeak & Seas, PLLC

[57] ABSTRACT

An electrophotographic photoreceptor comprising a charge transporting material containing at least one triphenylamine compound represented by general formula (1) and at least one compound selected from the group consisting of a hydrazone compound, a triphenylamine dimer compound and a distyryl compound:

(1)

said charge transporting material being able to express high carrier mobility, being high in solubility in a binder polymer, and being able to form a homogeneous charge transporting layer.

2 Claims, 14 Drawing Sheets

ELECTROPHOTOGRAPHIC PHOTORECEPTOR

FIELD OF THE INVENTION

The present invention relates to an electrophotographic photoreceptor, and more particularly to an electrophotographic photoreceptor comprising a charge transporting material containing at least one triphenylamine compound represented by general formula (1) and at least one compound selected from the group consisting of a hydrazone compound represented by general formula (2), a hydrazone compound represented by general formula (3), a triphenylamine dimer compound (N,N,N',N'-tetraphenylbenzidine compound) represented by general formula (4) and a distyryl compound represented by general formula (5):

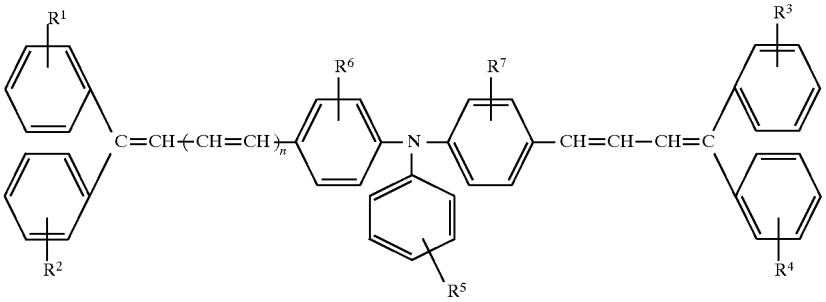

(1)

wherein $R^1$, $R^2$, $R^3$, $R^4$, $R^5$, $R^6$ and $R^7$, which may be the same or different, each represents a hydrogen atom, a lower alkyl group having 1 to 4 carbon atoms, a lower alkoxyl group having 1 to 4 carbon atoms, a halogen atom or a phenyl group which may be substituted by a lower alkyl group having 1 to 4 carbon atoms, a lower alkoxyl group having 1 to 4 carbon atoms or a halogen atom; and n represents 0 or 1;

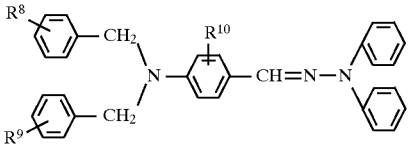

(2)

wherein $R^8$, $R^9$ and $R^{10}$, which may be the same or different, each represents a hydrogen atom, a lower alkyl group having 1 to 4 carbon atoms, a lower alkoxyl group having 1 to 4 carbon atoms or a halogen atom;

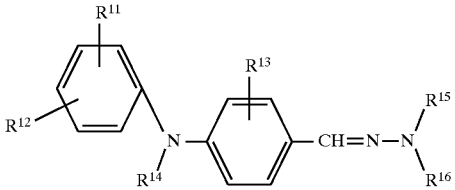

(3)

wherein $R^{11}$, $R^{12}$ and $R^{13}$, which may be the same or different, each represents a hydrogen atom, a lower alkyl group having 1 to 4 carbon atoms, a lower alkoxyl group having 1 to 4 carbon atoms or a halogen atom, and $R^{11}$ or $R^{12}$ may form a nitrogen-containing heterocycle unsubstituted or substituted by a lower alkyl group having 1 to 4 carbon atoms, a lower alkoxyl group having 1 to 4 carbon atoms, an aryl group or a halogen atom, together with $R^{13}$; $R^{14}$ represents a lower alkyl group having 1 to 4 carbon atoms, a phenyl group which may be substituted by a lower alkyl group having 1 to 4 carbon atoms, a lower alkoxyl group having 1 to 4 carbon atoms or a halogen atom, a benzyl group which may be substituted by a lower alkyl group having 1 to 4 carbon atoms, a lower alkoxyl group having 1 to 4 carbon atoms or a halogen atom, or a naphthylmethyl group which may be substituted by a lower alkyl group having 1 to 4 carbon atoms, a lower alkoxyl group having 1 to 4 carbon atoms or a halogen atom, and may form a nitrogen-containing heterocycle unsubstituted or substituted by a lower alkyl group having 1 to 4 carbon atoms, a lower alkoxyl group having 1 to 4 carbon atoms, an aryl group or a halogen atom, together with $R^{11}$, $R^{12}$ or $R^{13}$; and $R^{15}$ and $R^{16}$ each represents a lower alkyl group having 1 to 4 carbon atoms, a phenyl group which may be substituted by a lower alkyl group having 1 to 4 carbon atoms, a lower alkoxyl group having 1 to 4 carbon atoms or a halogen atom, a naphthyl group which may be substituted by a lower alkyl group having 1 to 4 carbon atoms, a lower alkoxyl group having 1 to 4 carbon atoms or a halogen atom, or a benzyl group which may be substituted by a lower alkyl group having 1 to 4 carbon atoms, a lower alkoxyl group having 1 to 4 carbon atoms or a halogen atom, and $R^{15}$ and $R^{16}$ may form together a nitrogen-containing heterocycle unsubstituted or substituted by a lower alkyl group having 1 to 4 carbon atoms, a lower alkoxyl group having 1 to 4 carbon atoms, an aryl group or a halogen atom;

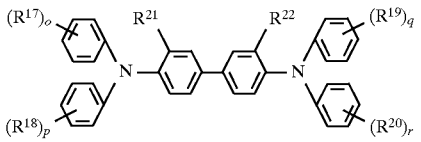

(4)

wherein $R^{17}$, $R^{18}$, $R^{19}$ and $R^{20}$, which may be the same or different, each represents a lower alkyl group having 1 to 4 carbon atoms, a lower alkoxyl group having 1 to 4 carbon atoms or a halogen atom; o, p, q and r each represents 0, 1 or 2; and $R^{21}$ and $R^{22}$, which may be the same or different, each represents a hydrogen atom, a lower alkyl group having 1 to 4 carbon atoms, a lower alkoxyl group having 1 to 4 carbon atoms or a halogen atom;

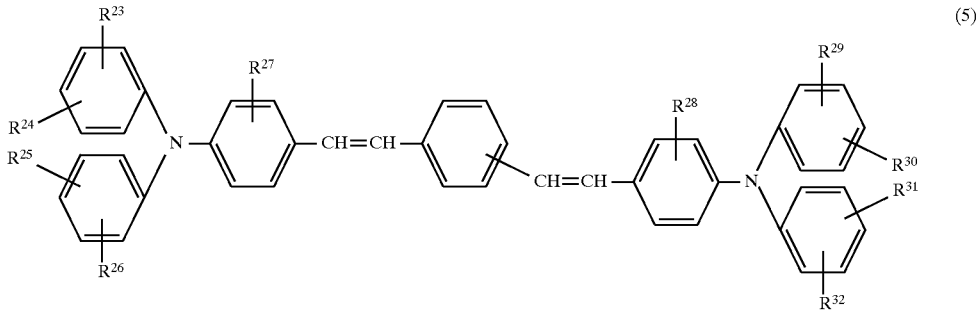

(5)

wherein $R^{23}$, $R^{24}$, $R^{25}$, $R^{26}$, $R^{27}$, $R^{28}$, $R^{29}$, $R^{30}$, $R^{31}$ and $R^{32}$, which may be the same or different, each represents a hydrogen atom, a lower alkyl group having 1 to 4 carbon atoms, a lower alkoxyl group having 1 to 4 carbon atoms or a halogen atom, and the central phenyl group may be substituted by two ethylene groups at the o-, p- or m-positions.

BACKGROUND OF THE INVENTION

Organic photoconductive materials are excellent in mass productivity and incur little risk of causing pollution problems when discarded, compared with inorganic photoconductive materials such as selenium alloys, cadmium sulfide and zinc oxide. They have therefore been widely used as photoreceptors for copying machines or printers utilizing electrophotographic systems. In particular, the function separation type laminated photoreceptors are high in material selectivity and easy in functional design, compared with the monolayer type photoreceptors, so that applied research and development thereof in many fields have been made. The function separation type laminated photoreceptors comprises charge generating layers for generating carriers (charge) by light and charge transporting layers for efficiently transporting the carriers generated in the charge generating layers and neutralizing surface charge, and have the possibility of providing electrophotographic photoreceptors high in electrophotographic characteristics such as charging characteristics, sensitivity and residual potential.

Of these, the characteristics of charge transporting materials constituting the charge transporting layers require efficient receiving of the carriers generated in the charge generating layers, rapid transportation of the carriers in the photoreceptor layers and rapid neutralization of surface charge. For example, charge transporting materials such as hydrazone compounds (JP-A-59-223432 (the term "JP-A" as used herein means an "unexamined published Japanese patent application") and JP-A-60-173112), triphenylamine compounds (JP-A-7-173112), distyryl compounds (JP-A-63-269158), triphenylamine dimer compounds (N,N,N',N'-tetraphenylbenzidine compounds) (*Denshi Shasin Gakkai Shi* (Journal of Electrophotographic Society) 30, 16–21 (1991) and heterocyclic compounds such as poly-N-vinylcarbazole and oxadiazole are already known. When they are used alone, however, some compounds are liable to suffer from light fatigue and cause an increase in residual potential in repeated use. Further, there are still many unsolved problems with respect to the compatibility with binder polymers, and the like.

On the other hand, it has been attempted that specified compounds selected from the known charge transporting materials are used in combination. For example, mixtures of hydrazone compounds and tetraphenylbutadiene compounds (JP-A-63-223755), and mixtures of distyrene compounds and butadiene compounds (JP-A-3-252861) are known. The former discloses that the problem of the light fatigue phenomenon is solved, and the latter discloses that the problem of prevention of a decrease in residual potential is solved. However, even such photoreceptors are not sufficiently high in light sensitivity yet.

Further, use of two positive hole transporting materials, poly(N-vinylcarbazole) and N,N'-diphenyl-N,N'-bis(3-methylphenyl)-(1,1-biphenyl)-4,4'-diamine, as a mixture is described in *J. Phys. Chem.* 88 (20), 4714–4717 (1984). However, it was observed that combined use of the two materials more reduced the mobility at certain mixing ratios than single use of each material. Accordingly, in some cases, even if two kinds of compounds selected as charge transporting materials both independently exhibit high mobility, they result in decreased performance of the charge transporting materials, leading to the failure to sufficiently keep the characteristics necessary for electrophotographic photoreceptors.

As described above, for the charge transporting materials obtained by mixing two kinds of compounds, ones satisfying all various desirable characteristics such as high charging performance in the dark, high static charge keeping ability, high mobility of charge generated in light irradiation and formation ability of charge transporting layers which are high in solubility in binder polymers and homogeneous have not necessarily been obtained yet at present.

Accordingly, in the charge transporting materials, it has been expected to obtain materials in which the above-mentioned disadvantages are overcome, higher carrier mobility can be exhibited, and various excellent characteristics can be expressed even when the electrophotographic photoreceptors are formed, and the electrophotographic photoreceptors comprising the charge transporting materials having such excellent characteristics have been desired.

SUMMARY OF THE INVENTION

The present inventors have made intensive studies to discover highly sensitive electrophotographic photoreceptors which can form homogeneous, stable charge transporting layers and satisfy various characteristics, giving attention to the characteristics of triphenylamine compounds high in carrier mobility. As a result, the present inventors have discovered that a system in which triphenylamine compounds are combined with hydrazone compounds, triphenylamine dimer compounds (N,N,N',N'-tetraphenylbenzidine compounds) or distyryl compounds which are good in solubility in binders does not reduce carrier mobility, is low in residual potential and can express highly sensitive photoreceptor performance. Further, the present inventors have discovered that electrophotographic photoreceptors produced by using charge transporting materials consisting of mixtures of triphenylamine compounds and hydrazone compounds, triphenylamine dimer compounds (N,N,N',N'-tetraphenylbenzidine compounds) or distyryl compounds also show no light fatigue even after use for a long period of time, do not increase residual potential, do not cau, images, and have highly sensitive, excellent light response thus completing the present invention.

That is, the present invention provides an electrophotographic photoreceptor comprising a charge transporting material containing at least one triphenylamine compound represented by general formula (1) and at least one compound selected from the group consisting of a hydrazone compound represented by general formula (2), a hydrazone compound represented by general formula (3), a triphenylamine dimer compound (N,N,N',N'-tetraphenylbenzidine compound) represented by general formula (4) and a distyryl compound represented by general formula (5):

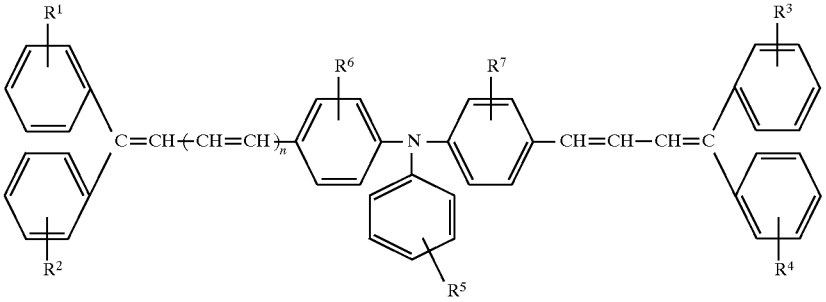

(1)

wherein $R^1$, $R^2$, $R^3$, $R^4$, $R^5$, $R^6$ and $R^7$, which may be the same or different, each represents a hydrogen atom, a lower alkyl group having 1 to 4 carbon atoms, a lower alkoxyl group having 1 to 4 carbon atoms, a halogen atom or a phenyl group which may be substituted by a lower alkyl group having 1 to 4 carbon atoms, a lower alkoxyl group having 1 to 4 carbon atoms or a halogen atom; and n represents 0 or 1;

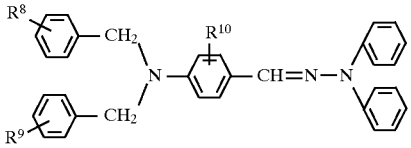

(2)

wherein $R^8$, $R^9$ and $R^{10}$, which may be the same or different, each represents a hydrogen atom, a lower alkyl group having 1 to 4 carbon atoms, a lower alkoxyl group having 1 to 4 carbon atoms or a halogen atom;

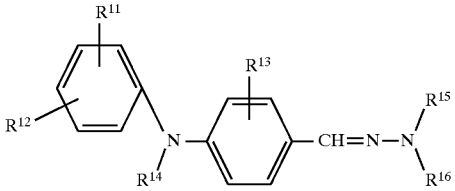

(3)

wherein $R^{11}$, $R^{12}$ and $R^{13}$, which may be the same or different, each represents a hydrogen atom, a lower alkyl group having 1 to 4 carbon atoms, a lower alkoxyl group having 1 to 4 carbon atoms or a halogen atom, and $R^{11}$ or $R^{12}$ may form a nitrogen-containing heterocycle unsubstituted or substituted by a lower alkyl group having 1 to 4 carbon atoms, a lower alkoxyl group having 1 to 4 carbon atoms, an aryl group or a halogen atom, together with $R^{13}$; $R^{14}$ represents a lower alkyl group having 1 to 4 carbon atoms, a phenyl group which may be substituted by a lower alkyl group having 1 to 4 carbon atoms, a lower alkoxyl group having 1 to 4 carbon atoms or a halogen atom, a benzyl group which may be substituted by a lower alkyl group having 1 to 4 carbon atoms, a lower alkoxyl group having 1 to 4 carbon atoms or a halogen atom, or a naphthylmethyl group which may be substituted by a lower alkyl group having 1 to 4 carbon atoms, a lower alkoxyl group having 1 to 4 carbon atoms or a halogen atom, and may form a nitrogen-containing heterocycle unsubstituted or substituted by a lower alkyl group having 1 to 4 carbon atoms, a lower alkoxyl group having 1 to 4 carbon atoms, an aryl group or a halogen atom, together with $R^{11}$, $R^{12}$ or $R^{13}$; and $R^{15}$ and $R^{16}$ each represents a lower alkyl group having 1 to 4 carbon atoms, a phenyl group which may be substituted by a lower alkyl group having 1 to 4 carbon atoms, a lower alkoxyl group having 1 to 4 carbon atoms or a halogen atom, a naphthyl group which may be substituted by a lower alkyl group having 1 to 4 carbon atoms, a lower alkoxyl group having 1 to 4 carbon atoms or a halogen atom, or a benzyl group which may be substituted by a lower alkyl group having 1 to 4 carbon atoms, a lower alkoxyl group having 1 to 4 carbon atoms or a halogen atom, and $R^{15}$ and $R^{16}$ may form together a nitrogen-containing heterocycle unsubstituted or substituted by a lower alkyl group having 1 to 4 carbon atoms, a lower alkoxyl group having 1 to 4 carbon atoms, an aryl group or a halogen atom;

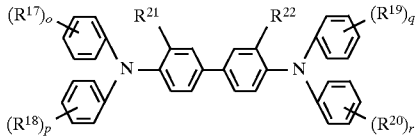

(4)

wherein $R^{17}$, $R^{18}$, $R^{19}$ and $R^{20}$, which may be the same or different, each represents a lower alkyl group having 1 to 4 carbon atoms, a lower alkoxyl group having 1 to 4 carbon atoms or a halogen atom; o, p, q and r each represents 0, 1 or 2; and $R^{21}$ and $R^{22}$, which may be the same or different, each represents a hydrogen atom, a lower alkyl group having 1 to 4 carbon atoms, a lower alkoxyl group having 1 to 4 carbon atoms or a halogen atom;

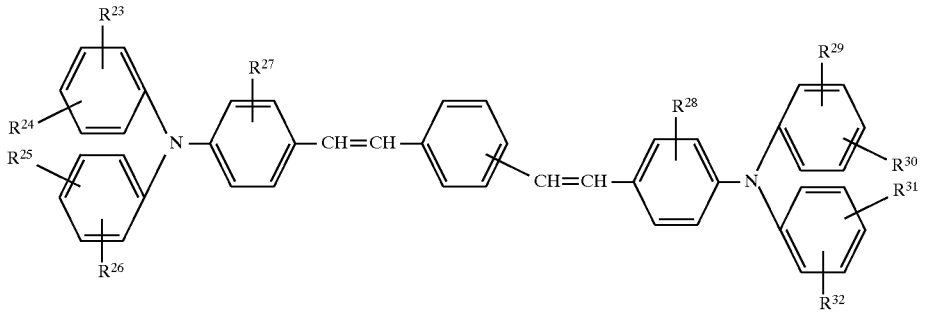

(5)

wherein $R^{23}$, $R^{24}$, $R^{25}$, $R^{26}$, $R^{27}$, $R^{28}$, $R^{29}$, $R^{30}$, $R^{31}$ and $R^{32}$, which may be the same or different, each represents a hydrogen atom, a lower alkyl group having 1 to 4 carbon atoms, a lower alkoxyl group having 1 to 4 carbon atoms or a halogen atom, and the central phenyl group may be substituted by two ethylene groups at the o-, p- or m-positions.

DETAILED DESCRIPTION OF THE INVENTION

Figure 1A:
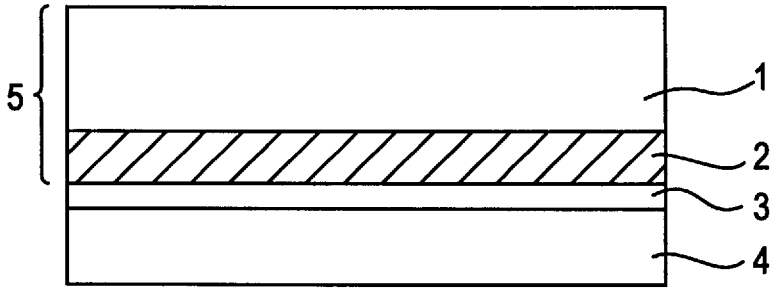
FIGS. 1(*a*) to 1(*c*) are sectional views showing layer structures of electrophotographic photoreceptors.

In the present invention, the triphenylamine compounds represented by general formula (1) described above can be obtained, for example, by the method described in JP-A-7-173112.

In general formula (1) described above, substituent groups $R^1$, $R^2$, $R^3$, $R^4$, $R^5$, $R^6$ and $R^7$, which may be the same or different, each represents a hydrogen atom, a lower alkyl group having 1 to 4 carbon atoms, a lower alkoxyl group having 1 to 4 carbon atoms, a halogen atom or a phenyl group which may be substituted by a lower alkyl group having 1 to 4 carbon atoms, a lower alkoxyl group having 1 to 4 carbon atoms or a halogen atom.

Preferably, $R^1$, $R^2$, $R^3$, $R^4$, $R^5$, $R^6$ and $R^7$, which may be the same or different, each represents a hydrogen atom, a lower alkyl group having 1 or 2 carbon atoms, a methoxy group, a chlorine atom, a bromine atom, a phenyl group or p-tolyl group.

Of these, examples of the lower alkyl groups having 1 and 2 carbon atoms include methyl and ethyl, and methyl is particularly preferred.

In the present invention, preferred examples of the triphenylamine compounds represented by general formula (1) described above include but are not limited to compounds shown in Tables 1, 2 and 3 given below. The abbreviations used in Tables 1, 2 and 3 have the following meanings, respectively. The abbreviations hereinafter used in compounds in this specification also have the same meanings. The numeral indicates the position of a substituent group in a phenyl group (for example, 4-Me means a methyl group substituted at the 4-position of a phenyl group).

Me: Methyl group
Et: Ethyl group
F: Fluorine atom
Cl: Chlorine atom
Br: Bromine atom
I: Iodine atom
OMe: Methoxy group
OEt: Ethoxy group
p-Tol: p-Tolyl group
Ph: Phenyl group
α-Np: α-Naphthyl group
Bn: Benzyl group
nPr: n-Propyl group
iPr: Isopropyl group
iBu: Isobutyl group
O-nPr: n-Propoxy group
O-nBu: n-Butoxy group
O-iPr: Isopropoxy group
O-iBu: Isobutoxy group
p-MeOPh: p-Methoxyphenyl group

TABLE 1

| Example compound | n | $R^1$ | $R^2$ | $R^3$ | $R^4$ | $R^5$ | $R^6$ | $R^7$ |
|---|---|---|---|---|---|---|---|---|
| | | General Formula (1) | | | | | | |
| 1 | 0 | H | H | H | H | H | H | H |
| 2 | 0 | H | H | H | H | H | 2-Me | 2-Me |
| 3 | 0 | H | H | H | H | H | 3-Me | 3-Me |
| 4 | 0 | H | H | H | H | 4-Me | H | H |
| 5 | 0 | H | H | H | H | 4-Me | 2-Me | 2-Me |
| 6 | 0 | H | H | H | H | 4-OMe | H | H |
| 7 | 0 | H | H | H | H | 4-OMe | 2-Me | 2-Me |
| 8 | 0 | H | H | H | H | 4-(p-Tol) | H | H |
| 9 | 0 | H | H | H | H | 4-(p-Tol) | 2-Me | 2-Me |
| 10 | 0 | H | H | H | H | 4-Br | H | H |
| 11 | 0 | H | H | H | H | 4-Br | 3-Me | 3-Me |
| 12 | 0 | H | H | H | H | 4-Cl | H | H |
| 13 | 0 | H | H | H | H | 4-Cl | 3-Me | 3-Me |
| 14 | 0 | H | H | 4-Me | 4-Me | H | H | H |
| 15 | 0 | H | H | 4-Me | 4-Me | 3-Me | H | H |
| 16 | 0 | 3-Me | 3-Me | H | H | H | H | H |
| 17 | 0 | 3-Me | 3-Me | H | H | 3-Me | H | H |
| 18 | 0 | 3-Me | 3-Me | 4-Me | 4-Me | H | H | H |
| 19 | 0 | 3-Me | 3-Me | 4-Me | 4-Me | 3-Me | H | H |
| 20 | 0 | 4-Me | 4-Me | 4-Me | 4-Me | H | H | H |

TABLE 2

| Example compound | n | $R^1$ | $R^2$ | $R^3$ | $R^4$ | $R^5$ | $R^6$ | $R^7$ |
|---|---|---|---|---|---|---|---|---|
| | | General Formula (1) | | | | | | |
| 21 | 1 | H | H | H | H | H | H | H |
| 22 | 1 | H | H | H | H | H | 2-Me | 2-Me |
| 23 | 1 | H | H | H | H | 2-Me | H | H |
| 24 | 1 | H | H | H | H | 4-Me | H | H |
| 25 | 1 | H | H | H | H | 4-Me | 3-Me | 3-Me |
| 26 | 1 | H | H | H | H | 4-OMe | H | H |
| 27 | 1 | H | H | H | H | 4-OMe | 3-Me | 3-Me |
| 28 | 1 | H | H | H | H | 4-(p-Tol) | H | H |
| 29 | 1 | H | H | H | H | 4-(p-Tol) | 2-Me | 2-Me |
| 30 | 1 | H | H | 3-Me | 3-Me | H | H | H |
| 31 | 1 | H | H | 3-Me | 3-Me | 4-Me | H | H |
| 32 | 1 | H | H | 4-Me | 3-Me | H | H | H |
| 33 | 1 | H | H | 4-Me | 4-Me | 4-Me | H | H |
| 34 | 1 | H | H | 4-Me | 4-Me | 4-Br | H | H |
| 35 | 1 | H | H | 4-Me | 4-Me | 4-Br | 3-Me | 3-Me |
| 36 | 1 | H | H | 4-Cl | 4-Cl | H | H | H |
| 37 | 1 | H | H | 4-Cl | 4-Cl | 4-Me | H | H |
| 38 | 1 | H | 4-Me | H | 4-Me | H | H | H |
| 39 | 1 | H | 4-Me | H | 4-Me | 4-Me | H | H |
| 40 | 1 | 3-Me | 3-Me | 4-Me | 4-Me | H | H | H |

TABLE 3

| Example compound | n | $R^1$ | $R^2$ | $R^3$ | $R^4$ | $R^5$ | $R^6$ | $R^7$ |
|---|---|---|---|---|---|---|---|---|
| | | General Formula (1) | | | | | | |
| 41 | 1 | 3-Me | 3-Me | 4-Me | 4-Me | 2-Me | H | H |
| 42 | 1 | 4-Me | 4-Me | 4-Me | 4-Me | H | H | H |
| 43 | 1 | 4-Me | 4-Me | 4-Me | 4-Me | H | 2-Me | 2-Me |
| 44 | 1 | 4-Me | 4-Me | 4-Me | 4-Me | H | 3-Me | 3-Me |
| 45 | 1 | 4-Me | 4-Me | 4-Me | 2-Me | 2-Me | H | H |
| 46 | 1 | 4-Me | 4-Me | 4-Me | 4-Me | 4-Me | 3-Me | 3-Me |
| 47 | 1 | 4-Me | 4-Me | 4-Me | 4-Me | 4-Me | H | H |
| 48 | 1 | 4-Me | 4-Me | 4-Me | 4-Me | 4-Me | 2-Me | 2-Me |
| 49 | 1 | 4-Me | 4-Me | 4-Me | 4-Me | 4-Et | 3-Me | 3-Me |
| 50 | 1 | 4-Me | 4-Me | 4-Me | 4-Me | 4-Et | H | H |
| 51 | 1 | 4-Me | 4-Me | 4-Me | 4-Me | 4-Et | 2-Me | 2-Me |
| 52 | 1 | 4-Me | 4-Me | 4-Me | 4-Me | 4-OEt | H | H |
| 53 | 1 | 4-Me | 4-Me | 4-Me | 4-Me | 4-(p-Tol) | H | H |

TABLE 3-continued

| Example compound | n | $R^1$ | $R^2$ | $R^3$ | $R^4$ | $R^5$ | $R^6$ | $R^7$ |
|---|---|---|---|---|---|---|---|---|
| | | General Formula (1) | | | | | | |
| 54 | 1 | 4-Me | 4-Me | 4-Me | 4-Me | 4-Br | H | H |
| 55 | 1 | 4-Me | 4-Me | 4-OMe | 4-OMe | H | H | H |
| 56 | 1 | 4-Me | 4-Me | 4-Cl | 4-Cl | H | H | H |
| 57 | 1 | 4-OMe | 4-OMe | 4-OMe | 4-OMe | H | H | H |
| 58 | 1 | 4-OMe | 4-OMe | 4-OMe | 4-OMe | 4-Me | H | H |
| 59 | 1 | 4-Cl | 4-Cl | 4-Cl | 4-Cl | H | H | H |
| 60 | 1 | 4-Cl | 4-Cl | 4-Cl | 4-Cl | 4-Me | H | H |

For the compounds represented by general formula (2) described above in the present invention, substituent groups $R^8$, $R^9$ and $R^{10}$ in general formula (2), which may be the same or different, each represents a hydrogen atom, a lower alkyl group having 1 to 4 carbon atoms, a lower alkoxyl group having 1 to 4 carbon atoms or a halogen atom.

Preferably, $R^8$, $R^9$ and $R^{10}$, which may be the same or different, each represents a hydrogen atom, a lower alkyl group having 1 to 4 carbon atoms, a methoxy group or a chlorine atom.

Of these, examples of the lower alkyl groups having 1 to 4 carbon atoms include methyl, ethyl, n-propyl, isopropyl, n-butyl and isobutyl, and methyl and ethyl are particularly preferred.

Preferred examples of the hydrazone compounds represented by general formula (2) described above in the present invention include but are not limited to compounds shown in Table 4 given below.

The abbreviations used in Table 4 have the same meanings as given above. The numeral indicates the position of a substituent group in a phenyl group (for example, 4-Me means a methyl group substituted at the 4-position of a phenyl group).

TABLE 4

| Example compound | $R^8$ | $R^9$ | $R^{10}$ |
|---|---|---|---|
| | General Formula (2) | | |
| 61 | H | H | H |
| 62 | H | H | 2-Me |
| 63 | H | H | 3-Me |
| 64 | H | H | 2-OMe |
| 65 | 4-Me | H | H |
| 66 | 4-Me | H | 2-Me |
| 67 | 4-Me | H | 2-Et |
| 68 | 4-Me | H | 2-nPr |
| 69 | 2-Me | H | H |
| 70 | 4-Me | 4-Me | H |
| 71 | 4-Me | 4-Me | 2-Me |
| 72 | 4-Me | 4-Me | 2-nPr |
| 73 | 4-OMe | H | H |
| 74 | 4-OMe | H | 2-Me |
| 75 | 4-OMe | 4-OMe | H |
| 76 | 4-OMe | 4-OMe | 2-Cl |
| 77 | 4-OMe | 4-OMe | 2-Cl |
| 78 | 4-Cl | H | H |
| 79 | 4-Cl | H | 2-Me |
| 80 | 4-Cl | 4-Cl | H |

The hydrazone compounds represented by general formula (3) described above in the present invention can be obtained by reacting corresponding aldehydes with hydrazine compounds in inactive organic solvents, for example, according to the method described in JP-A-60-255854.

In general formula (3) described above, $R^{11}$, $R^{12}$ and $R^{13}$, which may be the same or different, each represents a hydrogen atom, a lower alkyl group having 1 to 4 carbon atoms, a lower alkoxyl group having 1 to 4 carbon atoms or a halogen atom, and $R^{11}$ or $R^{12}$ may form a nitrogen-containing heterocycle unsubstituted or substituted by a lower alkyl group having 1 to 4 carbon atoms, a lower alkoxyl group having 1 to 4 carbon atoms, an aryl group or a halogen atom, together with $R^{13}$. $R^{14}$ represents a lower alkyl group having 1 to 4 carbon atoms, a phenyl group which may be substituted by a lower alkyl group having 1 to 4 carbon atoms, a lower alkoxyl group having 1 to 4 carbon atoms or a halogen atom, a benzyl group which may be substituted by a lower alkyl group having 1 to 4 carbon atoms, a lower alkoxyl group having 1 to 4 carbon atoms or a halogen atom, or a naphthylmethyl group which may be substituted by a lower alkyl group having 1 to 4 carbon atoms, a lower alkoxyl group having 1 to 4 carbon atoms or a halogen atom, and may form a nitrogen-containing heterocycle unsubstituted or substituted by a lower alkyl group having 1 to 4 carbon atoms, a lower alkoxyl group having 1 to 4 carbon atoms, an aryl group or a halogen atom, together with $R^{11}$, $R^{12}$ or $R^{13}$. $R^{15}$ and $R^{16}$ each represents a lower alkyl group having 1 to 4 carbon atoms, a phenyl group which may be substituted by a lower alkyl group having 1 to 4 carbon atoms, a lower alkoxyl group having 1 to 4 carbon atoms or a halogen atom, a naphthyl group which may be substituted by a lower alkyl group having 1 to 4 carbon atoms, a lower alkoxyl group having 1 to 4 carbon atoms or a halogen atom, or a benzyl group which may be substituted by a lower alkyl group having 1 to 4 carbon atoms, a lower alkoxyl group having 1 to 4 carbon atoms or a halogen atom, and $R^{15}$ and $R^{16}$ may form together a nitrogen-containing heterocycle unsubstituted or substituted by a lower alkyl group having 1 to 4 carbon atoms, a lower alkoxyl group having 1 to 4 carbon atoms, an aryl group or a halogen atom.

Preferably, $R^{11}$, $R^{12}$ and $R^{13}$, which may be the same or different, each represents a hydrogen atom, a lower alkyl group having 1 to 4 carbon atoms, a methoxy group, an ethoxy group, a chlorine atom or a bromine atom, and $R^{11}$ or $R^{12}$ may form a single bond together with $R^{13}$. $R^{14}$ represents a lower alkyl group having 1 to 4 carbon atoms, a phenyl group which may be substituted by a methoxy group, or a benzyl group, and may form an alkylene group having 2 or 3 carbon atoms together with $R^{13}$. $R^{15}$ and $R^{16}$ each represents a methyl group, a phenyl group, a naphthyl group or a benzyl group, and $R^{15}$ and $R^{16}$ may form together an indoline ring, a carbazole ring or a 1,2,3,4-tetrahydroquinoline ring each of which may be substituted by a lower alkyl group having 1 to 4 carbon atoms or methoxy group.

Of these, examples of the lower alkyl groups having 1 to 4 carbon atoms include methyl, ethyl, n-propyl, isopropyl, n-butyl and isobutyl, and methyl and ethyl are particularly preferred.

Further, the phenyl groups which may be substituted by lower alkyl groups having 1 to 4 carbon atoms or methoxy groups include, for example, phenyl, phenyl groups substituted by lower alkyl groups having 1 to 4 carbon atoms such as p-tolyl and 2,4-dimethylphenyl, and phenyl groups substituted by methoxy groups such as p-methoxyphenyl.

In general formula (3) described above in the present invention, $R^{11}$ or $R^{12}$ may form a single bond together with $R^{13}$. For example, when $R^{11}$ or $R^{12}$ which is at the 2-position of a phenyl group forms a single bond together with $R^{13}$ which is at the 2-position of a phenyl group, a carbazole ring is formed together with a nitrogen atom.

$R^{14}$ may form an alkylene group having 2 or 3 carbon atoms together with $R^{13}$. For example, when $R^{14}$ forms an ethylene group together with $R^{13}$ which is at the 2-position of a phenyl group, an indoline ring is formed together with a nitrogen atom. When $R^{14}$ forms a propylene group together with $R^{13}$, a 1,2,3,4-tetrahydroquinoline ring is formed together with a nitrogen atom.

The lower alkyl groups having 1 to 4 carbon atoms by which indoline rings, carbazole rings or 1,2,3,4-tetrahydroquinoline rings may be substituted include, for example, methyl, ethyl, n-propyl, isopropyl, n-butyl and isobutyl, and methyl is particularly preferred.

Preferred examples of the hydrazone compounds represented by general formula (3) described above in the present invention include but are not limited to compounds shown in Tables 5 to 7 given below.

The abbreviations used in Tables 5 to 7 have the same meanings as given above. The numeral indicates the position of a substituent group in a phenyl group, and N indicates a nitrogen atom (for example, (2,2)-(single bond) means that the 2-position of a phenyl group is linked by a single bond to the 2-position of a phenyl group, and (N, 2)—(—$(CH_2)_3$—) means that a nitrogen atom is linked by a propylene chain to the 2-position of a phenyl group).

Further, (a) to (j) are represented by the following formulas:

(a)

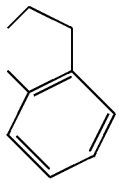

(b)

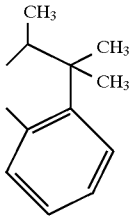

(c)

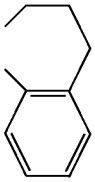

-continued (d)

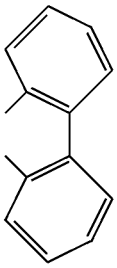

(e)

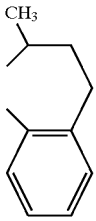

(f)

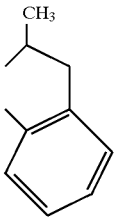

(g)

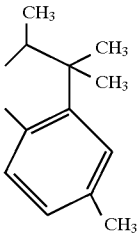

(h)

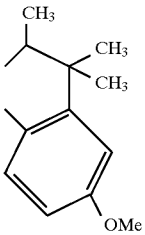

(i)

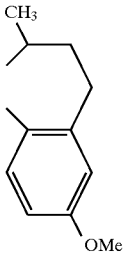

-continued (j)

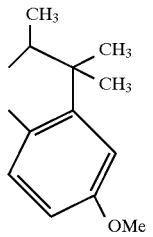

TABLE 5

General Formula (3)

| Example compound | $R^{11}$ | $R^{12}$ | $R^{13}$ | $R^{14}$ | $R^{15}$ | $R^{16}$ |
|---|---|---|---|---|---|---|
| 81 | H | H | H | Ph | Ph | Ph |
| 82 | H | H | H | Ph | Ph | Me |
| 83 | H | H | H | Ph | Ph | α-Np |
| 84 | H | H | H | Ph | (a) | |
| 85 | H | H | H | Ph | (b) | |
| 86 | H | H | H | Ph | (c) | |
| 87 | H | (2,2)-(single bond) | | Et | Ph | Ph |
| 88 | H | (2,2)-(single bond) | | Et | (b) | |
| 89 | H | (2,2)-(single bond) | | Et | (a) | |
| 90 | H | (2,2)-(single bond) | | Et | (c) | |
| 91 | H | H | (N,2)-(-$(CH_2)_3$-) | | Ph | Ph |
| 92 | H | H | (N,2)-(-$(CH_2)_3$-) | | Ph | Me |
| 93 | H | 4-Me | H | p-Tol | Ph | Ph |
| 94 | H | 4-Me | H | Ph | Ph | Me |
| 95 | H | 4-OMe | H | Ph | (a) | |
| 96 | H | 4-Br | H | Ph | (b) | |
| 97 | 2-Me | 4-Me | H | p-Tol | Ph | α-Np |
| 98 | H | 4-Et | H | p-Tol | Ph | Ph |
| 99 | H | H | H | H | P-Tol | Me |
| 100 | H | H | H | Ph | (d) | |

TABLE 6

General Formula (3)

| Example compound | $R^{11}$ | $R^{12}$ | $R^{13}$ | $R^{14}$ | $R^{15}$ | $R^{16}$ |
|---|---|---|---|---|---|---|
| 101 | H | H | H | Ph | (b) | |
| 102 | H | H | H | Ph | (e) | |
| 103 | H | (2,2)-(single bond) | | i-Pr | Ph | Ph |
| 104 | H | (2,2)-(single bond) | | Et | (b) | |
| 105 | H | (2,2)-(single bond) | | Et | Bn | Ph |
| 106 | H | H | (N,2)-(-$(CH_2)_3$-) | | (b) | |
| 107 | H | H | (N,2)-(-$(CH_2)_3$-) | | (e) | |
| 108 | H | H | H | Bn | Ph | Ph |
| 109 | H | H | H | Ph | Bn | Ph |
| 110 | H | H | H | Ph | (f) | |
| 111 | H | (2,2)-(single bond) | | Et | (f) | |
| 112 | H | H | H | Bn | Bn | Ph |
| 113 | H | 4-OEt | H | p-Tol | Ph | Ph |
| 114 | H | 4-Cl | H | Ph | p-Tol | Me |
| 115 | H | 4-Me | H | Ph | (d) | |
| 116 | H | 4-OMe | H | Ph | (g) | |
| 117 | H | 4-OMe | H | p-MeOPh | (e) | |
| 118 | H | (2,2)-(single bond) | | i-Pr | Ph | p-Tol |
| 119 | 4-Br | (2,2)-(single bond) | | Et | (h) | |
| 120 | H | (2,2)-(single bond) | | Et | Bn | p-Tol |

TABLE 7

General Formula (3)

| Example compound | $R^{11}$ | $R^{12}$ | $R^{13}$ | $R^{14}$ | $R^{15}$ | $R^{16}$ |
|---|---|---|---|---|---|---|
| 121 | H | 4-Me | (N,2)-(-$(CH_2)_3$-) | | (h) | |
| 122 | H | H | (N,2)-(-$(CH_2)_3$-) | | (i) | |
| 123 | H | 4-Me | 3-Me | Bn | Ph | Ph |
| 124 | H | 4-OMe | H | p-Tol | Bn | Ph |
| 125 | 2-OMe | 4-Me | H | p-MeOPh | (f) | |
| 126 | H | (2,2)-(single bond) | | Et | (j) | |
| 127 | H | 4-Me | H | Bn | Bn | Ph |
| 128 | H | H | H | Me | Ph | Ph |

The triphenylamine dimer compounds (N,N,N',N'-tetraphenylbenzidine compounds) represented by general formula (4) described above in the present invention can be obtained, for example, by reacting corresponding diarylamines with diiodobiphenyl derivatives in inactive organic solvents *Denshi Shasin Gakkai Shi* (Journal of Electrophotographic Society) 30, 16–21 (1991)).

In general formula (4) described above in the present invention, substituent groups $R^{17}$, $R^{18}$, $R^{19}$ and $R^{20}$, which may be the same or different, each represents a lower alkyl group having 1 to 4 carbon atoms, a lower alkoxyl group having 1 to 4 carbon atoms or a halogen atom; o, p, q and r each represents 0, 1 or 2; and $R^{21}$ and $R^{22}$, which may be the same or different, each represents a hydrogen atom, a lower alkyl group having 1 to 4 carbon atoms, a lower alkoxyl group having 1 to 4 carbon atoms or a halogen atom.

Preferably, $R^{17}$ $R^{18}$, $R^{19}$ and $R^{20}$, which may be the same or different, each represents a lower alkyl group having 1 to 4 carbon atoms, a lower alkoxyl group having 1 to 4 carbon atoms or a halogen atom; o, p, q and r each represents 0, 1 or 2; and $R^{21}$ and $R^{22}$, which may be the same or different, each represents a hydrogen atom, a methyl group, a methoxy group or a chlorine atom.

Of these, examples of the lower alkyl groups having 1 to 4 carbon atoms include methyl, ethyl, n-propyl, isopropyl, n-butyl and isobutyl, and methyl and ethyl are particularly preferred.

The lower alkoxyl groups having 1 to 4 carbon atoms include methoxy, ethoxy, propoxy and butoxy, and methoxy and ethoxy are particularly preferred.

The halogen atoms include, for example, fluorine, chlorine, bromine and iodine.

Preferred examples of the triphenylamine dimer compounds (N,N,N',N'-tetraphenylbenzidine compounds) represented by general formula (4) described above in the present invention include but are not limited to compounds shown in Tables 8 to 10 given below.

The abbreviations used in Tables 8 to 10 have the same meanings as given above.

TABLE 8

| Example compound | o | $R^{17}$ | p | $R^{18}$ | q | $R^{19}$ | r | $R^{20}$ | $R^{21}$ | $R^{22}$ |
|---|---|---|---|---|---|---|---|---|---|---|
| | | | | General Formula (4) | | | | | | |
| 129 | 0 | — | 0 | — | 0 | — | 0 | — | H | H |
| 130 | 1 | 4-Me | 0 | — | 1 | 4-Me | 0 | — | H | H |
| 131 | 1 | 3-Me | 0 | — | 1 | 3-Me | 0 | — | H | H |
| 132 | 2 | 2-Me<br>4-Me | 0 | — | 2 | 2-Me<br>4-Me | 0 | — | H | H |
| 133 | 0 | — | 0 | — | 0 | — | 0 | — | Me | Me |
| 134 | 1 | 4-Me | 0 | — | 1 | 4-Me | 0 | — | Me | Me |
| 135 | 1 | 3-Me | 0 | — | 1 | 3-Me | 0 | — | Me | Me |
| 136 | 2 | 2-Me<br>4-Me | 0 | — | 2 | 2-Me<br>4-Me | 0 | — | Me | Me |
| 137 | 1 | 4-Me | 1 | 4-Me | 1 | 4-Me | 1 | 4-Me | H | H |
| 138 | 1 | 4-Me | 1 | 3-Me | 1 | 4-Me | 1 | 3-Me | H | H |
| 139 | 1 | 3-Et | 0 | — | 1 | 3-Et | 0 | — | H | H |
| 140 | 1 | 4-Et | 0 | — | 1 | 4-Et | 0 | — | H | H |
| 141 | 1 | 4-Et | 0 | — | 1 | 4-Et | 0 | — | H | H |
| 142 | 2 | 3-Me<br>4-Me | 1 | 4-Et | 2 | 3-Me<br>4-Me | 1 | 4-Et | H | H |
| 143 | 2 | 3-Me<br>4-Me | 1 | 4-Et | 2 | 3-Me<br>4-Me | 1 | 4-Et | Me | Me |
| 144 | 1 | 4-Me | 1 | 4-Me | 1 | 4-Me | 1 | 4-Me | Me | Me |
| 145 | 1 | 4-nPr | 0 | — | 1 | 4-nPr | 0 | — | H | H |
| 146 | 1 | 3-nBu | 0 | — | 1 | 3-Me | 0 | — | H | H |
| 147 | 1 | 4-iPr | 0 | — | 1 | 4-iPr | 0 | — | H | H |
| 148 | 1 | 4-iBu | 0 | — | 1 | 4-iBu | 0 | — | Me | Me |

TABLE 9

| Example compound | o | $R^{17}$ | p | $R^{18}$ | q | $R^{19}$ | r | $R^{20}$ | $R^{21}$ | $R^{22}$ |
|---|---|---|---|---|---|---|---|---|---|---|
| | | | | General Formula (4) | | | | | | |
| 149 | 1 | 4-OMe | 0 | — | 1 | 4-OMe | 0 | — | H | H |
| 150 | 1 | 4-OMe | 0 | — | 1 | 4-Me | 0 | — | H | H |
| 151 | 1 | 3-Me | 0 | — | 1 | 4-OMe | 0 | — | H | H |
| 152 | 1 | 4-Me | 1 | 4-OMe | 1 | 4-OMe | 1 | 4-OMe | H | H |
| 153 | 1 | 4-OMe | 0 | — | 1 | 4-OMe | 0 | — | Me | Me |
| 154 | 1 | 4-OMe | 0 | — | 1 | 4-Me | 0 | — | Me | Me |
| 155 | 1 | 3-Me | 0 | — | 1 | 4-Me | 0 | — | Me | Me |
| 156 | 1 | 4-Me | 1 | 4-OMe | 1 | 4-Me | 1 | 4-OMe | Me | Me |
| 157 | 1 | 3-OMe | 0 | — | 1 | 3-OMe | 0 | — | H | H |
| 158 | 1 | 4-OMe | 1 | 3-Me | 1 | 4-OMe | 1 | 3-Me | H | H |
| 159 | 1 | 3-OEt | 0 | — | 1 | 3-OEt | 0 | — | H | H |
| 160 | 1 | 4-OEt | 0 | — | 1 | 4-OEt | 0 | — | H | H |
| 161 | 1 | 4-OMe | 0 | — | 1 | 4-Me | 0 | — | Me | Me |
| 162 | 2 | 3-OMe<br>4-OMe | 0 | — | 2 | 3-OMe<br>4-OMe | 0 | — | H | H |
| 163 | 2 | 3-OMe<br>4-OMe | 0 | — | 2 | 3-OMe<br>4-OMe | 0 | — | Me | Me |
| 164 | 1 | 4-Me | 1 | 4-Me | 1 | 4-Me | 1 | 4-Me | OMe | OMe |
| 165 | 1 | 4-O-nPr | 0 | — | 1 | 4-O-nPr | 0 | — | H | H |
| 166 | 1 | 3-O-nBu | 0 | — | 1 | 4-Me | 0 | — | H | H |
| 167 | 1 | 4-O-iPr | 0 | — | 1 | 4-O-iPr | 0 | — | H | H |
| 168 | 1 | 4-O-iBu | 0 | — | 1 | 4-O-iBu | 0 | — | Me | H |

TABLE 10

| Example compound | o | $R^{17}$ | p | $R^{18}$ | q | $R^{19}$ | r | $R^{20}$ | $R^{21}$ | $R^{22}$ |
|---|---|---|---|---|---|---|---|---|---|---|
| | | | | General Formula (4) | | | | | | |
| 169 | 1 | 4-Cl | 0 | — | 1 | 4-Cl | 0 | — | H | H |
| 170 | 1 | 4-Me | 1 | 4-Cl | 1 | 4-Me | 1 | 4-Cl | H | H |
| 171 | 1 | 3-Me | 1 | 4-Cl | 1 | 3-Me | 1 | 4-Cl | H | H |
| 172 | 2 | 2-Me<br>4-Me | 1 | 4-Cl | 2 | 2-Me<br>4-Me | 1 | 4-Cl | H | H |
| 173 | 1 | 4-Br | 0 | — | 1 | 4-Br | 0 | — | H | H |
| 174 | 1 | 4-Me | 1 | 4-Br | 1 | 4-Me | 1 | 4-Br | H | H |

TABLE 10-continued

| Example compound | o | $R^{17}$ | p | $R^{18}$ | q | $R^{19}$ | r | $R^{20}$ | $R^{21}$ | $R^{22}$ |
|---|---|---|---|---|---|---|---|---|---|---|
| | | | | General Formula (4) | | | | | | |
| 175 | 1 | 3-Me | 1 | 4-Br | 1 | 3-Me | 1 | 4-Br | H | H |
| 176 | 2 | 2-Me<br>4-Me | 1 | 4-Br | 2 | 2-Me<br>4-Me | 1 | 4-Br | H | H |
| 177 | 1 | 4-F | 0 | — | 1 | 4-F | 0 | — | H | H |
| 178 | 1 | 4-Me | 1 | 4-F | 1 | 4-Me | 1 | 4-F | H | H |
| 179 | 1 | 3-Me | 1 | 4-F | 1 | 3-Me | 1 | 4-F | H | H |
| 180 | 2 | 2-Me<br>4-Me | 1 | 4-F | 2 | 2-Me<br>4-Me | 1 | 4-F | H | H |
| 181 | 1 | 4-Et | 1 | 4-I | 1 | 4-Et | 1 | 4-I | Me | Me |
| 182 | 1 | 4-OMe | 1 | 4-Cl | 1 | 4-OMe | 1 | 4-Cl | H | H |
| 183 | 2 | 3-OMe<br>4-OMe | 1 | 4-Br | 2 | 3-OMe<br>4-OMe | 1 | 4-Br | Me | Me |
| 184 | 1 | 4-Me | 1 | 4-Me | 1 | 4-Me | 1 | 4-Me | Cl | Cl |
| 185 | 1 | 4-Me | 0 | — | 1 | 4-Cl | 0 | — | H | H |
| 186 | 1 | 3-Me | 0 | — | 1 | 4-Cl | 0 | — | H | H |
| 187 | 1 | 2-Me | 0 | — | 1 | 2-Me | 0 | — | H | H |
| 188 | 1 | 4-Me | 0 | — | 1 | 4-F | 0 | — | H | H |

The distyryl compounds represented by general formula (5) in the present invention can be obtained, for example, according to the method described in JP-A-63-269158.

In general formula (5) described above, $R^{23}$, $R^{24}$, $R^{25}$, $R^{26}$, $R^{27}$, $R^{28}$, $R^{29}$, $R^{30}$, $R^{31}$ and $R^{32}$, which may be the same or different, each represents a hydrogen atom, a lower alkyl group having 1 to 4 carbon atoms, a lower alkoxyl group having 1 to 4 carbon atoms or a halogen atom, and the central phenyl group may be substituted by two ethylene groups at the o-, p- or m-positions.

Preferably, $R^{23}$, $R^{24}$, $R^{25}$, $R^{26}$, $R^{27}$, $R^{28}$, $R^{29}$, $R^{30}$, $R^{31}$ and $R^{32}$, which may be the same or different, each represents a hydrogen atom, a lower alkyl group having 1 or 2 carbon atoms, a methoxy group, a chlorine atom or a bromine atom, and the central phenyl group may be substituted by two ethylene groups at the o-, p- or m-positions.

Of these, examples of the lower alkyl groups having 1 and 2 carbon atoms include methyl and ethyl.

Preferred examples of the distyryl compounds represented by general formula (5) described above in the present invention include but are not limited to compounds shown in Tables 11 to 16 given below.

TABLE 11

| Example compound | $R^{23}$ | $R^{24}$ | $R^{25}$ | $R^{26}$ | $R^{27}$ | $R^{28}$ | $R^{29}$ | $R^{30}$ | $R^{31}$ | $R^{32}$ | * |
|---|---|---|---|---|---|---|---|---|---|---|---|
| | | | | | | General Formula (5) | | | | | |
| 189 | H | H | H | H | H | H | H | H | H | H | (p) |
| 190 | 3-Me | H | H | H | H | H | 3-Me | H | H | H | (p) |
| 191 | 2-Me | H | H | H | H | H | 2-Me | H | H | H | (p) |
| 192 | 4-Me | H | H | H | H | H | 4-Me | H | H | H | (p) |
| 193 | 4-Me | H | 4-Me | H | H | H | 4-Me | H | 4-Me | H | (p) |
| 194 | 2-Me | 4-Me | H | H | H | H | 2-Me | 4-Me | H | H | (p) |
| 195 | 2-Me | 4-Me | 4-Me | H | H | H | 2-Me | 4-Me | 4-Me | H | (p) |
| 196 | 4-Me | H | 2-Me | H | H | H | 4-Me | H | 2-Me | H | (p) |
| 197 | 2-Me | 4-Me | 2-Me | 4-Me | H | H | 2-Me | 4-Me | 2-Me | 4-Me | (p) |
| 198 | 2-Me | 4-Me | 2-Me | H | H | H | 2-Me | 4-Me | 2-Me | H | (p) |
| 199 | H | H | H | H | 2-Me | 2-Me | H | H | H | H | (p) |
| 200 | 4-Me | H | H | H | 2-Me | 2-Me | 4-Me | H | H | H | (p) |
| 201 | 4-Me | H | 4-Me | H | 2-Me | 2-Me | 4-Me | H | 4-Me | H | (p) |
| 202 | 4-Me | H | 2-Me | 4-Me | 2-Me | 2-Me | 4-Me | H | 2-Me | 4-Me | (p) |
| 203 | 4-Me | H | 2-Me | H | 2-Me | 2-Me | 4-Me | H | 2-Me | H | (p) |
| 204 | 2-Me | 4-Me | 2-Me | 4-Me | 2-Me | 2-Me | 2-Me | 4-Me | 2-Me | 4-Me | (p) |
| 205 | H | H | H | H | 3-Me | 3-Me | H | H | H | H | (p) |
| 206 | 4-Me | H | H | H | 3-Me | 3-Me | 4-Me | H | H | H | (p) |
| 207 | 4-Me | H | 4-Me | H | 3-Me | 3-Me | 4-Me | H | 4-Me | H | (p) |
| 208 | 4-Me | H | 2-Me | 4-Me | 3-Me | 3-Me | 4-Me | H | 2-Me | 4-Me | (p) |

*: substituting position

TABLE 12

General Formula (5)

| Example compound | $R^{23}$ | $R^{24}$ | $R^{25}$ | $R^{26}$ | $R^{27}$ | $R^{28}$ | $R^{29}$ | $R^{30}$ | $R^{31}$ | $R^{32}$ | * |
|---|---|---|---|---|---|---|---|---|---|---|---|
| 209 | 4-Et | H | H | H | H | H | 4-Et | H | H | H | (p) |
| 210 | 3-Et | H | H | H | H | H | 3-Et | H | H | H | (p) |
| 211 | 2-Et | H | H | H | H | H | 2-Et | H | H | H | (p) |
| 212 | 4-Cl | H | H | H | H | H | 4-Cl | H | H | H | (p) |
| 213 | 4-Br | H | H | H | H | H | 4-Br | H | H | H | (p) |
| 214 | 2-Me | 4-Me | 4-Br | H | H | H | 2-Me | 4-Me | 4-Br | H | (p) |
| 215 | 2-Me | 4-Me | 4-Cl | H | H | H | 2-Me | 4-Me | 4-Cl | H | (p) |
| 216 | 4-F | H | H | H | H | H | 4-F | H | H | H | (p) |
| 217 | 2-Me | 4-Me | 4-Me | H | H | H | 4-Me | H | 4-Me | H | (p) |
| 218 | 2-Me | 4-Me | 4-Me | H | H | H | 4-Me | H | H | H | (p) |
| 219 | H | H | H | H | H | H | 2-Me | 4-Me | H | H | (p) |
| 220 | 4-Me | H | 4-Me | H | 2-Me | H | 4-Me | H | 4-Me | H | (p) |
| 221 | 4-OMe | H | H | H | H | H | 4-OMe | H | H | H | (p) |
| 222 | 4-OMe | H | 2-Me | 4-Me | H | H | 4-OMe | H | 2-Me | 4-Me | (p) |
| 223 | 4-OMe | H | 2-Me | H | H | H | 4-OMe | H | 2-Me | H | (p) |
| 224 | 2-OMe | 4-Me | 2-Me | 4-Me | H | H | 2-OMe | 4-Me | 2-Me | 4-Me | (p) |
| 225 | 4-OMe | H | 4-Me | H | H | H | 4-OMe | H | 4-Me | H | (p) |
| 226 | 2-OMe | 5-Me | H | H | H | H | 2-OMe | 5-Me | H | H | (p) |
| 227 | 3-OMe | H | H | H | H | H | 3-OMe | H | H | H | (p) |
| 228 | 4-OMe | H | 4-Me | H | 2-Me | 2-Me | 4-OMe | H | 4-Me | H | (p) |

*: substituting position

TABLE 13

General Formula (5)

| Example compound | $R^{23}$ | $R^{24}$ | $R^{25}$ | $R^{26}$ | $R^{27}$ | $R^{28}$ | $R^{29}$ | $R^{30}$ | $R^{31}$ | $R^{32}$ | * |
|---|---|---|---|---|---|---|---|---|---|---|---|
| 229 | H | H | H | H | H | H | H | H | H | H | (m) |
| 230 | 3-Me | H | H | H | H | H | 3-Me | H | H | H | (m) |
| 231 | 2-Me | H | H | H | H | H | 2-Me | H | H | H | (m) |
| 232 | 4-Me | H | H | H | H | H | 4-Me | H | H | H | (m) |
| 233 | 4-Me | H | 4-Me | H | H | H | 4-Me | H | 4-Me | H | (m) |
| 234 | 2-Me | 4-Me | H | H | H | H | 2-Me | 4-Me | H | H | (m) |
| 235 | 2-Me | 4-Me | 4-Me | H | H | H | 2-Me | 4-Me | 4-Me | H | (m) |
| 236 | 4-Me | H | 2-Me | H | H | H | 4-Me | H | 2-Me | H | (m) |
| 237 | 2-Me | 4-Me | 2-Me | 4-Me | H | H | 2-Me | 4-Me | 2-Me | 4-Me | (m) |
| 238 | 2-Me | 4-Me | 2-Me | H | H | H | 2-Me | 4-Me | 2-Me | H | (m) |
| 239 | H | H | H | H | 2-Me | 2-Me | H | H | H | H | (m) |
| 240 | 4-Me | H | H | H | 2-Me | 2-Me | 4-Me | H | H | H | (m) |
| 241 | 4-Me | H | 4-Me | H | 2-Me | 2-Me | 4-Me | H | 4-Me | H | (m) |
| 242 | 4-Me | H | 2-Me | 4-Me | 2-Me | 2-Me | 4-Me | H | 2-Me | 4-Me | (m) |
| 243 | 4-Me | H | 2-Me | H | 2-Me | 2-Me | 4-Me | H | 2-Me | H | (m) |
| 244 | 2-Me | 4-Me | 2-Me | 4-Me | 2-Me | 2-Me | 2-Me | 4-Me | 2-Me | 4-Me | (m) |
| 245 | H | H | H | H | 3-Me | 3-Me | H | H | H | H | (m) |
| 246 | 4-Me | H | H | H | 3-Me | 3-Me | 4-Me | H | H | H | (m) |
| 247 | 4-Me | H | 4-Me | H | 3-Me | 3-Me | 4-Me | H | 4-Me | H | (m) |
| 248 | 4-Me | H | 2-Me | 4-Me | 3-Me | 3-Me | 4-Me | H | 2-Me | 4-Me | (m) |

*: substituting position

TABLE 14

General Formula (5)

| Example compound | $R^{23}$ | $R^{24}$ | $R^{25}$ | $R^{26}$ | $R^{27}$ | $R^{28}$ | $R^{29}$ | $R^{30}$ | $R^{31}$ | $R^{32}$ | * |
|---|---|---|---|---|---|---|---|---|---|---|---|
| 249 | 4-Et | H | H | H | H | H | 4-Et | H | H | H | (m) |
| 250 | 3-Et | H | H | H | H | H | 3-Et | H | H | H | (m) |
| 251 | 2-Et | H | H | H | H | H | 2-Et | H | H | H | (m) |
| 252 | 4-Cl | H | H | H | H | H | 4-Cl | H | H | H | (m) |
| 253 | 4-Br | H | H | H | H | H | 4-Br | H | H | H | (m) |
| 254 | 2-Me | 4-Me | 4-Br | H | H | H | 2-Me | 4-Me | 4-Br | H | (m) |
| 255 | 2-Me | 4-Me | 4-Cl | H | H | H | 2-Me | 4-Me | 4-Cl | H | (m) |
| 256 | 4-F | H | H | H | H | H | 4-F | H | H | H | (m) |
| 257 | 2-Me | 4-Me | 4-Me | H | H | H | 4-Me | H | 4-Me | H | (m) |
| 258 | 2-Me | 4-Me | 4-Me | H | H | H | 4-Me | H | H | H | (m) |
| 259 | H | H | H | H | H | H | 2-Me | 4-Me | H | H | (m) |

TABLE 14-continued

| Example compound | $R^{23}$ | $R^{24}$ | $R^{25}$ | $R^{26}$ | $R^{27}$ | $R^{28}$ | $R^{29}$ | $R^{30}$ | $R^{31}$ | $R^{32}$ | * |
|---|---|---|---|---|---|---|---|---|---|---|---|
| | | | | | General Formula (5) | | | | | | |
| 260 | 4-Me | H | 4-Me | H | 2-Me | H | 4-Me | H | 4-Me | H | (m) |
| 261 | 4-OMe | H | H | H | H | H | 4-OMe | H | H | H | (m) |
| 262 | 4-OMe | H | 2-Me | 4-Me | H | H | 4-OMe | H | 2-Me | 4-Me | (m) |
| 263 | 4-OMe | H | 2-Me | H | H | H | 4-OMe | H | 2-Me | H | (m) |
| 264 | 2-OMe | 4-Me | 2-Me | 4-Me | H | H | 2-OMe | 4-Me | 2-Me | 4-Me | (m) |
| 265 | 4-OMe | H | 4-Me | H | H | H | 4-OMe | H | 4-Me | H | (m) |
| 266 | 2-OMe | 5-Me | H | H | H | H | 2-OMe | 5-Me | H | H | (m) |
| 267 | 3-OMe | H | H | H | H | H | 3-OMe | H | H | H | (m) |
| 268 | 4-OMe | H | 4-Me | H | 2-Me | 2-Me | 4-OMe | H | 4-Me | H | (m) |

*: substituting position

TABLE 15

| Example compound | $R^{23}$ | $R^{24}$ | $R^{25}$ | $R^{26}$ | $R^{27}$ | $R^{28}$ | $R^{29}$ | $R^{30}$ | $R^{31}$ | $R^{32}$ | * |
|---|---|---|---|---|---|---|---|---|---|---|---|
| | | | | | General Formula (5) | | | | | | |
| 269 | H | H | H | H | H | H | H | H | H | H | (o) |
| 270 | 3-Me | H | H | H | H | H | 3-Me | H | H | H | (o) |
| 271 | 2-Me | H | H | H | H | H | 2-Me | H | H | H | (o) |
| 272 | 4-Me | H | H | H | H | H | 4-Me | H | H | H | (o) |
| 273 | 4-Me | H | 4-Me | H | H | H | 4-Me | H | 4-Me | H | (o) |
| 274 | 2-Me | 4-Me | H | H | H | H | 2-Me | 4-Me | H | H | (o) |
| 275 | 2-Me | 4-Me | 4-Me | H | H | H | 2-Me | 4-Me | 4-Me | H | (o) |
| 276 | 4-Me | H | 2-Me | H | H | H | 4-Me | H | 2-Me | H | (o) |
| 277 | 2-Me | 4-Me | 2-Me | 4-Me | H | H | 2-Me | 4-Me | 2-Me | 4-Me | (o) |
| 278 | 2-Me | 4-Me | 2-Me | H | H | H | 2-Me | 4-Me | 2-Me | H | (o) |
| 279 | H | H | H | H | 2-Me | 2-Me | H | H | H | H | (o) |
| 280 | 4-Me | H | H | H | 2-Me | 2-Me | 4-Me | H | H | H | (o) |
| 281 | 4-Me | H | 4-Me | H | 2-Me | 2-Me | 4-Me | H | 4-Me | H | (o) |
| 282 | 4-Me | H | 2-Me | 4-Me | 2-Me | 2-Me | 4-Me | H | 2-Me | 4-Me | (o) |
| 283 | 4-Me | H | 2-Me | H | 2-Me | 2-Me | 4-Me | H | 2-Me | H | (o) |
| 284 | 2-Me | 4-Me | 2-Me | 4-Me | 2-Me | 2-Me | 2-Me | 4-Me | 2-Me | 4-Me | (o) |
| 285 | H | H | H | H | 3-Me | 3-Me | H | H | H | H | (o) |
| 286 | 4-Me | H | H | H | 3-Me | 3-Me | 4-Me | H | H | H | (o) |
| 287 | 4-Me | H | 4-Me | H | 3-Me | 3-Me | 4-Me | H | 4-Me | H | (o) |
| 288 | 4-Me | H | 2-Me | 4-Me | 3-Me | 3-Me | 4-Me | H | 2-Me | 4-Me | (o) |

*: substituting position

TABLE 16

| Example compound | $R^{23}$ | $R^{24}$ | $R^{25}$ | $R^{26}$ | $R^{27}$ | $R^{28}$ | $R^{29}$ | $R^{30}$ | $R^{31}$ | $R^{32}$ | * |
|---|---|---|---|---|---|---|---|---|---|---|---|
| | | | | | General Formula (5) | | | | | | |
| 289 | 4-Et | H | H | H | H | H | 4-Et | H | H | H | (o) |
| 290 | 3-Et | H | H | H | H | H | 3-Et | H | H | H | (o) |
| 291 | 2-Et | H | H | H | H | H | 2-Et | H | H | H | (o) |
| 292 | 4-Cl | H | H | H | H | H | 4-Cl | H | H | H | (o) |
| 293 | 4-Br | H | H | H | H | H | 4-Br | H | H | H | (o) |
| 294 | 2-Me | 4-Me | 4-Br | H | H | H | 2-Me | 4-Me | 4-Br | H | (o) |
| 295 | 2-Me | 4-Me | 4-Cl | H | H | H | 2-Me | 4-Me | 4-Cl | H | (o) |
| 296 | 4-F | H | H | H | H | H | 4-F | H | H | H | (o) |
| 297 | 2-Me | 4-Me | 4-Me | H | H | H | 4-Me | H | 4-Me | H | (o) |
| 298 | 2-Me | 4-Me | 4-Me | H | H | H | 4-Me | H | H | H | (o) |
| 299 | H | H | H | H | H | H | 2-Me | 4-Me | H | H | (o) |
| 300 | 4-Me | H | 4-Me | H | 2-Me | H | 4-Me | H | 4-Me | H | (o) |
| 301 | 4-OMe | H | H | H | H | H | 4-OMe | H | H | H | (o) |
| 302 | 4-OMe | H | 2-Me | 4-Me | H | H | 4-OMe | H | 2-Me | 4-Me | (o) |
| 303 | 4-OMe | H | 2-Me | H | H | H | 4-OMe | H | 2-Me | H | (o) |
| 304 | 2-OMe | 4-Me | 2-Me | 4-Me | H | H | 2-OMe | 4-Me | 2-Me | 4-Me | (o) |
| 305 | 4-OMe | 4-Me | H | H | H | H | 4-OMe | H | 4-Me | H | (o) |
| 306 | 2-OMe | 5-Me | H | H | H | H | 2-OMe | 5-Me | H | H | (o) |
| 307 | 3-OMe | H | H | H | H | H | 3-OMe | H | H | H | (o) |
| 308 | 4-OMe | H | 4-Me | H | 2-Me | 2-Me | 4-OMe | H | 4-Me | H | (o) |

*: substituting position

The charge transporting material according to the present invention contains a mixture of the triphenylamine compound represented by general formula (1) described above and at least one compound selected from the group consisting of the hydrazone compound represented by general formula (2) described above, the hydrazone compound represented by general formula (3) described above, the triphenylamine dimer compound (N,N,N',N'-tetraphenylbenzidine compound) represented by general formula (4) described above and the distyryl compound represented by general formula (5) described above. There is no particular limitation on a method for preparing the mixture of both the compounds.

The mixing ratio of the compounds, namely the mixing ratio of the triphenylamine compound (1) to at least one compound selected from the group consisting of the hydrazone compound (2), the hydrazone compound (3), the triphenylamine dimer compound (N,N,N',N'-tetraphenylbenzidine compound) (4) and the distyryl compound (5), can be from 5% to 95% by weight, and preferably from 5% to 50% by weight, because some triphenylamine compound is poor in solubility in a binder.

The charge transporting layer can be formed by coating a conductive support or the charge generating layer with a solution in which the triphenylamine compound represented by general formula (1) described above, at least one compound selected from the group consisting of the hydrazone compound represented by general formula (2) described above, the hydrazone compound represented by general formula (3) described above, the triphenylamine dimer compound (N,N,N',N'-tetraphenylbenzidine compound) represented by general formula (4) described above and the distyryl compound represented by general formula (5) described above, and a binder are dissolved in an appropriate solvent, and drying it. The binders usually affect not only electric characteristics such as charging properties and sensitivity of the photoreceptors, but also binding strength of the photosensitive layers and mechanical properties such as hardness and abrasion resistance to influence the durability of the photoreceptors. Furthermore, the binders affect viscosity of the coating liquid, dispersion stability of the charge generating materials and production conditions. Accordingly examples of the binders used in the present invention include polycarbonates, polyesters, polystyrene, polyacrylates, polymethacrylates, polyamides, acrylic resins, vinyl chloride resins, vinyl acetate resins, epoxy resins, polyurethanes, copolymers thereof and mixtures thereof. In addition to such insulating polymers, organic photoconductive polymers such as polyvinylcarbazole, polyvinylanthracene and polysilane can also be used.

Of these binders, polycarbonates are particularly preferably used. The polycarbonates include bisphenol methane type polycarbonates represented by the following formula (H):

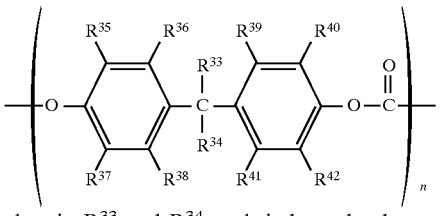

(H)

wherein $R^{33}$ and $R^{34}$ each independently represents a hydrogen atom, a lower alkyl group having 1 to 4 carbon atoms, or a phenyl group which may be substituted by a lower alkyl group having 1 to 4 carbon atoms, a lower alkoxyl group having 1 to 4 carbon atoms or a halogen atom, and may form together an alicyclic group unsubstituted or substituted by a lower alkyl group having 1 to 4 carbon atoms, a lower alkoxyl group having 1 to 4 carbon atoms, a phenyl group or a halogen atom; $R^{35}$, $R^{36}$, $R^{37}$, $R^{38}$, $R^{39}$, $R^{40}$, $R^{41}$ and $R^{42}$ each independently represents a hydrogen atom, a halogen atom, a lower alkyl group having 1 to 4 carbon atoms, or a phenyl group which may be substituted by a lower alkyl group having 1 to 4 carbon atoms, a lower alkoxyl group having 1 to 4 carbon atoms or a halogen atom; and n represents an integer.

Specific examples of the polycarbonates include bisphenol A type polycarbonates represented by the following formula (H-1) (for example, Yupilon E series manufactured by Mitsubishi Gas Chemical Co., Inc.), bisphenol Z type polycarbonate resins represented by the following formula (H-2) (for example, Polycarbonate Z series manufactured by Mitsubishi Gas Chemical Co., Inc.), polycarbonates represented by the following formula (H-3) or (H-4), mixtures thereof and copolymers thereof. These polycarbonates preferably have relatively high molecular weight so that cracks or flaws are hard to develop when formed into the photoreceptors.

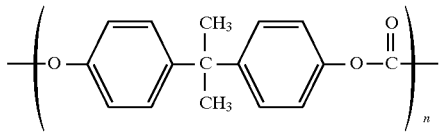

(H-1)

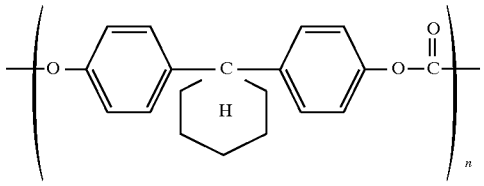

(H-2)

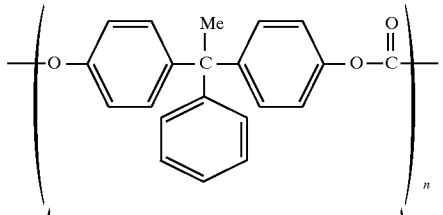

(H-3)

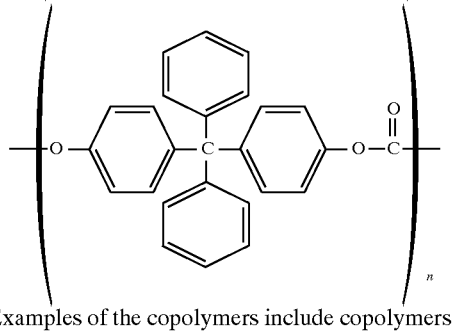

(H-4)

Examples of the copolymers include copolymers in which the monomer units represented by formula (H) are appropriately combined, and a bisphenol/biphenol type copolymerized polycarbonate resin (JP-A-4-179961) represented by the following formula (J) is preferably used:

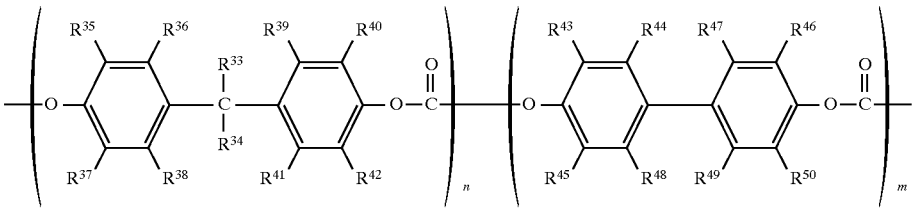

(J)

wherein $R^{33}$ and $R^{34}$ each independently represents a hydrogen atom, a lower alkyl group having 1 to 4 carbon atoms, or a phenyl group which may be substituted by a lower alkyl group having 1 to 4 carbon atoms, a lower alkoxyl group having 1 to 4 carbon atoms or a halogen atom, and may form together an alicyclic group unsubstituted or substituted by a lower alkyl group having 1 to 4 carbon atoms, a lower alkoxyl group having 1 to 4 carbon atoms, a phenyl group or a halogen atom; $R^{35}$, $R^{36}$, $R^{37}$, $R^{38}$, $R^{39}$, $R^{40}$, $R^{41}$ and $R^{42}$ each independently represents a hydrogen atom, a halogen atom, a lower alkyl group having 1 to 4 carbon atoms, or a phenyl group which may be substituted by a lower alkyl group having 1 to 4 carbon atoms, a lower alkoxyl group having 1 to 4 carbon atoms or a halogen atom; $R^{43}$, $R^{44}$, $R^{45}$, $R^{46}$, $R^{47}$, $R^{48}$, $R^{49}$ and $R^{50}$ each independently represents a hydrogen atom, a lower alkyl group having 1 to 4 carbon atoms, a lower alkoxyl group having 1 to 4 carbon atoms, a halogen atom or a phenyl group which may be substituted by a lower alkyl group having 1 to 4 carbon atoms, a lower alkoxyl group having 1 to 4 carbon atoms or a halogen atom, and may each independently cyclically bind; and m and n each represents an integer.

Further, specific examples of the bisphenol type copolymerized polycarbonate include bisphenol/biphenol type copolymerized polycarbonate resins represented by the following formulas (J-1), (J-2), (J-3) and (J-4) (the ratio of m to n may be any).

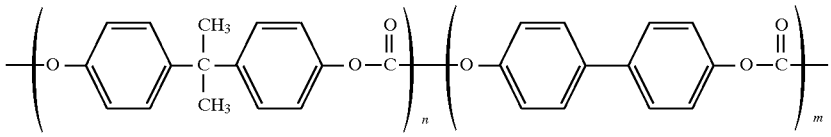

(J-1)

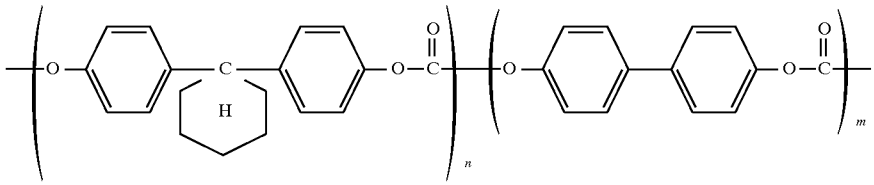

(J-2)

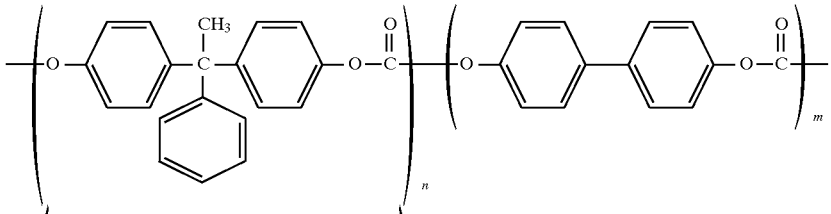

(J-3)

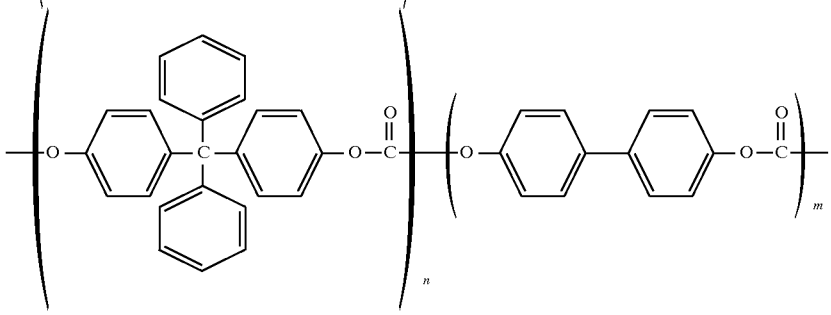

(J-4)

In addition to the above-mentioned polycarbonates, the polycarbonates further include polycarbonates having repeating units represented by the following formulas (JP-A-6-214412 and JP-A-6-222581):

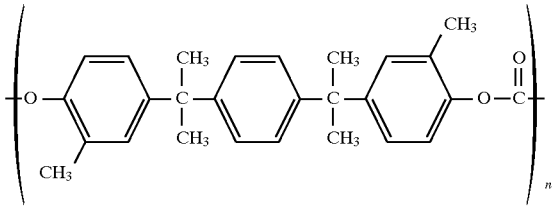

(K)

-continued

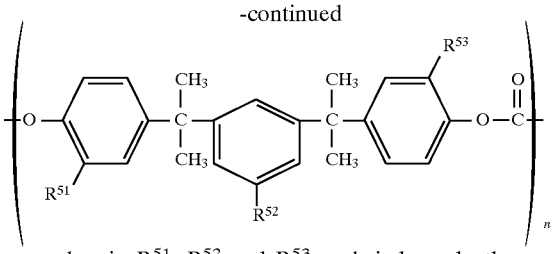

(L)

wherein $R^{51}$, $R^{52}$ and $R^{53}$ each independently represents a hydrogen atom, a lower alkyl group having 1 to 4 carbon atoms, a lower alkoxyl group having 1 to 4 carbon atoms, a halogen atom, a 3- to 8-membered carbon atom-containing alicyclic groups unsubstituted or substituted by a lower alkyl group having 1 to 4 carbon atoms, a lower alkoxyl group having 1 to 4 carbon atoms or a halogen atom, a phenyl group which may be substituted by a lower alkyl group having 1 to 4 carbon atoms, a lower alkoxyl group having 1 to 4 carbon atoms or a halogen atom, a naphthyl group which may be substituted by a lower alkyl group having 1 to 4 carbon atoms, a lower alkoxyl group having 1 to 4 carbon atoms or a halogen atom, a benzyl group which may be substituted by a lower alkyl group having 1 to 4 carbon atoms, a lower alkoxyl group having 1 to 4 carbon atoms or a halogen atom, or a naphthylmethyl group which may be substituted by a lower alkyl group having 1 to 4 carbon atoms, a lower alkoxyl group having 1 to 4 carbon atoms or a halogen atom; and n represents an integer.

These binders may be mixed with the charge transporting materials used in the present invention at any ratio. Usually, the charge transporting materials are added in an amount of 10 to 1,000 parts by weight, and preferably in an amount of 25 to 500 parts by weight, per 100 parts by weight of binder.

Although the film thickness of the resulting charge transporting materials is generally 2 $\mu$m to 40 $\mu$m, it is preferably 5 $\mu$m to 30 $\mu$m.

The organic solvents used in forming such charge transporting layers include ketones such as methyl ethyl ketone and cyclohexanone, amides such as N,N-dimethylformamide and N,N-dimethylacetamide, sulfoxides such as dimethyl sulfoxide, ethers such as tetrahydrofuran, dioxane and ethylene glycol dimethyl ether, esters such as ethyl acetate and methyl acetate, aliphatic halogen hydrocarbons such as methylene chloride, chloroform, 1,2-dichloroethane, dichloroethylene, carbon tetrachloride, trichloroethylene and trichloroethane, aromatic compounds such as benzene, toluene, xylene, chlorobenzene and dichlorobenzene, and mixtures thereof.

The charge transporting layers obtained as described above are electrically connected to the charge generating layers, and have the functions of receiving carriers injected from the charge generating layers in the presence of the electric field and being able to transport the carriers to surfaces of the photoreceptors. In this case, the charge transporting layers may be formed either on or under the charge generating layers disposed on conductive substrates. However, it is desirable that the charge transporting layers are formed on the charge generating layers.

With respect to the charge generating layers, materials selected from inorganic charge generating materials such as selenium, selenium-tellurium and amorphous silicon; cationic dyes such as pyrylium salt dyes, thiapyrylium salt dyes, azulenium salt dyes, thiacyanine dyes and quinocyanine dyes; polycyclic quinone pigments such as squarylium salt pigments, phthalocyanine pigments, anthoanthrone pigments, dibenz-pyrenequinone pigments and pyranthrone pigments; and organic charge generating materials such as indigo pigments, quinacridone pigments, azo pigments and pyrrolopyrrole pigments can be used alone or in combination as deposited layers or coated layers. Of the organic charge generating materials as described above, organic charge generating materials described in *Chem. Rev.* 93, 449–486 (1993) are particularly preferred. Specifically, phthalocyanine pigments are preferred.

In particular, the phthalocyanine pigments include oxotitanium phthalocyanine (TiOPc), copper phthalocyanine (CuPc), metal-free phthalocyanine ($H_2PC$), hydroxygallium phthalocyanine (HOGaPc), vanadyl phthalocyanine (VOPc) and chloroindium phthalocyanine (ClInPc). More particularly, TiOPc includes $\alpha$-TiOPc, $\beta$-TiOPc, $\gamma$-TiOPc, m-TiOPc, Y-TiOPc, A-TiOPc, B-TiOPc, amorphous TiOPc and dimethylethylene glycoside titanium phthalocyanine. $H_2Pc$ includes $\alpha$-$H_2Pc$, $\beta$-$H_2Pc$, $\tau$-$H_2Pc$, $\tau_2$-$H_2Pc$ and X-$H_2Pc$. Mixed crystals of these phthalocyanine pigments (for example, JP-A-6-148917 and JP-A6-271786) can also be suitably used.

Further, the azo compounds include various monoazo pigments, bisazo pigments, trisazo pigments and tetrakisazo pigments, and the compounds represented by the following structural formulas are preferred.

Bisazo Pigments

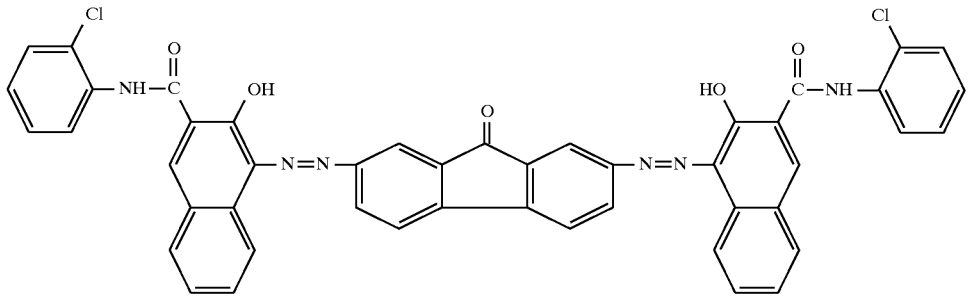

(O)

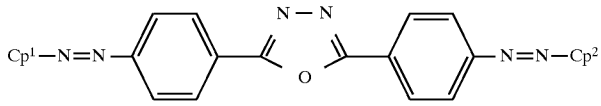

(P)

-continued

Bisazo Pigments

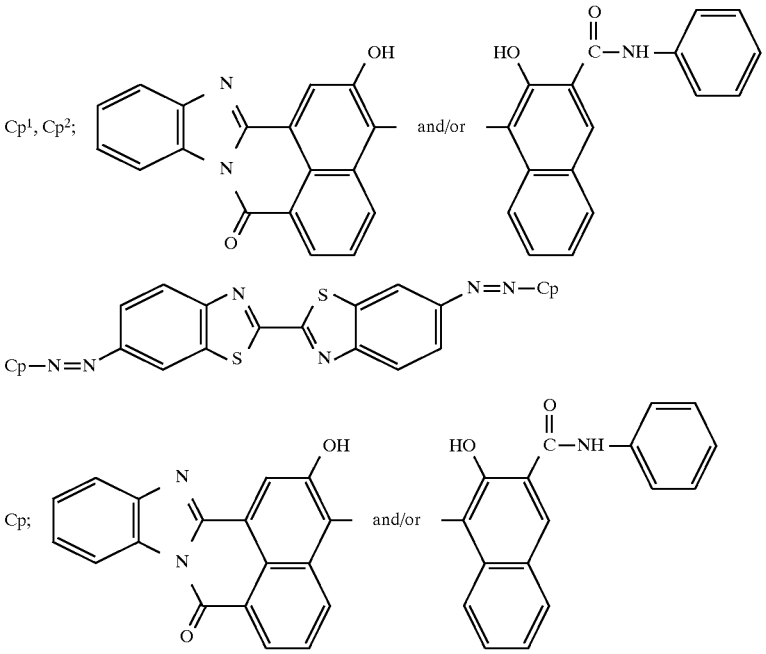

(Q)

Trisazo Pigment

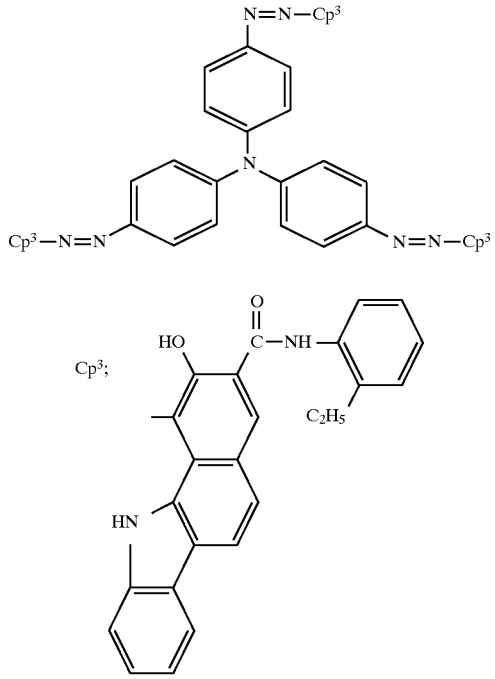

(R)

Further, the perylene compound represented by the following structural formula (S) or the polycyclic quinone compound represented by the following structural formula (T) are also preferred.

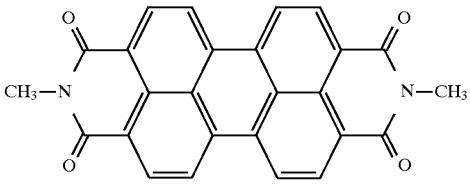

(S)

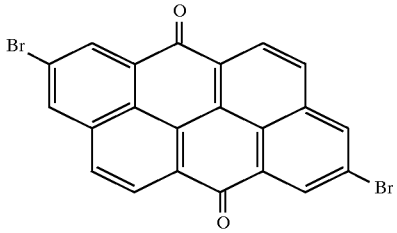

(T)

In addition to these, any materials can be used as long as they are materials absorbing light and generating charge at high efficiency.

The conductive supports used in the photoreceptors of the present invention include foils or plates of metals such as copper, aluminum, silver, iron, zinc and nickel or alloys thereof formed into the sheet form or the drum form, plastic films or cylinders over which these metals are vacuum deposited or electrolytically plated, or supports such as glass, paper and plastic films over which layers of conductive compounds such as conductive polymers, indium oxide and tin oxide are provided by coating or vapor deposition.

Coating can be conducted by use of coating methods such as dip coating, spray coating, spinner coating, wire bar coating, blade coating, roller coating and curtain coating.

Drying is preferably conducted by the method of heating at room temperature, followed by heat drying. It is preferred that the heat drying is generally performed at a temperature of 30° C. to 200° C. for 5 minutes to 4 hours in still or forced air.

In order to improve the durability of the photoreceptors, ultraviolet absorbers, antioxidants and other additives are used in the photosensitive layers in the present invention as required. The various additives include, for example, plasticizers such as biphenyl compounds disclosed in JP-A-6-332206, m-di-tert-butylphenyl and dibutyl phthalate, surface lubricants such as silicone oil, graft type silicone polymers and various fluorocarbons, potential stabilizers such as dicyanovinyl compounds and carbazole derivatives, monophenol antioxidants such as 2-tert-butyl-4-methylphenol and 2,6-di-tert-butyl-4-methylphenol, bisphenol antioxidants, polymeric phenol antioxidants, amine antioxidants such as 4-diazabicyclo[2,2,2]octane, salicylic acid antioxidants, dilauryl-3,3-thiodiamine antioxidants, phosphorus antioxidants, hindered amine light stabilizers such as bis(2,2,6,6-tetramethyl-4-piperidyl) sebacate, and dl-α-tocopherol (vitamin E).

On the photosensitive layers thus prepared, protective layers can be formed by coating as required. Underlayers having the barrier function and the adhesive function can also be provided between the conductive supports and photosensitive layers. Materials for forming the underlayers include polyvinyl alcohol, nitrocellulose, casein, ethylene-acrylic acid copolymers, polyamides such as nylon, polyurethanes, gelatin and aluminum oxide. The film thickness of the underlayers is 0.1 μm to 5 μm, and preferably 0.5 μm to 3 μm.

Figure 1B:
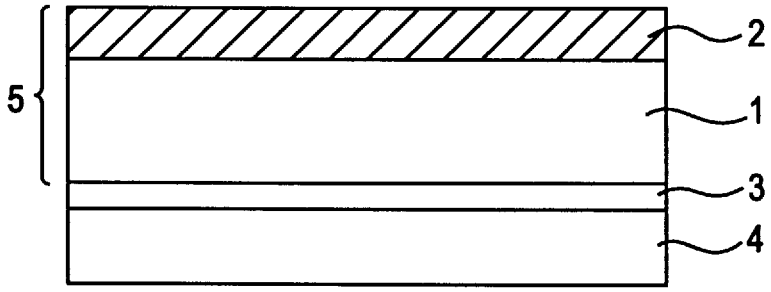
Figure 1C:
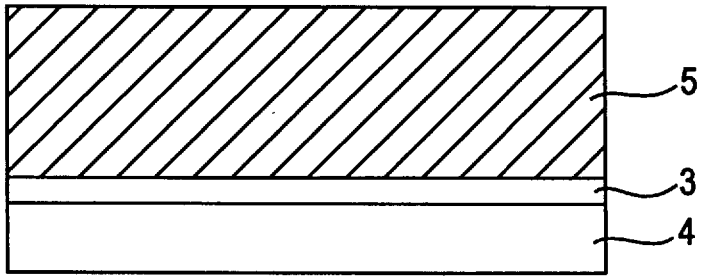

As described above, the charge transporting material can be obtained which contains at least one triphenylamine compound represented by general formula (1) and at least one compound selected from the group consisting of the hydrazone compound represented by general formula (2), the hydrazone compound represented by general formula (3), the triphenylamine dimer compound represented by general formula (4) and the distyryl compound represented by general formula (5). The electrophotographic photoreceptor (shown in FIG. 1(*a*) or 1(*b*)) can be obtained in which the charge transporting layer containing said charge transporting material and the above-mentioned charge generating layer are laminated with each other to form the photosensitive layer, and the electrophotographic photoreceptor (shown in FIG. 1(*c*)) in which the above-mentioned charge generating material is dissolved (molecularly dispersed) in the charge transporting layer containing said charge transporting material or mixed therewith in the form of fine grain dispersion to form the photosensitive layer.

The present invention will be described with reference to examples below, but these are not to be construed as limiting the invention. It is to be understood that changes and variations may be made without departing from the spirit and the scope of the present invention.

Abbreviations used in the examples are as follows:

$V_0$: Initial surface charge potential (unit: −volt, hereinafter described as −V)

$V_1$: Surface potential after keeping in the dark for 5 seconds (unit: −V)

$E_{1/2}$: Half-exposure (unit: lux·second, hereinafter described as lux·s)

$E_{1/6}$: Exposure necessary for attenuating the surface potential $V_1$ to ⅙ (unit: lux·s)

$V_{R10}$: Surface residual potential after light irradiation for 10 seconds (unit: −V) Comparative Compounds used in the examples have the following structures:

Comparative Compound 1

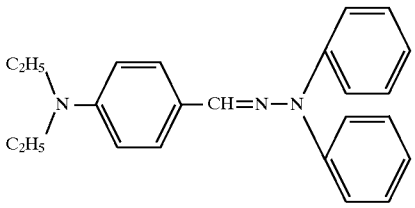

Comparative Compound 2

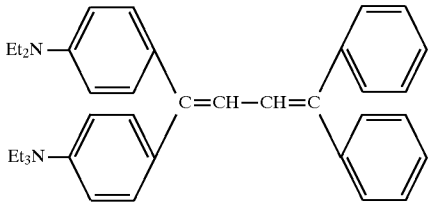

Comparative Compound 3

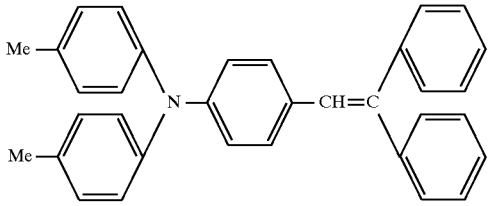

Comparative Compound 4

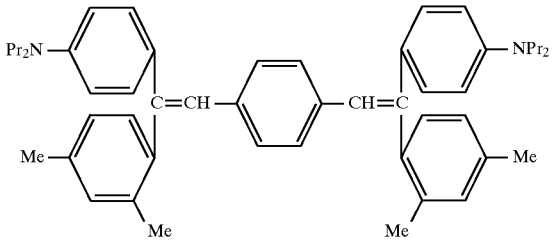

EXAMPLES 1 TO 7 AND COMPARATIVE EXAMPLES 1 AND 2

Oxotitanium phthalocyanine (TiOPc) was vacuum deposited at $10^{-6}$ Torr to a thickness of about 0.8 μm on an aluminum thin film deposited on a polyester film to form a charge generating layer. Further, one part of the test compounds in each example shown in Table 17 and one part of a polycarbonate resin represented by formula (H-2) (trade name: Polycarbonate Z-200, manufactured by Mitsubishi Gas Chemical Co., Inc.) were dissolved in 8 parts of dichloroethane by mixing. This solution was applied onto the above-mentioned charge generating layer with a-doctor blade, and dried at 80° C. for 3 hours to prepare a photoreceptor.

The electrophotographic characteristics of the electrophotographic photoreceptors thus obtained were measured by the static system using an electrostatic paper analyzer Model EPA-8200 (manufactured by Kawaguchi Electric Works). That is, the photoreceptors were exposed to the corona discharge of −6 kV to charge them, and the surface potential $V_0$ was measured. They were kept in the dark for 5 seconds (surface potential $V_1$), followed by irradiation of light having an illuminance of 5 luxes with a halogen lamp. Then, the exposure necessary for decreasing the surface potential to ½ or ⅙ ($E_{1/2}$ or $E_{1/6}$) was measured. Subsequently, after irradiation of light having an illuminance of 5 luxes for 10 seconds, the surface residual potential $V_{R10}$ was determined.

In Comparative Example 1, comparative compound 1 was used in place of one of the test compounds, and in Comparative Example 2, only example compound 47, a triphenylamine compound, was used.

Results thereof are shown in Table 18.

TABLE 17

| | Test Compound (Amount Used) | Polymer | Organic Solvent | Charge Generating Layer |
|---|---|---|---|---|
| Example 1 | Example compound 1 (0.4 part) Example compound 63 (0.6 part) | H-2 (1 part) | Dichloroethane | TiOPc Deposited |
| Example 2 | Example compound 21 (0.5 part) Example compound 63 (0.5 part) | H-2 (1 part) | Dichloroethane | TiOPc Deposited |
| Example 3 | Example compound 42 (0.4 part) Example compound 61 (0.6 part) | H-2 (1 part) | Dichloroethane | TiOPc Deposited |
| Example 4 | Example compound 21 (0.5 part) Example compound 63 (0.5 part) | H-2 (1 part) | Toluene | TiOPc Deposited |
| Example 5 | Example compound 21 (0.5 part) Example compound 63 (0.5 part) | H-2 (1 part) | Tetrahydrofuran | TiOPc Deposited |
| Example 6 | Example compound 47 (0.4 part) Example compound 61 (0.6 part) | H-2 (1 part) | Tetrahydrofuran | TiOPc Deposited |
| Example 7 | Example compound 47 (0.4 part) Example compound 61 (0.6 part) | H-2 (1 part) | Dioxane | TiOPc Deposited |
| Comparative Example 1 | Comparative compound 1 (0.4 part) Example compound 63 (0.6 part) | H-2 (1 part) | Dichloroethane | TiOPc Deposited |
| Comparative Example 2 | Example compound 47 (1.0 part) | H-2 (1 part) | Dichloroethane | TiOPc Deposited |

TABLE 18

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 1 | 932 | 603 | 12 | 0.83 | 2.51 |
| Example 2 | 971 | 671 | 11 | 0.72 | 1.98 |
| Example 3 | 789 | 398 | 3 | 0.75 | 2.61 |
| Example 4 | 923 | 756 | 0 | 1.33 | 3.33 |
| Example 5 | 1072 | 951 | 0 | 1.19 | 2.82 |
| Example 6 | 1118 | 988 | 11 | 1.15 | 2.73 |
| Example 7 | 1009 | 815 | 0 | 1.11 | 2.51 |
| Comparative Example 1 | 924 | 624 | 55 | 1.14 | 6.91 |
| Comparative Example 2 | Unmeasurable | | | | |

As apparent from Table 18, it has become clear that the photoreceptors of the present invention prepared by use of the test compounds of Examples 1 to 7 were low in residual potential and also low in $E_{1/6}$, providing excellent electrophotographic characteristics, compared with the photoreceptor of Comparative Example 1 prepared by use of comparative compound 1.

For the photoreceptor of Comparative Example 2 prepared by use of example compound 47 alone, cracks developed in the photoreceptor layer after film formation.

EXAMPLES 8 TO 13 AND COMPARATIVE EXAMPLE 3

A charge generating layer was prepared in the same manner as with Examples 1 to 7. A photoreceptor was prepared and the electrophotographic characteristics thereof were measured in the same manner as with Examples 1 to 7 with the exception that the test compounds in each example shown in Table 19 were used in an amount of one part in place of the compounds shown in Table 17 and one part of a bisphenol A/biphenol copolymerized polycarbonate resin represented by formula (J-1) (manufactured by Idemitsu Kosan Co., Ltd.) was used in place of the polycarbonate resin represented by formula (H-2).

In Comparative Example 3, comparative compound 1 was used in place of one of the test compounds.

Results thereof are shown in Table 20.

TABLE 19

| | Test Compound (Amount Used) | Polymer | Organic Solvent | Charge Generating Layer |
|---|---|---|---|---|
| Example 8 | Example compound 21 (0.5 part) Example compound 61 (0.5 part) | J-1 (1 part) | Dichloroethane | TiOPc Deposited |
| Example 9 | Example compound 1 (0.4 part) Example compound 63 (0.6 part) | J-1 (1 part) | Tetrahydrofuran | TiOPc Deposited |
| Example 10 | Example compound 1 (0.4 part) Example compound 63 (0.6 part) | J-1 (1 part) | Dioxane | TiOPc Deposited |
| Example 11 | Example compound 42 (0.3 part) Example compound 61 (0.7 part) | J-1 (1 part) | Tetrahydrofuran | TiOPc Deposited |
| Example 12 | Example compound 42 (0.3 part) Example compound 63 (0.7 part) | J-1 (1 part) | Dioxane | TiOPc Deposited |
| Example 13 | Example compound 47 (0.4 part) Example compound 63 (0.6 part) | J-1 (1 part) | Tetrahydrofuran | TiOPc Deposited |
| Comparative Example 3 | Comparative compound 1 (0.4 part) Example compound 63 (0.6 part) | J-1 (1 part) | Dichloroethane | TiOPc Deposited |

TABLE 20

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 8 | 835 | 478 | 4 | 0.75 | 2.42 |
| Example 9 | 1018 | 869 | 0 | 1.07 | 2.48 |
| Example 10 | 963 | 729 | 1 | 1.20 | 2.85 |
| Example 11 | 992 | 864 | 0 | 1.10 | 2.57 |
| Example 12 | 999 | 830 | 4 | 1.21 | 2.83 |
| Example 13 | 1028 | 896 | 0 | 1.14 | 2.73 |
| Comparative Example 3 | 921 | 569 | 44 | 0.94 | 5.95 |

As apparent from Table 20, it has become clear that the photoreceptors of the present invention of Examples 8 to 13 were low in residual potential-and also low in $E_{1/16}$, providing excellent electrophotographic characteristics, compared with the photoreceptor of Comparative Example 3 prepared by use of comparative compound 1.

EXAMPLES 14 TO 17 AND COMPARATIVE EXAMPLE 4

According to the method described in JP-A-1-291256, 40 parts of crystalline oxytitanyl phthalocyanine was added to a binder resin solution obtained by dissolving 35 parts of a butyral resin (trade name: Polyvinyl Butyral BL-1, manufactured by Sekisui Chemical Co., Ltd.) in 1,425 parts of tetrahydrofuran, and dispersed together with glass beads by use of a vibrating mill for 2 hours. This dispersion was applied with a wire bar onto a sheet in which aluminum was deposited over a polyethylene terephthalate (PET) film, and dried to form a charge generating layer.

One part of the test compounds in each example shown in Table 12 and one part of a polycarbonate resin represented by formula (H-2) (trade name: Polycarbonate Z, manufactured by Mitsubishi Gas Chemical Co., Inc.) were dissolved in 8 parts of an organic solvent by mixing. This solution was applied onto the charge generating layer with a doctor blade, and dried at 80° C. for 3 hours to prepare a photoreceptor. The electrophotographic characteristics of the photoreceptors thus obtained were measured in the same manner as with Examples 1 to 7.

In Comparative Example 4, comparative compound 1 was used in place of one of the test compounds.

Results thereof are shown in Table 22.

TABLE 21

| | Test Compound (Amount Used) | Polymer | Organic Solvent | Charge Generating Layer |
|---|---|---|---|---|
| Example 14 | Example compound 1 (0.5 part) Example compound 63 (0.5 part) | H-2 (1 part) | Dichloroethane | TiOPc Crystal |
| Example 15 | Example compound 47 (0.4 part) Example compound 63 (0.6 part) | H-2 (1 part) | Dichloroethane | TiOPc Crystal |
| Example 16 | Example compound 21 (0.5 part) Example compound 63 (0.5 part) | H-2 (1 part) | Tetrahydrofuran | TiOPc Crystal |
| Example 17 | Example compound 47 (0.3 part) Example compound 61 (0.7 part) | H-2 (1 part) | Tetrahydrofuran | TiOPc Crystal |
| Comparative Example 4 | Comparative compound 1 (0.4 part) Example compound 63 (0.6 part) | H-2 (1 part) | Dichloroethane | TiOPc Crystal |

TABLE 22

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 14 | 821 | 429 | 2 | 0.49 | 1.39 |
| Example 15 | 693 | 463 | 2 | 0.37 | 0.80 |
| Example 16 | 775 | 540 | 0 | 0.36 | 0.86 |
| Example 17 | 697 | 479 | 1 | 0.30 | 0.63 |
| Comparative Example 4 | 718 | 285 | 48 | 1.25 | 48.70 |

As apparent from Table 22, it has become clear that the photoreceptors of the present invention of Examples 14 to 17 were low in residual potential and also low in $E_{1/2}$ and $E_{1/6}$, providing excellent electrophotographic characteristics, compared with the photoreceptor of Comparative Example 4.

EXAMPLES 18 AND 19 AND COMPARATIVE EXAMPLE 5

A charge generating layer was prepared in the same manner as with Examples 14 to 17. A photoreceptor was prepared and the electrophotographic characteristics thereof were measured in the same manner as with Examples 14 to 17 with the exception that the test compounds in each example shown in Table 23 were used in an amount of one part in place of the compounds shown in Table 21 and one part of a bisphenol A/biphenol copolymerized polycarbonate resin represented by formula (J-1) (manufactured by Idemitsu Kosan Co., Ltd.) was used in place of the polycarbonate resin represented by formula (H-2).

In Comparative Example 5 as a control, comparative compound 1 was used in place of one of the test compounds.

Results thereof are shown in Table 24.

TABLE 23

| | Test Compound (Amount Used) | Polymer | Organic Solvent | Charge Generating Layer |
|---|---|---|---|---|
| Example 18 | Example compound 47 (0.4 part) Example compound 63 (0.6 part) | J-1 (1 part) | Dichloroethane | TiOPc Crystal |
| Example 19 | Example compound 1 (0.3 part) Example compound 63 (0.7 part) | J-1 (1 part) | Tetrahydrofuran | TiOPc Crystal |
| Comparative Example 5 | Comparative compound 1 (0.4 part) Example compound 63 (0.6 part) | J-1 (1 part) | Dichloroethane | TiOPc Crystal |

TABLE 24

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 18 | 732 | 336 | 3 | 0.42 | 1.16 |
| Example 19 | 702 | 421 | 2 | 0.34 | 0.95 |
| Comparative Example 5 | 712 | 247 | 35 | 1.19 | 31.02 |

As apparent from Table 24, it has become clear that the photoreceptors of the present invention prepared in Examples 18 and 19 were low in residual potential and also low in $E_{1/2}$ and $E_{1/6}$, providing excellent electrophotographic characteristics, compared with the photoreceptor of Comparative Example 5 prepared by use of comparative compound 1.

EXAMPLES 20 TO 27 AND COMPARATIVE EXAMPLE 6

One part of chlorodian blue (CDB) and one part of a polycarbonate resin (trade name: Yupilon E-2000, manufactured by Mitsubishi Gas Chemical Co., Inc.) were kneaded in a ball mill for 5 hours, using 30 parts of dichloroethane as a solvent. The resulting pigment dispersion was applied with a wire bar onto a sheet in which aluminum was deposited over a polyethylene terephthalate carrier generating layer to a thickness of about 1 μm.

One part of the test compounds in each example shown in Table 25 and one part of a polycarbonate resin represented by formula (H-2) (trade name: Polycarbonate Z, manufactured by Mitsubishi Gas Chemical Co., Inc.) were dissolved in 8 parts of an organic solvent by mixing. This solution was applied onto the charge carrier generating layer with a doctor blade, and dried at 80° C. for 3 hours to prepare a photoreceptor.

The electrophotographic characteristics of the photoreceptors thus obtained were measured in the same manner as with Example 1.

In Comparative Example 6, comparative compound 1 was used in place of one of the test compounds.

Results thereof are shown in Table 26.

TABLE 25

| | Test Compound (Amount Used) | Polymer | Organic Solvent | Charge Generating Layer |
|---|---|---|---|---|
| Example 20 | Example compound 1 (0.4 part) Example compound 63 (0.6 part) | H-2 (1 part) | Dichloroethane | CDB |
| Example 21 | Example compound 21 (0.5 part) Example compound 63 (0.5 part) | H-2 (1 part) | Dichloroethane | CDB |
| Example 22 | Example compound 42 (0.3 part) Example compound 61 (0.7 part) | H-2 (1 part) | Dichloroethane | CDB |
| Example 23 | Example compound 47 (0.4 part) Example compound 63 (0.6 part) | H-2 (1 part) | Dichloroethane | CDB |
| Example 24 | Example compound 21 (0.5 part) Example compound 63 (0.5 part) | H-2 (1 part) | Toluene | CDB |
| Example 25 | Example compound 21 (0.5 part) Example compound 63 (0.5 part) | H-2 (1 part) | Tetrahydrofuran | CDB |
| Example 26 | Example compound 47 (0.3 part) Example compound 63 (0.7 part) | H-2 (1 part) | Tetrahydrofuran | CDB |
| Example 27 | Example compound 47 (0.4 part) Example compound 63 (0.6 part) | H-2 (1 part) | Tetrahydrofuran | CDB |
| Comparative Example 6 | Comparative compound 1 (0.4 part) Example compound 63 (0.6 part) | H-2 (1 part) | Dichloroethane | CDB |

TABLE 26

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 20 | 860 | 666 | 14 | 3.71 | 9.02 |
| Example 21 | 1003 | 857 | 5 | 3.65 | 8.28 |
| Example 22 | 812 | 695 | 0 | 3.71 | 8.51 |
| Example 23 | 1033 | 905 | 6 | 3.62 | 8.06 |
| Example 24 | 889 | 773 | 3 | 3.75 | 8.23 |
| Example 25 | 751 | 647 | 0 | 4.12 | 8.95 |
| Example 26 | 651 | 560 | 0 | 4.39 | 9.46 |
| Example 27 | 988 | 859 | 1 | 3.72 | 8.07 |
| Comparative Example 6 | 931 | 792 | 32 | 4.25 | 10.78 |

As apparent from Table 26, it has become clear that the photoreceptors of the present invention of Examples 20 to 27 were low in residual potential and also low in $E_{1/6}$, providing excellent electrophotographic characteristics, compared with the photoreceptor of Comparative Example 6 prepared by use of comparative compound 1.

EXAMPLES 28 TO 30 AND COMPARATIVE EXAMPLE 7

Chlorodian blue (CDB) was used as an electrophotographic material similary to Examples 20 to 27. One part of the test compounds in each example shown in Table 27 as charge transporting materials and one part of a bisphenol A/biphenol copolymerized polycarbonate resin represented by formula (J-1) (manufactured by Idemitsu Kosan Co., Ltd.) were dissolved in an organic solvent. This solution was applied onto the charge generating layer with a doctor blade, and dried at 80° C. for 3 hours to prepare a photoreceptor. The electrophotographic characteristics of the photoreceptors thus obtained were measured in the same manner as with Example 1.

In Comparative Example 7, comparative compound 1 was used in place of one of the test compounds. The test compounds of Comparative Example 7 were dissolved by mixing, together with the bisphenol A/biphenol copolymerized polycarbonate resin represented by formula (J-1), using 8 parts of dichloroethane as the organic solvent. The resulting solution was applied onto the CDB-containing charge generating layer with a doctor blade, and dried at 80° C. for 3 hours to prepare a photoreceptor.

Results thereof are shown in Table 28.

TABLE 27

| | Test Compound (Amount Used) | Polymer | Organic Solvent | Charge Generating Layer |
|---|---|---|---|---|
| Example 28 | Example compound 47 (0.4 part) Example compound 63 (0.6 part) | J-1 (1 part) | Dichloroethane | CDB |
| Example 29 | Example compound 1 (0.3 part) Example compound 63 (0.7 part) | J-1 (1 part) | Tetrahydrofuran | CDB |
| Example 30 | Example compound 47 (0.4 part) Example compound 63 (0.6 part) | J-1 (1 part) | Tetarhydrofuran | CDB |
| Comparative Example 7 | Comparative compound 1 (0.4 part) Example compound 63 (0.6 part) | J-1 (1 part) | Dichloroethane | CDB |

TABLE 28

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 28 | 1219 | 753 | 0 | 3.07 | 6.32 |
| Example 29 | 712 | 594 | 1 | 3.77 | 8.33 |
| Example 30 | 806 | 655 | 1 | 2.98 | 6.11 |
| Comparative Example 7 | 916 | 773 | 33 | 4.21 | 10.48 |

As apparent from Table 28, it has become clear that the photoreceptors of the present invention were low in residual potential and also low in $E_{1/2}$ and $E_{1/6}$, providing excellent electrophotographic characteristics, compared with the photoreceptor prepared by use of comparative compound 1.

EXAMPLES 31 TO 33 AND COMPARATIVE EXAMPLE 8

One part of x-form metal-free phthalocyanine (x-$H_2$Pc) and one part of a butyral resin (Polyvinyl Butyral BL-1, manufactured by Sekisui Chemical Co., Ltd.) were kneaded in a ball mill for 5 hours, using 30 parts of tetrahydrofuran as a solvent. The resulting pigment dispersion was applied onto a sheet in which aluminum was deposited over a polyethylene terephthalate (PET) film, and dried at 50° C. for 2 hours.

Further, one part of the test compounds in each example shown in Table 29 and one part of a polycarbonate resin represented by formula (H-2) (trade name: Polycarbonate Z, manufactured by Mitsubishi Gas Chemical Co., Inc.) were dissolved in 8 parts of an organic solvent by mixing. This solution was applied onto the charge generating layer with a doctor blade, and dried at 80° C. for 3 hours to prepare a photoreceptor. The electrophotographic characteristics of the photoreceptors thus obtained were measured in the same manner as with Examples 1 to 7.

In Comparative Example 8, comparative compound 1 was used in place of one of the test compounds.

Results thereof are shown in Table 30.

TABLE 29

| | Test Compound (Amount Used) | Polymer | Organic Solvent | Charge Generating Layer |
|---|---|---|---|---|
| Example 31 | Example compound 1 (0.5 part) Example compound 63 (0.5 part) | H-2 (1 part) | Dichloroethane | x-$H_2$Pc |
| Example 32 | Example compound 47 (0.4 part) Example compound 63 (0.6 part) | H-2 (1 part) | Dichloroethane | x-$H_2$Pc |
| Example 33 | Example compound 47 (0.4 part) Example compound 63 (0.6 part) | H-2 (1 part) | Tetarhydrofuran | x-$H_2$Pc |
| Comparative Example 8 | Comparative compound 1 (0.4 part) Example compound 63 (0.6 part) | H-2 (1 part) | Dichloroethane | x-$H_2$Pc |

TABLE 30

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 31 | 968 | 727 | 7 | 1.53 | 3.28 |
| Example 32 | 980 | 790 | 2 | 1.56 | 3.21 |
| Example 33 | 723 | 479 | 1 | 0.93 | 1.91 |
| Comparative Example 8 | 1042 | 834 | 45 | 1.84 | 5.16 |

As apparent from Table 30, it has become clear that the photoreceptors of the present invention of Examples 31 to 33 were low in residual potential and also low in $E_{1/2}$ and $E_{1/6}$, providing excellent electrophotographic characteristics, compared with the photoreceptor of Comparative Example 8.

EXAMPLE 34

In a charge generating layer, x-form metal-free phthalocyanine (x-$H_2$Pc) was used. The test compounds shown in Table 31 as charge transporting materials and a bisphenol A/biphenol copolymerized polycarbonate resin represented by formula (J-1) (manufactured by Idemitsu Kosan Co., Ltd.) were dissolved in an organic solvent. This solution was applied onto the charge generating layer with a doctor blade, and dried at 80° C. for 3 hours to prepare a photoreceptor. The electrophotographic characteristics of the photoreceptor thus obtained were measured in the same manner as with Examples 1 to 7.

Results thereof are shown in Table 32.

TABLE 31

| | Test Compound (Amount Used) | Polymer | Organic Solvent | Charge Generating Layer |
|---|---|---|---|---|
| Example 34 | Example compound 42 (0.4 part) Example compound 63 (0.6 part) | J-1 (1 part) | Tetrahydrofuran | x-$H_2$Pc |

TABLE 32

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 34 | 775 | 621 | 7 | 3.23 | 7.74 |

EXAMPLES 35 TO 38 AND COMPARATIVE EXAMPLE 9

One part of τ-form metal-free phthalocyanine (τ-$H_2$Pc) and one part of a butyral resin (trade name: Polyvinyl Butyral BL-1, manufactured by Sekisui Chemical Co., Ltd.) were kneaded in a ball mill for 5 hours, using 30 parts of tetrahydrofuran as a solvent. The resulting pigment dispersion was applied onto a sheet in which aluminum was deposited over a polyethylene terephthalate (PET) film, and dried at 50° C. for 2 hours.

Further, one part of the test compounds in each example shown in Table 33 and one part of a polycarbonate resin represented by formula (H-2) (trade name: Polycarbonate Z, manufactured by Mitsubishi Gas Chemical Co., Inc.) were dissolved in 8 parts of an organic solvent by mixing. This solution was applied onto the charge generating layer with a doctor blade, and dried at 80° C. for 3 hours to prepare a photoreceptor. The electrophotographic characteristics of the photoreceptors thus obtained were measured in the same manner as with Examples 1 to 7.

In Comparative Example 9, comparative compound 1 was used in place of one of the test compounds.

Results thereof are shown in Table 34.

TABLE 33

| | Test Compound (Amount Used) | Polymer | Organic Solvent | Charge Generating Layer |
|---|---|---|---|---|
| Example 35 | Example compound 1 (0.5 part) Example compound 63 (0.5 part) | H-2 (1 part) | Dichloroethane | τ-$H_2$Pc |
| Example 36 | Example compound 1 (0.4 part) Example compound 63 (0.6 part) | H-2 (1 part) | Dichloroethane | τ-$H_2$Pc |

TABLE 33-continued

| | Test Compound (Amount Used) | Polymer | Organic Solvent | Charge Generating Layer |
|---|---|---|---|---|
| Example 37 | Example compound 21 (0.5 part) Example compound 63 (0.5 part) | H-2 (1 part) | Dichloroethane | τ-$H_2$Pc |
| Example 38 | Example compound 47 (0.4 part) Example compound 63 (0.6 part) | H-2 (1 part) | Tetrahydrofuran | τ-$H_2$Pc |
| Comparative Example 9 | Comparative compound 1 (0.4 part) Example compound 63 (0.6 part) | H-2 (1 part) | Dichloroethane | τ-$H_2$Pc |

TABLE 34

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 35 | 594 | 278 | 7 | 0.84 | 3.94 |
| Example 36 | 934 | 752 | 20 | 1.73 | 3.88 |
| Example 37 | 665 | 344 | 5 | 0.85 | 2.46 |
| Example 38 | 703 | 531 | 0 | 0.86 | 1.69 |
| Comparative Example 9 | 596 | 290 | 43 | 1.53 | 35.64 |

As apparent from Table 34, it has become clear that the photoreceptors of the present invention of Examples 35 to 38 were low in residual potential and also low in $E_{1/6}$, providing excellent electrophotographic characteristics, compared with the photoreceptor of Comparative Example 9 prepared by use of comparative compound 1.

EXAMPLES 39 AND 40

In a charge generating layer, τ-form metal-free phthalocyanine (τ-$H_2$Pc) was used. One part of the test compounds in each example shown in Table 35 as charge transporting materials and a bisphenol A/biphenol copolymerized polycarbonate resin represented by formula (J-1) (manufactured by Idemitsu Kosan Co., Ltd.) were dissolved in an organic solvent. This solution was applied onto the charge generating layer with a doctor blade, and dried at 80° C. for 3 hours to prepare a photoreceptor. The electrophotographic characteristics of the photoreceptors thus obtained were measured in the same manner as with Examples 1 to 7.

Results thereof are shown in Table 36.

TABLE 35

| | Test Compound (Amount Used) | Polymer | Organic Solvent | Charge Generating Layer |
|---|---|---|---|---|
| Example 39 | Example compound 1 (0.3 part) Example compound 61 (0.7 part) | J-1 (1 part) | Tetrahydrofuran | τ-$H_2$Pc |
| Example 40 | Example compound 42 (0.4 part) Example compound 61 (0.6 part) | J-1 (1 part) | Tetrahydrofuran | τ-$H_2$Pc |

TABLE 36

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 39 | 620 | 354 | 7 | 0.84 | 2.44 |
| Example 40 | 640 | 355 | 5 | 0.77 | 1.85 |

EXAMPLE 41 AND COMPARATIVE EXAMPLE 10

One part of a bisazo pigment represented by formula (O) and one part of a polycarbonate resin (trade name: Yupilon E-2000, manufactured by Mitsubishi Gas Chemical Co., Inc.) were kneaded in a ball mill for 5 hours, using 30 parts of dichloroethane as a solvent. The resulting pigment dispersion was applied with a wire bar onto a sheet in which aluminum was deposited over a polyethylene terephthalate (PET) film, and dried at 50° C. for 3 hours to form a charge carrier generating layer to a thickness of about 1 μm.

Further, one part of the test compounds in each example shown in Table 37 and a bisphenol A/biphenol copolymerized polycarbonate resin represented by formula (J-1) (manufactured by Idemitsu Kosan Co., Ltd.) were dissolved in dichloroethane. This solution was applied onto the charge generating layer with a doctor blade, and dried at 80° C. for 3 hours to prepare a photoreceptor. The electrophotographic characteristics of the photoreceptors were measured in the same manner as with Examples 1 to 7.

In Comparative Example 10, comparative compound 1 was used in place of one of the test compounds. One part of the test compounds of Comparative Example 10 was dissolved by mixing, together with one part of the bisphenol A/biphenol copolymerized polycarbonate resin represented by formula (J-1), using 8 parts of dichloroethane as the organic solvent. The resulting solution was applied onto the bisazo (O)-containing charge generating layer with a doctor blade, and dried at 80° C. for 3 hours to prepare a photoreceptor.

Results thereof are shown in Table 38.

TABLE 37

| | Test Compound (Amount Used) | Polymer | Organic Solvent | Charge Generating Layer |
|---|---|---|---|---|
| Example 41 | Example compound 47 (0.4 part) Example compound 63 (0.6 part) | J-1 (1 part) | Dichloroethane | Bisazo (O) |
| Comparative Example 10 | Comparative compound 1 (0.4 part) Example compound 63 (0.6 part) | J-1 (1 part) | Dichloroethane | Bisazo (O) |

TABLE 38

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 41 | 1019 | 803 | 93 | 2.95 | 6.00 |
| Comparative Example 10 | 850 | 750 | 120 | 4.50 | Unmeasurable |

As apparent from Table 38, it has become clear that the photoreceptor of the present invention of Example 41 was low in residual potential and also low in $E_{1/2}$ providing excellent electrophotographic characteristics, compared with the photoreceptor of Comparative Example 10 prepared by use of comparative compound 1. It was impossible to measure $E_{1/6}$.

EXAMPLES 42 AND 43 AND COMPARATIVE EXAMPLE 11

One part of copper phthalocyanine (CuPc) and one part a butyral resin (Polyvinyl Butyral BL-1, manufactured by Sekisui Chemical Co., Ltd.) were kneaded in a ball mill for 5 hours, using 30 parts of tetrahydrofuran as a solvent. The resulting pigment dispersion was applied onto a sheet in which aluminum was deposited over a polyethylene terephthalate (PET) film, and dried at 50° C. for 2 hours.

Further, one part of the test compounds in each example shown in Table 39 and one part of a polycarbonate resin represented by formula (H-2) (Polycarbonate Z, manufactured by Mitsubishi Gas Chemical Co., Inc.) were dissolved in 8 parts of an organic solvent by mixing. This solution was applied onto the charge generating layer with a doctor blade, and dried at 80° C. for 3 hours to prepare a photoreceptor. The electrophotographic characteristics of the photoreceptors thus obtained were measured in the same manner as with Examples 1 to 7.

In Comparative Example 11, comparative compound 1 was used in place of one of the test compounds.

Results thereof are shown in Table 40.

TABLE 39

| | Test Compound (Amount Used) | Polymer | Organic Solvent | Charge Generating Layer |
|---|---|---|---|---|
| Example 42 | Example compound 1 (0.4 part) Example compound 63 (0.6 part) | H-2 (1 part) | Dichloroethane | CuPc |
| Example 43 | Example compound 42 (0.3 part) Example compound 61 (0.7 part) | H-2 (1 part) | Dichloroethane | CuPc |

TABLE 39-continued

| | Test Compound (Amount Used) | Polymer | Organic Solvent | Charge Generating Layer |
|---|---|---|---|---|
| Comparative Example 11 | Comparative compound 1 (0.4 part) Example compound 63 (0.6 part) | H-2 (1 part) | Dichloroethane | CuPc |

TABLE 40

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 42 | 1026 | 891 | 14 | 2.48 | 5.49 |
| Example 43 | 1022 | 893 | 9 | 2.35 | 5.16 |
| Comparative Example 11 | 979 | 792 | 50 | 2.84 | 8.12 |

As apparent from Table 40, it has become clear that the photoreceptors of the present invention of Examples 42 and 43 were low in residual potential and also low in $E_{1/2}$ and $E_{1/6}$, providing excellent electrophotographic characteristics, compared with the photoreceptor of Comparative Example 11 prepared by use of comparative compound 1.

EXAMPLE 44 AND COMPARATIVE EXAMPLE 12

A charge generating layer was prepared in the same manner as with Examples 42 and 43. One part of the test compounds in each example shown in Table 41 and one part of a bisphenol A/biphenol copolymerized polycarbonate resin represented by formula (J-1) (manufactured by Idemitsu Kosan Co., Ltd.) were dissolved in 8 parts of an organic solvent by mixing. This solution was applied onto the above-mentioned charge generating layer with a doctor blade, and dried at 80° C. for 3 hours to prepare a photoreceptor. The electrophotographic characteristics of the photoreceptors thus obtained were measured in the same manner as with Examples 1 to 7.

In Comparative Example 12, comparative compound 1 was used in place of one of the test compounds.

Results thereof are shown in Table 42.

TABLE 41

| | Test Compound (Amount Used) | Polymer | Organic Solvent | Charge Generating Layer |
|---|---|---|---|---|
| Example 44 | Example compound 47 (0.4 part) Example compound 63 (0.6 part) | J-1 (1 part) | Dichloroethane | CuPc |
| Comparative Example 12 | Comparative compound 1 (0.4 part) Example compound 63 (0.6 part) | J-1 (1 part) | Dichloroethane | CuPc |

TABLE 42

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 44 | 987 | 824 | 6 | 2.60 | 5.61 |
| Comparative Example 12 | 1071 | 918 | 59 | 2.79 | 7.54 |

As apparent from Table 42, it has become clear that the photoreceptor of the present invention of Example 44 was low in residual potential and also low in $E_{1/2}$ and $E_{1/6}$, providing excellent electrophotographic characteristics, compared with the photoreceptor of Comparative Example 12 prepared by use of comparative compound 1.

EXAMPLES 45 TO 47 AND COMPARATIVE EXAMPLE 13

A charge generating layer was prepared in the same manner as with Examples 1 to 7. A photoreceptor was prepared and the electrophotographic characteristics thereof were measured in the same manner as with Examples 1 to 7 with the exception that the test compounds in each example shown in Table 43 were used in an amount of one part in place of the compounds shown in Table 17.

In Comparative Example 13, example compound 63 (0.5 part) and example compound 128 (0.5 part) were used.

Results thereof are shown in Table 44.

TABLE 43

| | Test Compound (Amount Used) | Polymer | Organic Solvent | Charge Generating Layer |
|---|---|---|---|---|
| Example 45 | Example compound 21 (0.5 part) Example compound 85 (0.5 part) | H-2 (1 part) | Dichloroethane | TiOPc Deposited |
| Example 46 | Example compound 21 (0.5 part) Example compound 91 (0.5 part) | H-2 (1 part) | Dichloroethane | TiOPc Deposited |
| Example 47 | Example compound 21 (0.5 part) Example compound 128 (0.5 part) | H-2 (1 part) | Dichloroethane | TiOPc Deposited |
| Comparative Example 13 | Example compound 63 (0.5 part) Example compound 128 (0.5 part) | H-2 (1 part) | Dichloroethane | TiOPc Deposited |

TABLE 44

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 45 | 1121 | 1044 | 11 | 1.47 | 4.01 |
| Example 46 | 1197 | 876 | 39 | 2.06 | 7.59 |
| Example 47 | 1130 | 1041 | 22 | 1.42 | 3.92 |
| Comparative Example 13 | 1338 | 1228 | 258 | 2.33 | Unmeasurable |

As apparent from Table 44, it has become clear that the photoreceptors of the present invention prepared by use of the example compounds of Examples 45 to 47 were low in residual potential and also low in $E_{1/2}$, providing excellent electrophotographic characteristics, compared with the photoreceptor of Comparative Example 13 prepared by use of example compound 63 (0.5 part) and example compound 128 (0.5 part).

In Comparative Example 13, it was impossible to measure $E_{1/6}$ because of insufficient light attenuation.

EXAMPLES 48 TO 51 AND COMPARATIVE EXAMPLES 14 and 15

According to the method described in JP-A-1-291256, 40 parts of crystalline oxytitanyl phthalocyanine was added to a binder resin solution obtained by dissolving 35 parts of a butyral resin (trade name: Polyvinyl Butyral EL-1, manufactured by Sekisui Chemical Co., Ltd.) in 1,425 parts of tetrahydrofuran, and dispersed together with glass beads by use of a vibrating mill for 2 hours. This dispersion was applied with a wire bar onto a sheet in which aluminum was deposited over a polyethylene terephthalate (PET) film, and dried to form a charge generating layer.

One part of the example compounds in each example shown in Table 45 and one part of a polycarbonate resin represented by formula (H-2) (trade name: Polycarbonate Z, manufactured by Mitsubishi Gas Chemical Co., Inc.) were dissolved in 8 parts of an organic solvent by mixing. This solution was applied onto the charge generating layer with a doctor blade, and dried at 80° C. for 3 hours to prepare a photoreceptor. The electrophotographic characteristics of the photoreceptors thus obtained were measured in the same manner as with Examples 1 to 7.

In Comparative Example 14, example compound 63 (0.4 part) and example compound 85 (0.6 part) were used. On the other hand. in Comparative Example 15, only example compound 47, a triphenylamine compound, was used, Results thereof are shown in Table 46.

TABLE 45

| | Test Compound (Amount Used) | Polymer | Organic Solvent | Charge Generating Layer |
|---|---|---|---|---|
| Example 48 | Example compound 47 (0.4 part) Example compound 81 (0.6 part) | H-2 (1 part) | Dichloroethane | TiOPc Crystal |
| Example 49 | Example compound 47 (0.4 part) Example compound 85 (0.6 part) | H-2 (1 part) | Dichloroethane | TiOPc Crystal |
| Example 50 | Example compound 47 (0.4 part) Example compound 93 (0.6 part) | H-2 (1 part) | Dichloroethane | TiOPc Crystal |
| Example 51 | Example compound 47 (0.4 part) Example compound 99 (0.6 part) | H-2 (1 part) | Dichloroethane | TiOPc Crystal |
| Comparative Example 14 | Example compound 63 (0.4 part) Example compound 85 (0.6 part) | H-2 (1 part) | Dichloroethane | TiOPc Crystal |
| Comparative Example 15 | Example compound 47 (1.0 part) | H-2 (1 part) | Dichloroethane | TiOPc Crystal |

TABLE 46

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 48 | 1468 | 681 | 0 | 0.29 | 0.54 |
| Example 49 | 1083 | 678 | 2 | 0.32 | 0.73 |
| Example 50 | 1015 | 664 | 0 | 0.29 | 0.86 |
| Example 51 | 1166 | 756 | 3 | 0.30 | 0.64 |
| Comparative Example 14 | 1065 | 756 | 267 | 0.80 | Unmeasurable |
| Comparative Example 15 | Unmeasurable | | | | |

As apparent from Table 46, it has become clear that the photoreceptors of the present invention prepared by use of the example compounds of Examples 48 to 51 were low in residual potential and also low in $E_{1/2}$, providing excellent electrophotographic characteristics, compared with the photoreceptor of Comparative Example 14 prepared by use of example compound 63 (0.4 part) and example compound 85 (0.6 part).

In Comparative Example 14, it was impossible to measure $E_{1/6}$ because of insufficient light attenuation.

In Comparative Example 15 in which the triphenylamin compound was singly used, cracks developed in a photoreceptor film.

EXAMPLE 52 AND COMPARATIVE EXAMPLE 16

A charge generating layer was prepared in the same manner as with Examples 48 to 51. A photoreceptor was prepared in the same manner as with Examples 48 to 51 with the exception that the example compounds in each example shown in Table 47 were used in an amount of one part in place of the compounds shown in Table 45 and a bisphenol A/biphenol copolymerized polycarbonate resin represented by formula (J-1) (manufactured by Idemitsu Kosan Co., Ltd.) was used in place of the polycarbonate resin represented by formula (H-2), and the electrophotographic characteristics thereof were measured in the same manner as with Examples 1 to 7

In Comparative Example 16, comparative compound 1 was used in place of one of the example compounds.

Results thereof are shown in Table 48.

TABLE 47

| | Test Compound (Amount Used) | Polymer | Organic Solvent | Charge Generating Layer |
|---|---|---|---|---|
| Example 52 | Example compound 47 (0.4 part) Example compound 93 (0.6 part) | J-1 (1 part) | Dichloroethane | TiOPc Crystal |
| Comparative Example 16 | Comparative compound 1 (0.4 part) Example compound 93 (0.6 part) | J-1 (1 part) | Dichloroethane | TiOPc Crystal |

TABLE 48

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 52 | 626 | 232 | 4 | 0.20 | 0.47 |
| Comparative Example 16 | 990 | 784 | 18 | 0.71 | 1.86 |

As apparent from Table 48, it has become clear that the photoreceptor of the present invention prepared by use of the example compounds of Example 52 was low in residual potential and also low in $E_{1/2}$ and $E_{1/6}$, providing excellent electrophotographic characteristics, compared with the photoreceptor of Comparative Example 16 prepared by use of comparative compound 1.

EXAMPLES 53 TO 56 AND COMPARATIVE EXAMPLE 17

A charge generating layer was prepared in the same manner as with Examples 20 to 27.

One part of the example compounds in each example shown in Table 49 as charge transporting materials and one part of a polycarbonate resin represented by formula (H-2) (trade name: Polycarbonate Z. manufactured by Mitsubishi Gas Chemical Co., Inc.) were dissolved in 8 parts of dichloroethane by mixing. This solution was applied onto the charge generating layer with a doctor blade, and dried at 80° C. for 3 hours to prepare a photoreceptor. The electrophotographic characteristics of the photoreceptors thus obtained were measured in the same manner as with Examples 1 to 7.

In Comparative Example 17, example compound 63 (0.4 part) and example compound 85 (0.6 part) were used.

Results thereof are shown in Table 50.

TABLE 49

| | Test Compound (Amount Used) | Polymer | Organic Solvent | Charge Generating Layer |
|---|---|---|---|---|
| Example 53 | Example compound 47 (0.4 part) Example compound 81 (0.6 part) | H-2 (1 part) | Dichloroethane | CDB |
| Example 54 | Example compound 47 (0.4 part) Example compound 82 (0.6 part) | H-2 (1 part) | Dichloroethane | CDB |
| Example 55 | Example compound 47 (0.4 part) Example compound 93 (0.6 part) | H-2 (1 part) | Dichloroethane | CDB |
| Example 56 | Example compound 47 (0.4 part) Example compound 99 (0.6 part) | H-2 (1 part) | Dichloroethane | CDB |
| Comparative Example 17 | Example compound 63 (0.4 part) Example compound 85 (0.6 part) | H-2 (1 part) | Dichloroethane | CDB |

TABLE 50

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 53 | 1581 | 1384 | 7 | 3.08 | 6.72 |
| Example 54 | 1425 | 1187 | 0 | 3.55 | 7.55 |
| Example 55 | 1487 | 1309 | 0 | 2.83 | 5.94 |

TABLE 50-continued

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 56 | 1651 | 1424 | 0 | 3.37 | 7.52 |
| Comparative Example 17 | 1133 | 910 | 54 | 4.42 | 11.28 |

As apparent from Table 50, it has become clear that the photoreceptors of the present invention prepared by use of the example compounds of Examples 53 to 56 were low in residual potential and also low in $E_{1/2}$ and $E_{1/6}$, providing excellent electrophotographic characteristics, compared with the photoreceptor of Comparative Example 17 prepared by use of example compound 63 (0.4 part) and example compound 85 (0.6 part).

EXAMPLES 57 AND 58 AND COMPARATIVE EXAMPLE 18

A charge generating layer was prepared in the same manner as with Examples 20 to 27.

One part of the example compounds in each example shown in Table 51 and one part of a bisphenol A/biphenol copolymerized polycarbonate resin represented by formula (J-1) (manufactured by Idemitsu Kosan Co., Ltd.) were dissolved in 8 parts of dichloroethane by mixing. This solution was applied onto the charge generating layer with a doctor blade, and dried at 80° C. for 3 hours to prepare a photoreceptor. The electrophotographic characteristics of the photoreceptors thus obtained were measured in the same manner as with Examples 1 to 7.

In Comparative Example 18, example compound 63 (0.4 part) and example compound 81 (0.6 part) were used.

Results thereof are shown in Table 52.

TABLE 51

| | Test Compound (Amount Used) | Polymer | Organic Solvent | Charge Generating Layer |
|---|---|---|---|---|
| Example 57 | Example compound 47 (0.4 part) Example compound 81 (0.6 part) | J-1 (1 part) | Dichloroethane | CDB |
| Example 58 | Example compound 47 (0.4 part) Example compound 93 (0.6 part) | J-1 (1 part) | Dichloroethane | CDB |
| Comparative Example 18 | Example compound 63 (0.4 part) Example compound 81 (0.6 part) | J-1 (1 part) | Dichloroethane | CDB |

TABLE 52

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 57 | 936 | 839 | 7 | 3.32 | 7.28 |
| Example 58 | 897 | 802 | 1 | 2.88 | 6.21 |
| Comparative Example 18 | 1160 | 979 | 189 | 5.29 | Unmeasurable |

As apparent from Table 52, it has become clear that the photoreceptors of the present invention prepared by use of the example compounds of Examples 57 and 58 were low in residual potential and also low in $E_{1/2}$, providing excellent electrophotographic characteristics, compared with the photoreceptor of Comparative Example 18 prepared by use of example compound 63 (0.4 part) and example compound 81 (0.6 part).

In Comparative Example 18, it was impossible to measure $E_{1/6}$ because of insufficient light attenuation.

EXAMPLES 59 TO 61 AND COMPARATIVE EXAMPLE 19

A charge generating layer was prepared in the same manner as with Examples 31 to 33.

One part of the example compounds in each example shown in Table 53 and one part of a polycarbonate resin represented by formula (H-2) (trade name: Polycarbonate Z, manufactured by Mitsubishi Gas Chemical Co., Inc.) were dissolved in 8 parts of dichloroethane by mixing. This solution was applied onto the charge generating layer with a doctor blade, and dried at 80° C. for 3 hours to prepare a photoreceptor. The electrophotographic characteristics of the photoreceptors thus obtained were measured in the same manner as with Examples 1 to 7.

In Comparative Example 19, example compound 63 (0.4 part) and example compound 85 (0.6 part) were used.

Results thereof are shown in Table 54.

TABLE 53

| | Test Compound (Amount Used) | Polymer | Organic Solvent | Charge Generating Layer |
|---|---|---|---|---|
| Example 59 | Example compound 47 (0.4 part) Example compound 81 (0.6 part) | H-2 (1 part) | Dichloroethane | x-$H_2$Pc |
| Example 60 | Example compound 47 (0.4 part) Example compound 85 (0.6 part) | H-2 (1 part) | Dichloroethane | x-$H_2$Pc |
| Example 61 | Example compound 47 (0.4 part) Example compound 109 (0.6 part) | H-2 (1 part) | Dichloroethane | x-$H_2$Pc |
| Comparative Example 19 | Example compound 63 (0.4 part) Example compound 85 (0.6 part) | H-2 (1 part) | Dichloroethane | x-$H_2$Pc |

TABLE 54

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 59 | 1318 | 956 | 0 | 1.22 | 2.54 |
| Example 60 | 1618 | 1379 | 0 | 1.60 | 3.35 |
| Example 61 | 1509 | 1235 | 0 | 1.42 | 2.91 |
| Comparative Example 19 | 488 | 290 | 232 | Unmeasurable | Unmeasurable |

As apparent from Table 54, it has become clear that the photoreceptors of the present invention prepared by use of the example compounds of Examples 59 to 61 were low in residual potential, providing excellent electrophotographic characteristics, compared with the photoreceptor of Comparative Example 19 prepared by use of example compound 63 (0.4 part) and example compound 85 (0.6 part).

In Comparative Example 19, it was impossible to measure $E_{1/2}$ and $E_{1/6}$ because of insufficient light attenuation.

EXAMPLE 62 TO 64 AND COMPARATIVE EXAMPLE 20

A charge generating layer was prepared in the same manner as with Examples 35 to 38.

One part of the example compounds in each example shown in Table 55 and one part of a polycarbonate resin represented by formula (H-2) (trade name: Polycarbonate Z, manufactured by Mitsubishi Gas Chemical Co., Inc.) were dissolved in 8 parts of dichloroethane by mixing. This solution was applied onto the charge generating layer with a doctor blade, and dried at 80° C. for 3 hours to prepare a photoreceptor. The electrophotographic characteristics of the photoreceptors thus obtained were measured in the same manner as with Examples 1 to 7.

In Comparative Example 20, example compound 63 (0.4 part) and example compound 82 (0.6 part) were used.

Results thereof are shown in Table 56.

TABLE 55

| | Test Compound (Amount Used) | Polymer | Organic Solvent | Charge Generating Layer |
|---|---|---|---|---|
| Example 62 | Example compound 47 (0.4 part) Example compound 82 (0.6 part) | H-2 (1 part) | Dichloroethane | τ-$H_2$Pc |
| Example 63 | Example compound 47 (0.4 part) Example compound 93 (0.6 part) | H-2 (1 part) | Dichloroethane | τ-$H_2$Pc |
| Example 64 | Example compound 47 (0.4 part) Example compound 109 (0.6 part) | H-2 (1 part) | Dichloroethane | τ-$H_2$Pc |
| Comparative Example 20 | Example compound 63 (0.4 part) Example compound 82 (0.6 part) | H-2 (1 part) | Dichloroethane | τ-$H_2$Pc |

TABLE 56

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 62 | 1392 | 933 | 0 | 0.90 | 1.87 |
| Example 63 | 1054 | 528 | 0 | 0.68 | 1.33 |
| Example 64 | 1161 | 751 | 0 | 0.89 | 1.73 |
| Comparative Example 20 | 400 | 189 | 68 | 5.22 | Unmeasurable |

As apparent from Table 56, it has become clear that the photoreceptors of the present invention prepared by use of the example compounds of Examples 62 to 64 were low in residual potential and also low in $E_{1/2}$, providing excellent electrophotographic characteristics, compared with the photoreceptor of Comparative Example 20 prepared by use of example compound 63 (0.4 part) and example compound 82 (0.6 part).

In Comparative Example 20, it was impossible to measure $E_{1/6}$ because of insufficient light attenuation.

EXAMPLES 65 TO 67 AND COMPARATIVE EXAMPLE 21

A charge generating layer was prepared in the same manner as with Example 41.

Further, one part of the example compounds in each example shown in Table 57 and one part of a bisphenol A/biphenol copolymerized polycarbonate resin represented by formula (J-1) (manufactured by Idemitsu Kosan Co., Ltd.) were dissolved in 8 parts of dichloroethane by mixing. This solution was applied onto the charge generating layer with a doctor blade, and dried at 80° C. for 3 hours to prepare a photoreceptor. The electrophotographic characteristics of the photoreceptors thus obtained were measured in the same manner as with Examples 1 to 7.

In Comparative Example 21, example compound 63 (0.4 part) and example compound 85 (0.6 part) were used.

Results thereof are shown in Table 58.

TABLE 57

| | Test Compound (Amount Used) | Polymer | Organic Solvent | Charge Generating Layer |
|---|---|---|---|---|
| Example 65 | Example compound 47 (0.4 part) Example compound 81 (0.6 part) | J-1 (1 part) | Dichloroethane | Bisazo (O) |
| Example 66 | Example compound 47 (0.4 part) Example compound 82 (0.6 part) | J-1 (1 part) | Dichloroethane | Bisazo (O) |
| Example 67 | Example compound 47 (0.4 part) Example compound 85 (0.6 part) | J-1 (1 part) | Dichloroethane | Bisazo (O) |
| Comparative Example 21 | Example compound 63 (0.4 part) Example compound 85 (0.6 part) | J-1 (1 part) | Dichloroethane | Bisazo (O) |

TABLE 58

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 65 | 1306 | 1009 | 12 | 1.69 | 2.91 |
| Example 66 | 1396 | 1195 | 0 | 1.75 | 3.25 |
| Example 67 | 1505 | 1176 | 6 | 2.16 | 3.97 |
| Comparative Example 21 | 721 | 499 | 37 | 2.08 | 4.74 |

As apparent from Table 58, it has become clear that the photoreceptors of the present invention prepared by use of the example compounds of Examples 65 to 67 were low in residual potential and also low in $E_{1/6}$, providing excellent electrophotographic characteristics, compared with the photoreceptor of Comparative Example 21 prepared by use of example compound 63 (0.4 part) and example compound 85 (0.6 part).

EXAMPLE 68 AND COMPARATIVE EXAMPLE 22

A charge generating layer was prepared in the same manner as with Examples 42 and 43.

Further, one part of the example compounds in each example shown in Table 59 and one part of a polycarbonate resin represented by formula (H-2) (trade name: Polycarbonate Z, manufactured by Mitsubishi Gas Chemical Co., Inc.) were dissolved in 8 parts of dichloroethane by mixing. This solution was applied onto the charge generating layer with a doctor blade, and dried at 80° C. for 3 hours to prepare a photoreceptor. The electrophotographic characteristics of the photoreceptors thus obtained were measured in the same manner as with Examples 1 to 7.

In Comparative Example 22, example compound 63 (0.4 part) and example compound 82 (0.6 part) were used.

Results thereof are shown in Table 60.

TABLE 59

| | Test Compound (Amount Used) | Polymer | Organic Solvent | Charge Generating Layer |
|---|---|---|---|---|
| Example 68 | Example compound 47 (0.4 part) Example compound 82 (0.6 part) | H-2 (1 part) | Dichloroethane | CuPc |
| Comparative Example 22 | Example compound 63 (0.4 part) Example compound 82 (0.6 part) | H-2 (1 part) | Dichloroethane | CuPc |

TABLE 60

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 68 | 1562 | 1359 | 4 | 2.64 | 5.90 |
| Comparative Example 22 | 1059 | 971 | 221 | 3.83 | Unmeasurable |

As apparent from Table 60, it has become clear that the photoreceptor of the present invention prepared by use of the example compounds of Example 68 was low in residual potential and also low in $E_{1/2}$, providing excellent electrophotographic characteristics, compared with the photoreceptor of Comparative Example 22 prepared by use of example compound 63 (0.4 part) and example compound 82 (0.6 part).

In Comparative Example 22, it was impossible to measure $E_{1/6}$ because of insufficient light attenuation.

EXAMPLES 69 AND 70 AND COMPARATIVE EXAMPLE 23

A charge generating layer was prepared in the same manner as with Example 68.

One part of the example compounds in each example shown in Table 61 and one part of a bisphenol A/biphenol copolymerized polycarbonate resin represented by formula (J-1) (manufactured by Idemitsu Kosan Co., Ltd.) were dissolved in 8 parts of dichloroethane by mixing. This solution was applied onto the charge generating layer with a doctor blade, and dried at 80° C. for 3 hours to prepare a photoreceptor. The electrophotographic characteristics of the photoreceptors thus obtained were measured in the same manner as with Examples 1 to 7.

In Comparative Example 23, example compound 63 (0.4 part) and example compound 93 (0.6 part) were used.

Results thereof are shown in Table 62.

TABLE 61

| | Test Compound (Amount Used) | Polymer | Organic Solvent | Charge Generating Layer |
|---|---|---|---|---|
| Example 69 | Example compound 47 (0.4 part) Example compound 81 (0.6 part) | J-1 (1 part) | Dichloroethane | CuPc |
| Example 70 | Example compound 47 (0.4 part) Example compound 93 (0.6 part) | J-1 (1 part) | Dichloroethane | CuPc |
| Comparative Example 23 | Example compound 63 (0.4 part) Example compound 93 (0.6 part) | J-1 (1 part) | Dichloroethane | CuPc |

TABLE 62

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 69 | 667 | 584 | 6 | 2.67 | 5.99 |
| Example 70 | 883 | 769 | 2 | 2.51 | 5.77 |
| Comparative Example 23 | 898 | 733 | 149 | 2.79 | Unmeasurable |

As apparent from Table 62, it has become clear that the photoreceptors of the present invention prepared by use of the example compounds of Examples 69 and 70 were low in residual potential and also low in $E_{1/2}$, providing excellent electrophotographic characteristics, compared with the photoreceptor of Comparative Example 23 prepared by use of example compound 63 (0.4 part) and example compound 93 (0.6 part).

In Comparative Example 23, it was impossible to measure $E_{1/6}$ because of insufficient light attenuation.

EXAMPLE 71 AND COMPARATIVE EXAMPLE 24

An underlayer, a charge generating layer and a charge transporting layer are successively formed on an aluminum drum by a dip coating method to prepare an OPC (organic photoconductor) having a film thickness of 20 $\mu$m.

For the charge generating layer, a dispersion was used which was obtained by adding 40 parts of crystalline oxytitanyl phthalocyanine to a binder resin solution obtained by dissolving 35 parts of a butyral resin (trade name: Polyvinyl Butyral BL-1, manufactured by Sekisui Chemical Co., Ltd.) in 1,425 parts of tetrahydrofuran, and dispersing it together with glass beads by use of a vibrating mill for 2 hours, according to the method described in JP-A-1-291256.

For the charge generating layer, a solution was used which was obtained by dissolving 0.2 part of example compound 47, 0.8 part of example compound 81 and one part of a polycarbonate resin represented by formula (H-2) (trade name: Polycarbonate Z, manufactured by Mitsubishi Gas Chemical Co., Inc.) in 8 parts of dichloroethane by mixing.

After standing of this coating solution in the dark for 2 months, a photoreceptor was prepared similarly.

The electrophotographic characteristics were measured with a Cynthia 99HC (manufactured by Gentec Co., Ltd.).

The retention was determined from the ratio of a reduced amount of charge potential from an initial charge potential to a surface potential after 5 seconds in the dark to the initial charge potential, when a photoreceptor was charged by corona discharge. The half-exposure $E_{1/2}$ ($\mu$J/cm$^2$) was calculated by determining a time taken until a surface potential reached one-half (−300 V) of an initial surface potential (−600 V). Further, $E_{1}$oo is an irradiation energy necessary for attenuating the initial surface potential (−600 V) to −100 V.

In Comparative Example 24, a solution was used which was obtained by dissolving one part of example compound 81 and one part of a polycarbonate resin represented by formula (H-2) (trade name: Polycarbonate Z. manufactured by Mitsubishi Gas Chemical Co., Inc.) in 8 parts of dichloroethane by mixing.

Results thereof are shown in Table 63.

TABLE 63

| | | Initial Characteristics | | | After standing for 2 months | | |
|---|---|---|---|---|---|---|---|
| | Charge Transporting material | Retention (%) | $E_{1/2}$ ($\mu J/cm^2$) | $E_{100}$ ($\mu J/cm^2$) | Retention (%) | $E_{1/2}$ ($\mu J/cm^2$) | $E_{100}$ ($\mu J/cm^2$) |
| Example 71 | Example compound 47 Example compaund 81 | 89.5 | 0.22 | 0.63 | 89.1 | 0.22 | 1.59 |
| Comparative Example 24 | Example compound 81 | 90.1 | 0.22 | 2.40 | 89.1 | 0.24 | 5.31 |

As apparent from Table 63, the photoreceptor of the present invention obtained in Example 71 was small in changes in characteristics before and after standing of the coating solution, compared with the photoreceptor obtained by use of example compound 81 alone in Comparative Example 24. Thus, the photoreceptor in which example compound 47 was mixed with example compound 81 could increase the stability of the coating solution.

EXAMPLES 72 TO 75 AND COMPARATIVE EXAMPLES 25 AND 26

A charge generating layer was prepared in the same manner as with Examples 1 to 7. A photoreceptor was prepared and the electrophotographic characteristics thereof were measured in the same manner as with Examples 1 to 7 with the exception that the test compounds in each example shown in Table 64 were used in an amount of one part in place of the compounds shown in Table 17.

In Comparative Example 25, comparative compound 1 was used in place of one of the example compounds, and in Comparative Example 26, only comparative compound 1 was used.

Results thereof are shown in Table 65.

TABLE 64

| | Test Compound (Amount Used) | Organic Polymer | Solvent | Charge Generating Layer |
|---|---|---|---|---|
| Example 72 | Example compound 1 (0.4 part) Example compound 132 (0.6 part) | H-2 (1 part) | Dichloroethane | TiOPc Deposited |
| Example 73 | Example compound 21 (0.5 part) Example compound 132 (0.5 part) | H-2 (1 part) | Dichloroethane | TiOPc Deposited |
| Example 74 | Example compound 47 (0.4 part) Example compound 131 (0.6 part) | H-2 (1 part) | Tetrahydrofuran | TiOPc Deposited |
| Example 75 | Example compound 47 (0.4 part) Example compound 152 (0.6 part) | H-2 (1 part) | Dichloroethane | TiOPc Deposited |
| Comparative Example 25 | Comparative compound 1 (0.4 part) Example compound 132 (0.6 part) | H-2 (1 part) | Dichloroethane | TiOPc Deposited |
| Comparative Example 26 | Comparative compound 1 (1 part) | H-2 (1 part) | Dichloroethane | TiOPc Deposited |

TABLE 44

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 72 | 1175 | 909 | 3 | 0.56 | 1.39 |
| Example 73 | 792 | 515 | 21 | 0.67 | 2.11 |
| Example 74 | 1805 | 1658 | 0 | 1.14 | 2.61 |
| Example 75 | 844 | 591 | 8 | 0.43 | 0.87 |
| Comparative Example 25 | 1175 | 1012 | 82 | 1.57 | 5.73 |
| Comparative Example 26 | Unmeasurable | | | | |

As apparent from Table 65, it has become clear that the photoreceptors of the present invention prepared by use of the example compounds of Examples 72 to 75 were low in residual potential and also low in $E_{1/2}$ and $E_{1/6}$, providing excellent electrophotographic characteristics, compared with the photoreceptor of Comparative Example 25 prepared by use of comparative compound 1.

In the photoreceptor of Comparative Example 26 prepared by use of example compound 47 alone, cracks developed after film formation and drying, resulting in the failure of measurement.

EXAMPLES 76 TO 78 AND COMPARATIVE EXAMPLE 27

A charge generating layer was prepared in the same manner as with Examples 1 to 7.

Further, one part of the example compounds in each example shown in Table 66 and one part of a bisphenol A/biphenol copolymerized polycarbonate resin represented by formula (J-1) (manufactured by Idemitsu Kosan Co., Ltd.) were dissolved in 8 parts of an organic solvent by mixing. This solution was applied onto the charge generating layer with a doctor blade, and dried at 80° C. for 3 hours to prepare a photoreceptor. The electrophotographic characteristics of the photoreceptors thus obtained were measured in the same manner as with Examples 1 to 7.

In comparative Example 27, comparative compound 1 was used in place of the triphenylamine compound (1) of the example compounds.

Results thereof are shown in Table 67.

TABLE 66

| | Test Compound (Amount Used) | Polymer | Organic Solvent | Charge Generating Layer |
|---|---|---|---|---|
| Example 76 | Example compound 47 (0.4 part) Example compound 131 (0.6 part) | J-1 (1 part) | Toluene | TiOPc Deposited |
| Example 77 | Example compound 47 (0.5 part) Example compound 131 (0.5 part) | J-1 (1 part) | Dioxane | TiOPc Deposited |
| Example 78 | Example compound 47 (0.4 part) Example compound 131 (0.6 part) | J-1 (1 part) | Tetrahydrofuran | TiOPc Deposited |
| Comparative Example 27 | Comparative compound 1 (0.4 part) Example compound 132 (0.6 part) | J-1 (1 part) | Dichloroethane | TiOPc Deposited |

TABLE 67

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 76 | 675 | 549 | 4 | 1.35 | 3.29 |
| Example 77 | 1000 | 899 | 0 | 1.16 | 2.78 |
| Example 78 | 1004 | 918 | 0 | 1.07 | 2.48 |
| Comparative Example 27 | 1140 | 989 | 66 | 1.45 | 4.63 |

As apparent from Table 67, it has become clear that the photoreceptors of the present invention prepared by use of the example compounds of Examples 76 to 78 were low in residual potential and also low in $E_{1/2}$ and $E_{1/6}$, providing excellent electrophotographic characteristics, compared with the photoreceptor of Comparative Example 27 prepared by use of comparative compound 1.

EXAMPLES 79 TO 81 AND COMPARATIVE EXAMPLE 28

A charge generating layer was prepared in the same manner as with Examples 14 to 17.

Further, one part of the example compounds in each example shown in Table 68 and one part of a polycarbonate resin represented by formula (H-2) (trade name: Polycarbonate Z, manufactured by Mitsubishi Gas Chemical Co., Inc.) were dissolved in 8 parts of an organic solvent by mixing. This solution was applied onto the charge generating layer with a doctor blade, and dried at 80° C. for 3 hours to prepare a photoreceptor. The electrophotographic characteristics of the photoreceptors thus obtained were measured in the same manner as with Examples 1 to 7.

In Comparative Example 28, comparative compound 1 was used in place of the triphenylamine compound (1) of the example compounds.

Results thereof are shown in Table 69.

TABLE 68

| | Test Compound (Amount Used) | Polymer | Organic Solvent | Charge Generating Layer |
|---|---|---|---|---|
| Example 79 | Example compound 21 (0.5 part) Example compound 132 (0.5 part) | H-2 (1 part) | Dichloroethane | TiOPc Deposited |
| Example 80 | Example compound 47 (0.4 part) Example compound 131 (0.6 part) | H-2 (1 part) | Tetrahydrofuran | TiOPc Deposited |
| Example 81 | Example compound 47 (0.5 part) Example compound 152 (0.5 part) | H-2 (1 part) | Dichloroethane | TiOPc Deposited |
| Comparative Example 28 | Comparative compound 1 (0.4 part) Example compound 132 (0.6 part) | H-2 (1 part) | Dichloroethane | TiOPc Deposited |

TABLE 69

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 79 | 876 | 532 | 0 | 0.33 | 0.64 |
| Example 80 | 1060 | 734 | 0 | 0.29 | 0.56 |
| Example 81 | 586 | 238 | 10 | 0.26 | 0.53 |
| Comparative Example 28 | 714 | 389 | 75 | 0.75 | Unmeasurable |

As apparent from Table 69, it has become clear that the photoreceptors of the present invention prepared by use of the example compounds of Examples 79 to 81 were low in residual potential and also low in $E_{1/2}$, providing excellent electrophotographic characteristics, compared with the photoreceptor of Comparative Example 28 prepared by use of comparative compound 1.

In Comparative Example 28, it was impossible to measure $E_{1/6}$ because of insufficient light sensitivity.

EXAMPLE 82 AND COMPARATIVE EXAMPLE 29

A charge generating layer was prepared in the same manner as with Examples 14 to 17. Further, a photoreceptor was prepared in the same manner as with Examples 48 to 51 with the exception that the example compounds in each example shown in Table 70 were used in an amount of one part in place of the compounds shown in Table 45 and a bisphenol A/biphenol copolymerized polycarbonate resin represented by formula (J-1) (manufactured by Idemitsu Kosan Co., Ltd.) was used in an amount of one part in place of the polycarbonate resin represented by formula (H-2). The electrophotographic characteristics of the photoreceptors thus obtained were measured in the same manner as with Examples 1 to 7.

In Comparative Example 29, comparative compound 1 was used in place of the triphenylamine compound (1) of the example compounds.

Results thereof are shown in Table 71.

As apparent from Table 71, it has become clear that the photoreceptor of the present invention prepared by use of the example compounds of Example 82 was low in residual potential and also low in $E_{1/2}$, providing excellent electrophotographic characteristics, compared with the photoreceptor of Comparative Example 29 prepared by use of comparative compound 1.

In Comparative Example 29, it was impossible to measure $E_{1/6}$ because of insufficient light sensitivity.

EXAMPLES 83 AND 84 AND COMPARATIVE EXAMPLE 30

A charge generating layer was prepared in the same manner as with Examples 20 to 27.

Further, one part of the example compounds in each example shown in Table 72 and one part of a polycarbonate resin represented by formula (H-2) (trade name: Polycarbonate Z, manufactured by Mitsubishi Gas Chemical Co., Inc.) were dissolved in 8 parts of an organic solvent by mixing. This solution was applied onto the charge generating layer with a doctor blade, and dried at 80° C. for 3 hours to prepare a photoreceptor. The electrophotographic characteristics of the photoreceptors thus obtained were measured in the same manner as with Examples 1 to 7.

TABLE 70

| | Test Compound (Amount Used) | Polymer | Organic Solvent | Charge Generating Layer |
|---|---|---|---|---|
| Example 82 | Example compound 47 (0.4 part) Example compound 131 (0.6 part) | J-1 (1 part) | Dichloroethane | TiOPc Deposited |
| Comparative Example 29 | Comparative compound 1 (0.4 part) Example compound 132 (0.6 part) | J-1 (1 part) | Dichloroethane | TiOPc Deposited |

TABLE 67

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 82 | 821 | 539 | 0 | 0.35 | 0.70 |
| Comparative Example 29 | 604 | 166 | 59 | 7.82 | Unmeasurable |

In Comparative Example 30, comparative compound 1 was used in place of the triphenylamine compound (1) of the example compounds.

Results thereof are shown in Table 73.

TABLE 72

| | Test Compound (Amount Used) | Polymer | Organic Solvent | Charge Generating Layer |
|---|---|---|---|---|
| Example 83 | Example compound 1 (0.6 part) Example compound 132 (0.4 part) | H-2 (1 part) | Dichloroethane | CDB |
| Example 84 | Example compound 47 (0.4 part) Example compound 131 (0.6 part) | H-2 (1 part) | Tetrahydrofuran | CDB |
| Comparative Example 30 | Comparative compound 1 (0.4 part) | H-2 (1 part) | Dichloroethane | CDB |

TABLE 72-continued

| | Test Compound (Amount Used) | Polymer | Organic Solvent | Charge Generating Layer |
|---|---|---|---|---|
| | Example compound 132 (0.6 part) | | | |

TABLE 73

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 83 | 1022 | 886 | 0 | 4.14 | 9.15 |
| Example 84 | 800 | 691 | 0 | 3.56 | 7.52 |
| Comparative Example 30 | 1094 | 912 | 95 | 4.71 | 15.35 |

As apparent from Table 73, it has become clear that the photoreceptors of the present invention prepared by use of the example compounds of Examples 83 and 84 were low in residual potential and also low in $E_{1/2}$ and $E_{1/6}$, providing excellent electrophotographic characteristics, compared with the photoreceptor of Comparative Example 30 prepared by use of comparative compound 1.

EXAMPLES 85 AND 86 AND COMPARATIVE EXAMPLE 31

Chlorodian blue (CDB) was used as a charge generating material similarly to Examples 20 to 27. One part of the example compounds in each example shown in Table 74 as charge transporting materials and one part of a bisphenol A/biphenol copolymerized polycarbonate resin represented by formula (J-1) (manufactured by Idemitsu Kosan Co., Ltd.) were dissolved in 8 parts of an organic solvent. This solution was applied onto the charge generating layer with a doctor blade, and dried at 80° C. for 3 hours to prepare a photoreceptor. The electrophotographic characteristics of the photoreceptors thus obtained were measured in the same manner as with Examples 1 to 7.

In Comparative Example 31, comparative compound 1 was used in place of the triphenylamine compound (1) of the example compounds.

Results thereof are shown in Table 75.

TABLE 74

| | Test Compound (Amount Used) | Polymer | Organic Solvent | Charge Generating Layer |
|---|---|---|---|---|
| Example 85 | Example compound 47 (0.6 part) Example compound 131 (0.4 part) | J-1 (1 part) | Toluene | CDB |
| Example 86 | Example compound 47 (0.3 part) Example compound 131 (0.7 part) | J-1 (1 part) | Dioxane | CDB |
| Comparative Example 31 | Comparative compound 1 (0.4 part) Example compound 132 (0.6 part) | J-1 (1 part) | Dichloroethane | CDB |

TABLE 75

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 85 | 796 | 705 | 0 | 3.85 | 8.27 |
| Example 86 | 798 | 683 | 0 | 3.02 | 6.34 |
| Comparative Example 31 | 868 | 738 | 34 | 4.46 | 10.81 |

As apparent from Table 75, it has become clear that the photoreceptors of the present invention prepared by use of the example compounds of Examples 85 and 86 were low in residual potential and also low in $E_{1/2}$ and $E_{1/6}$, providing excellent electrophotographic characteristics, compared with the photoreceptor of Comparative Example 31 prepared by use of comparative compound 1.

EXAMPLES 87 TO 90 AND COMPARATIVE EXAMPLE 32

A charge generating layer was prepared in the same manner as with Examples 31 to 33.

Further, one part of the example compounds in each example shown in Table 76 and one part of a polycarbonate resin represented by formula (H-2) (trade name: Polycarbonate Z, manufactured by Mitsubishi Gas Chemical Co., Inc.) were dissolved in 8 parts of dichloroethane by mixing. This solution was applied onto the charge generating layer with a doctor blade, and dried at 80° C. for 3 hours to prepare a photoreceptor. The electrophotographic characteristics of the photoreceptors thus obtained were measured in the same manner as with Examples 1 to 7.

In Comparative Example 32, comparative compound 1 was used in place of the triphenylamine compound (1) of the example compounds.

Results thereof are shown in Table 77.

TABLE 76

| | Test Compound (Amount Used) | Polymer | Organic Solvent | Charge Generating Layer |
|---|---|---|---|---|
| Example 87 | Example compound 1 (0.5 part) Example compound 132 (0.5 part) | H-2 (1 part) | Dichloroethane | x-$H_2$PC |
| Example 88 | Example compound 21 (0.5 part) Example compound 132 (0.5 part) | H-2 (1 part) | Dichloroethane | x-$H_2$Pc |
| Example 89 | Example compound 47 (0.4 part) Example compound 131 (0.6 part) | H-2 (1 part) | Dichloroethane | x-$H_2$Pc |
| Example 90 | Example compound 47 (0.4 part) Example compound 152 (0.6 part) | H-2 (1 part) | Dichloroethane | x-$H_2$Pc |
| Comparative Example 32 | Comparative compound 1 (0.4 part) Example compound 132 (0.6 part) | H-2 (1 part) | Dichloroethane | x-$H_2$Pc |

TABLE 77

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 87 | 1094 | 947 | 0 | 1.54 | 3.10 |
| Example 88 | 1113 | 993 | 0 | 1.70 | 3.46 |
| Example 89 | 1135 | 759 | 0 | 1.54 | 3.09 |
| Example 90 | 1037 | 934 | 0 | 1.10 | 1.09 |
| Comparative Example 32 | 904 | 652 | 77 | 1.49 | 12.95 |

As apparent from Table 77, it has become clear that the photoreceptors of the present invention prepared by use of the example compounds of Examples 87 to 90 were low in residual potential and also low in $E_{1/6}$, providing excellent electrophotographic characteristics, compared with the photoreceptor of Comparative Example 32 prepared by use of comparative compound 1.

EXAMPLES 91 TO 93 AND COMPARATIVE EXAMPLE 33

A charge generating layer was prepared by use of x-form metal-free phthalocyanine (x-$H_2$Pc) in the same manner as with Examples 31 to 33.

Further, one part of the example compounds in each example shown in Table 78 and one part of a bisphenol A/biphenol copolymerized polycarbonate resin represented by formula (J-1) (manufactured by Idemitsu Kosan Co., Ltd.) were dissolved in 8 parts of an organic solvent by mixing. This solution was applied onto the charge generating layer with a doctor blade, and dried at 80° C. for 3 hours to prepare a photoreceptor. The electrophotographic characteristics of the photoreceptors thus obtained were measured in the same manner as with Examples 1 to 7.

In Comparative Example 33, comparative compound 1 was used in place of the triphenylamine compound (1) of the example compounds.

Results thereof are shown in Table 79.

TABLE 78

| | Test Compound (Amount Used) | Polymer | Organic Solvent | Charge Generating Layer |
|---|---|---|---|---|
| Example 91 | Example compound 47 (0.4 part) Example compound 131 (0.6 part) | J-1 (1 part) | Toluene | x-$H_2$Pc |
| Example 92 | Example compound 47 (0.5 part) Example compound 131 (0.5 part) | J-1 (1 part) | Dioxane | x-$H_2$Pc |
| Example 93 | Example compound 42 (0.5 part) Example compound 131 (0.5 part) | J-1 (1 part) | Tetrahydrofuran | x-$H_2$Pc |
| Comparative Example 33 | Comparative compound 1 (0.4 part) Example compound 132 (0.6 part) | J-1 (1 part) | Dichloroethane | x-$H_2$Pc |

TABLE 79

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 91 | 699 | 472 | 0 | 0.96 | 1.81 |
| Example 92 | 584 | 310 | 0 | 0.64 | 1.31 |
| Example 93 | 598 | 391 | 0 | 0.86 | 1.74 |
| Comparative Example 33 | 837 | 597 | 55 | 1.35 | 6.40 |

As apparent from Table 79, it has become clear that the photoreceptors of the present invention prepared by use of the example compounds of Examples 91 to 93 were low in residual potential and also low in $E_{1/2}$ and $E_{1/6}$, providing excellent electrophotographic characteristics, compared with the photoreceptor of Comparative Example 33 prepared by use of comparative compound 1.

EXAMPLES 94 AND 95 AND COMPARATIVE EXAMPLE 34

A charge generating layer was prepared in the same manner as with Examples 35 to 38.

Further, one part of the example compounds in each example shown in Table 80 and one part of a polycarbonate resin represented by formula (H-2) (trade name: Polycarbonate Z, manufactured by Mitsubishi Gas Chemical Co., Inc.) were dissolved in 8 parts of an organic solvent by mixing. This solution was applied onto the charge generating layer with a doctor blade, and dried at 80° C. for 3 hours to prepare a photoreceptor. The electrophotographic characteristics of the photoreceptors thus obtained were measured in the same manner as with Examples 1 to 7.

In Comparative Example 34, comparative compound 1 was used in place of the triphenylamine compound (1) of the example compounds.

Results thereof are shown in Table 81.

As apparent from Table 81, it has become clear that the photoreceptors of the present invention prepared by use of the example compounds of Examples 94 and 95 were low in residual potential and also low in $E_{1/2}$, providing excellent electrophotographic characteristics, compared with the photoreceptor of Comparative Example 34 prepared by use of comparative compound 1.

In Comparative Example 34, it was impossible to measure $E_{1/6}$ because of insufficient light sensitivity.

EXAMPLE 96 AND COMPARATIVE EXAMPLE 35

A charge generating layer was prepared by use of τ-form metal-free phthalocyanine (τ-$H_2$Pc) in the same manner as with Examples 39 and 40.

One part of the example compounds in each example shown in Table 82 as charge transporting materials and one part of a bisphenol A/biphenol copolymerized polycarbonate resin represented by formula (J-1) (manufactured by Idemitsu Kosan Co., Ltd.) were dissolved in 8 parts of an organic solvent by mixing. This solution was applied onto the charge generating layer with a doctor blade, and dried at 80° C. for 3 hours to prepare a photoreceptor. The electrophotographic characteristics of the photoreceptors thus obtained were measured in the same manner as with Examples 1 to 7.

In Comparative Example 35, comparative compound 1 was used in place of the triphenylamine compound (1) of the example compounds.

Results thereof are shown in Table 83.

TABLE 80

| | Test Compound (Amount Used) | Polymer | Organic Solvent | Charge Generating Layer |
|---|---|---|---|---|
| Example 94 | Example compound 47 (0.5 part) Example compound 131 (0.5 part) | H-2 (1 part) | Tetrahydrofuran | τ-$H_2$Pc |
| Example 95 | Example compound 52 (0.4 part) Example compound 152 (0.6 part) | H-2 (1 part) | Dichloroethane | τ-$H_2$Pc |
| Comparative Example 34 | Comparative compound 1 (0.4 part) Example compound 132 (0.6 part) | H-2 (1 part) | Dichloroethane | τ-$H_2$Pc |

TABLE 81

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 94 | 1295 | 948 | 0 | 0.86 | 1.65 |
| Example 95 | 807 | 587 | 4 | 0.54 | 0.93 |
| Comparative Example 34 | 623 | 332 | 76 | 1.63 | Unmeasurable |

TABLE 82

| | Test Compound (Amount Used) | Polymer | Organic Solvent | Charge Generating Layer |
|---|---|---|---|---|
| Example 96 | Example compound 42 (0.3 part) Example compound 131 (0.7 part) | J-1 (1 part) | Tetrahydrofuran | τ-$H_2$Pc |
| Comparative Example 35 | Comparative compound 1 (0.4 part) Example compound 132 (0.6 part) | J-1 (1 part) | Dichloroethane | τ-$H_2$Pc |

TABLE 83

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 96 | 806 | 679 | 0 | 1.08 | 2.12 |
| Comparative Example 35 | 597 | 315 | 63 | 1.42 | Unmeasurable |

As apparent from Table 83, it has become clear that the photoreceptor of the present invention prepared by use of the example compounds of Example 96 was low in residual potential and also low in $E_{1/2}$, providing excellent electrophotographic characteristics, compared with the photoreceptor of Comparative Example 35 prepared by use of comparative compound 1.

In Comparative Example 35, it was impossible to measure $E_{1/6}$ because of insufficient light sensitivity.

EXAMPLE 97

A charge generating layer was prepared in the same manner as with Examples 42 and 43.

Further, one part of the example compounds shown in Table 84 and one part of a polycarbonate resin represented by formula (H-2) (trade name: Polycarbonate Z, manufactured by Mitsubishi Gas Chemical Co., Inc.) were dissolved in 8 parts of dichloroethane by mixing. This solution was applied onto the charge generating layer with a doctor blade, and dried at 80° C. for 3 hours to prepare a photoreceptor. The electrophotographic characteristics of the photoreceptor thus obtained were measured in the same manner as with Examples 1 to 7.

Results thereof are shown in Table 85.

TABLE 84

| | Test Compound (Amount Used) | Polymer | Organic Solvent | Charge Generating Layer |
|---|---|---|---|---|
| Example 97 | Example compound 47 (0.4 part) Example compound 131 (0.6 part) | H-2 (1 part) | Dichloroethane | CuPc |

TABLE 85

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 97 | 1047 | 873 | 0 | 2.38 | 4.89 |

EXAMPLE 98

A charge generating layer was prepared by use of copper phthalocyanine (CuPc) in the same manner as with Examples 42 and 43.

Further, one part of the example compounds shown in Table 86 and one part of a bisphenol A/biphenol copolymerized polycarbonate resin represented by formula (J-1) (manufactured by Idemitsu Kosan Co., Ltd.) were dissolved in 8 parts of dichloroethane by mixing. This solution was applied onto the charge generating layer with a doctor blade, and dried at 80° C. for 3 hours to prepare a photoreceptor. The electrophotographic characteristics of the photoreceptor thus obtained were measured in the same manner as with Examples 1 to 7.

Results thereof are shown in Table 87.

TABLE 86

| | Test Compound (Amount Used) | Polymer | Organic Solvent | Charge Generating Layer |
|---|---|---|---|---|
| Example 98 | Example compound 21 | J-1 | Dichlo- | CuPc |

TABLE 86-continued

| | Test Compound (Amount Used) | Polymer | Organic Solvent | Charge Generating Layer |
|---|---|---|---|---|
| | (0.4 part) Example compound 131 (0.6 part) | (1 part) | roethane | |

TABLE 87

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 98 | 1054 | 932 | 0 | 2.55 | 5.37 |

EXAMPLES 99 AND 100

A charge generating layer was prepared in the same manner as with Example 41.

Further, one part of the example compounds in each example shown in Table 88 and one part of a polycarbonate resin represented by formula (H-2) (trade name: Polycarbonate Z, manufactured by Mitsubishi Gas Chemical Co., Inc.) were dissolved in 8 parts of dichloroethane by mixing. This solution was applied onto the charge generating layer with a doctor blade, and dried at 80° C. for 3 hours to prepare a photoreceptor. The electrophotographic characteristics of the photoreceptors thus obtained were measured in the same manner as with Examples 1 to 7.

Results thereof are shown in Table 89.

TABLE 88

| | Test Compound (Amount Used) | Polymer | Organic Solvent | Charge Generating Layer |
|---|---|---|---|---|
| Example 99 | Example compound 47 (0.4 part) Example compound 152 (0.6 part) | H-2 (1 part) | Dichloroethane | Bisazo (O) |
| Example 100 | Example compound 52 (0.4 part) Example compound 152 (0.6 part) | H-2 (1 part) | Dichloroethane | Bisazo (O) |

TABLE 89

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 99 | 716 | 362 | 8 | 3.65 | 6.55 |
| Example 100 | 659 | 328 | 5 | 2.98 | 5.27 |

As apparent from Tables 85, 87 and 89, it has become clear that the photoreceptosr of the present invention prepared by use of the example compounds of Examples 97 to 100 were low in residual potential and also low in $E_{1/2}$ and $E_{1/6}$, providing excellent electrophotographic characteristics.

EXAMPLE 101

A mixture of 0.4 part of example compound 47 and 0.6 part of example compound 131 was dissolved by heating at various ratios in 2.0 g of a polymer solution comprising one part of a polycarbonate resin represented by formula (H-2) (trade name: Polycarbonate Z, manufactured by Mitsubishi Gas Chemical Co., Inc.) and 8 parts of tetrahydrofuran. After dissolution, it was observed whether crystals were precipitated or not when the solution was allowed to stand in the dark at room temperature. When the mixture of example compound 47 (0.4 part) and example compound 131 (0.6 part) was added in an amount of 0.4 g or more, the precipitation of crystals was observed.

COMPARATIVE EXAMPLE 3.6

Only example compound 47 was dissolved by heating in 2.0 g of a polymer solution comprising one part of a polycarbonate resin represented by formula (H-2) (trade name: Polycarbonate Z. manufactured by Mitsubishi Gas Chemical Co., Inc.) and 8 parts of tetrahydrofuran, similarly to Example 101. After dissolution, it was observed whether crystals were precipitated or not when the solution was allowed to stand in the dark at room temperature. When example compound 47 was added in an amount of 0.15 g or more, the precipitation of crystals was observed.

Example 101 and Comparative Example 36 have proved that the solubility in the binder polymer was improved in the case where example compound 131 was mixed with example compound 47, compared with the case where only example compound 47 was used.

EXAMPLES 102 TO 104 AND COMPARATIVE EXAMPLES 37 AND 38

A charge generating layer was prepared in the same manner as with Examples 1 to 7. Further, a photoreceptor was prepared in the same manner as with Examples 1 to 7 with the exception that the example compounds in each example shown in Table 90 were used in an amount of one part in place of the compounds shown in Table 17.

In Comparative Example 37, comparative compound 1 was used in place of the triphenylamine compound of the example compounds. In Comparative Example 38, only the triphenylamine compound (example compound 47) was used.

Results thereof are shown in Table 91.

TABLE 90

| | Test Compound (Amount Used) | Polymer | Organic Solvent | Charge Generating Layer |
|---|---|---|---|---|
| Example 102 | Example compound 1 (0.5 part) Example compound 229 (0.5 part) | H-2 (1 part) | Dichloroethane | TiOPc Deposited |
| Example 103 | Example compound 47 (0.5 part) Example compound 235 (0.5 part) | H-2 (1 part) | Dichloroethane | TiOPc Deposited |
| Example 104 | Example compound 47 (0.4 part) Example compound 269 (0.6 part) | H-2 (1 part) | Dichloroethane | TiOPc Deposited |
| Comparative Example 37 | Comparative compound 1 (0.5 part) Example compound 235 (0.5 part) | H-2 (1 part) | Dichloroethane | TiOPc Deposited |
| Comparative Example 38 | Example compound 47 (1.0 part) | H-2 (1 part) | Dichloroethane | TiOPc Deposited |

TABLE 91

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 102 | 844 | 620 | 21 | 0.58 | 2.23 |
| Example 103 | 980 | 764 | 21 | 0.57 | 1.39 |
| Example 104 | 979 | 746 | 3 | 0.69 | 1.62 |
| Comparative Example 37 | 1293 | 1082 | 339 | 2.15 | Unmeasurable |
| Comparative Example 38 | Unmeasurable | | | | |

As apparent from Table 91, it has become clear that the photoreceptors of the present invention prepared by use of the example compounds of Examples 102 to 104 were low in residual potential and also low in $E_{1/2}$, providing excellent electrophotographic characteristics, compared with the photoreceptor of Comparative Example 37 prepared by use of comparative compound 1.

In Comparative Example 37, it was impossible to measure $E_{1/6}$ because of insufficient light sensitivity. In the photoreceptor of Comparative Example 38, cracks developed after film formation and drying, resulting in the failure of measurement.

EXAMPLE 105 AND COMPARATIVE EXAMPLE 39

A charge generating layer was prepared in the same manner as with Examples 1 to 7.

Further, a photoreceptor was prepared in the same manner as with Examples 1 to 7 with the exception that the example compounds in each example shown in Table 92 were used in an amount of one part in place of the compounds shown in Table 17 and one part of a bisphenol A/biphenol copolymerized polycarbonate resin represented by formula (J-1) (manufactured by Idemitsu Kosan Co., Ltd.) was used in place of the polycarbonate resin represented by formula (H-2). The electrophotographic characteristics of the photoreceptors thus obtained were measured in the same manner as with Examples 1 to 7.

In Comparative Example 39, comparative compound 1 was used in place of the triphenylamine compound of the example compounds.

Results thereof are shown in Table 93.

TABLE 92

| | Test Compound (Amount Used) | Polymer | Organic Solvent | Charge Generating Layer |
|---|---|---|---|---|
| Example 105 | Example compound 47 (0.4 part) Example compound 269 (0.6 part) | J-1 (1 part) | Dichloroethane | TiOPc Deposited |
| Comparative Example 39 | Comparative compound 1 (0.5 part) Example compound 235 (0.5 part) | J-1 (1 part) | Dichloroethane | TiOPc Deposited |

TABLE 93

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 105 | 917 | 700 | 71 | 0.82 | 14.50 |
| Comparative Example 39 | 933 | 592 | 88 | 1.19 | 21.09 |

As apparent from Table 93, it has become clear that the photoreceptor of the present invention prepared by use of the example compounds of Example 105 was low in residual potential and also low in $E_{1/2}$ and $E_{1/6}$, providing excellent electrophotographic characteristics, compared with the photoreceptor of Comparative Example 39 prepared by use of comparative compound 1.

EXAMPLES 106 AND 107 AND COMPARATIVE EXAMPLE 40

A charge generating layer was prepared in the same manner as with Examples 20 to 27.

Further, one part of the example compounds in each example shown in Table 94 and one part of a polycarbonate resin represented by formula (H-2) (trade name: Polycarbonate Z, manufactured by Mitsubishi Gas Chemical Co., Inc.) were dissolved in 8 parts of dichloroethane by mixing. This solution was applied onto the charge generating layer with a doctor blade, and dried at 80° C. for 3 hours to prepare a photoreceptor. The electrophotographic characteristics of the photoreceptors thus obtained were measured in the same manner as with Examples 1 to 7.

In Comparative Example 40, comparative compound 1 was used in place of the triphenylamine compound of the example compounds.

Results thereof are shown in Table 95.

TABLE 94

| | Test Compound (Amount Used) | Polymer | Organic Solvent | Charge Generating Layer |
|---|---|---|---|---|
| Example 106 | Example compound 1 (0.5 part) Example compound 229 (0.5 part) | H-2 (1 part) | Dichloroethane | CDB |
| Example 107 | Example compound 47 (0.4 part) Example compound 235 (0.6 part) | H-2 (1 part) | Dichloroethane | CDB |
| Comparative Example 40 | Comparative compound 1 (0.5 part) Example compound 235 (0.5 part) | H-2 (1 part) | Dichloroethane | CDB |

TABLE 95

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 106 | 1041 | 967 | 12 | 5.93 | 14.64 |
| Example 107 | 999 | 870 | 12 | 3.68 | 8.30 |
| Comparative Example 40 | 1324 | 1141 | 129 | 5.16 | 16.28 |

As apparent from Table 95, it has become clear that the photoreceptors of the present invention prepared by use of the example compounds of Examples 106 and 107 were low in residual potential and also low in $E_{1/6}$, providing excellent electrophotographic characteristics, compared with the photoreceptor of Comparative Example 40 prepared by use of comparative compound 1.

EXAMPLE 108 AND COMPARATIVE EXAMPLE 41

Chlorodian blue (CDB) was used as a charge generating material similarly to Examples 20 to 27.

Further, one part of the example compounds in each example shown in Table 96 as charge transporting materials and one part of a bisphenol A/biphenol copolymerized polycarbonate resin represented by formula (J-1) manufactured by Idemitsu Kosan Co., Ltd.) were dissolved in 8 parts of dichloroethane. This solution was applied onto the charge generating layer with a doctor blade, and dried at 80° C. for 3 hours to prepare a photoreceptor. The electrophotographic characteristics of the photoreceptors thus obtained were measured in the same manner as with Examples 1 to 7.

In Comparative Example 41, comparative compound 1 was used in place of the triphenylamine compound of the example compounds.

Results thereof are shown in Table 97.

TABLE 96

| | Test Compound (Amount Used) | Polymer | Organic Solvent | Charge Generating Layer |
|---|---|---|---|---|
| Example 108 | Example compound 1 (0.5 part) Example compound 241 (0.5 part) | J-1 (1 part) | Dichloroethane | CDB |
| Comparative Example 41 | Comparative compound 1 (0.5 part) Example compound 234 (0.5 part) | J-1 (1 part) | Dichloroethane | CDB |

TABLE 97

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 108 | 985 | 896 | 18 | 5.52 | 13.00 |
| Comparative Example 41 | 1077 | 930 | 127 | 5.50 | 21.71 |

As apparent from Table 97, it has become clear that the photoreceptor of the present invention prepared by use of the example compounds of Example 108 was low in residual potential and also low in $E_{1/6}$, providing excellent electrophotographic characteristics, compared with the photoreceptor of Comparative Example 41 prepared by use of comparative compound 1.

EXAMPLES 109 TO 111 AND COMPARATIVE EXAMPLE 42

A charge generating layer was prepared in the same manner as with Examples 35 to 38.

Further, one part of the example compounds in each example shown in Table 98 and one part of a polycarbonate resin represented by formula (H-2) (trade name: Polycarbonate Z. manufactured by Mitsubishi Gas Chemical Co., Inc.) were dissolved in 8 parts of dichloroethane by mixing. This solution was applied onto the charge generating layer with a doctor blade, and dried at 80° C. for 3 hours to prepare a photoreceptor. The electrophotographic characteristics of the photoreceptors thus obtained were measured in the same manner as with Examples 1 to 7.

In Comparative Example 42, comparative compound 1 was used in place of the triphenylamine compound of the example compounds.

Results thereof are shown in Table 99.

TABLE 98

| | Test Compound (Amount Used) | Polymer | Organic Solvent | Charge Generating Layer |
|---|---|---|---|---|
| Example 109 | Example compound 1 (0.5 part) Example compound 229 (0.5 part) | H-2 (1 part) | Dichloroethane | τ-$H_2$Pc |
| Example 110 | Example compound 14 (0.4 part) Example compound 234 (0.6 part) | H-2 (1 part) | Dichloroethane | τ-$H_2$Pc |
| Example 111 | Example compound 47 (0.4 part) Example compound 269 (0.6 part) | H-2 (1 part) | Dichloroethane | τ-$H_2$Pc |
| Comparative Example 42 | Comparative compound 1 (0.5 part) Example compound 235 (0.5 part) | H-2 (1 part) | Dichloroethane | τ-$H_2$Pc |

TABLE 99

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 109 | 908 | 762 | 0 | 0.73 | 1.37 |
| Example 110 | 808 | 682 | 10 | 0.67 | 1.23 |
| Example 111 | 1002 | 876 | 12 | 0.74 | 1.39 |

TABLE 99-continued

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Comparative Example 20 | 1411 | 1203 | 255 | 1.16 | Unmeasurable |

As apparent from Table 99, it has become clear that the photoreceptors of the present invention prepared by use of the example compounds of Examples 109 to 111 were low in residual potential and also low in $E_{1/2}$, providing excellent electrophotographic characteristics, compared with the photoreceptor of Comparative Example 42 prepared by use of comparative compound 1.

In Comparative Example 42, it was impossible to measure $E_{1/6}$ because of insufficient light sensitivity.

EXAMPLE 112 AND COMPARATIVE EXAMPLE 43

A charge generating layer was prepared by use of τ-form metal-free phthalocyanine (τ-$H_2$Pc) in the same manner as with Examples 35 to 38.

One part of the example compounds in each example shown in Table 100 as charge transporting materials and one part of a bisphenol A/biphenol copolymerized polycarbonate resin represented by formula (J-1) (manufactured by Idemitsu Kosan Co., Ltd.) were dissolved in 8 parts of dichloroethane by mixing. This solution was applied onto the charge generating layer with a doctor blade, and dried at 80° C. for 3 hours to prepare a photoreceptor. The electrophotographic characteristics of the photoreceptors thus obtained were measured in the same manner as with Examples 1 to 7.

In Comparative Example 43, comparative compound 1 was used in place of the triphenylamine compound of the example compounds.

Results thereof are shown in Table 101.

TABLE 100

| | Test Compound (Amount Used) | Polymer | Organic Solvent | Charge Generating Layer |
|---|---|---|---|---|
| Example 112 | Example compound 1 (0.4 part) Example compound 241 (0.6 part) | J-1 (1 part) | Dichloroethane | τ-$H_2$Pc |
| Comparative Example 43 | Comparative compound 1 (0.4 part) Example compound 234 (0.6 part) | J-1 (1 part) | Dichloroethane | τ-$H_2$Pc |

TABLE 101

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 112 | 808 | 676 | 22 | 0.63 | 1.18 |
| Comparative Example 43 | 1072 | 933 | 37 | 0.87 | 2.16 |

As apparent from Table 101, it has become clear that the photoreceptor of the present invention prepared by use of the example compounds of Example 112 was low in residual potential and also low in $E_{1/2}$ and $E_{1/6}$, providing excellent electrophotographic characteristics, compared with the photoreceptor of Comparative Example 43 prepared by use of comparative compound 1.

EXAMPLES 113 AND 114 AND COMPARATIVE EXAMPLE 44

A charge generating layer was prepared in the same manner as with Examples 14 to 17.

Further, one part of the example compounds in each example shown in Table 102 and one part of a polycarbonate resin represented by formula (H-2) (trade name: Polycarbonate Z. manufactured by Mitsubishi Gas Chemical Co., Inc.) were dissolved in 8 parts of dichloroethane by mixing. This solution was applied onto the charge generating layer with a doctor blade, and dried at 80° C. for 3 hours to prepare a photoreceptor. The electrophotographic characteristics of the photoreceptors thus obtained were measured in the same manner as with Examples 1 to 7.

In Comparative Example 44, comparative compound 1 was used in place of the triphenylamine compound of the example compounds.

Results thereof are shown in Table 103.

TABLE 102

| | Test Compound (Amount Used) | Polymer | Organic Solvent | Charge Generating Layer |
|---|---|---|---|---|
| Example 113 | Example compound 14 (0.4 part) Example compound 235 (0.6 part) | H-2 (1 part) | Dichloroethane | TiOPc Deposited |
| Example 114 | Example compound 47 (0.4 part) Example compound 234 (0.6 part) | H-2 (1 part) | Dichloroethane | TiOPc Deposited |
| Comparative Example 44 | Comparative compound 1 (0.5 part) Example compound 235 (0.5 part) | H-2 (1 part) | Dichloroethane | TiOPc Deposited |

TABLE 103

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 113 | 745 | 399 | 15 | 0.31 | 0.64 |
| Example 114 | 866 | 501 | 5 | 0.37 | 0.89 |
| Comparative Example 44 | 655 | 205 | 37 | 2.43 | 48.72 |

As apparent from Table 103, it has become clear that the photoreceptors of the present invention prepared by use of the example compounds of Examples 113 and 114 were low in residual potential and also low in $E_{1/2}$ and $E_{1/6}$, providing excellent electrophotographic characteristics, compared with the photoreceptor of Comparative Example 44 prepared by use of comparative compound 1.

EXAMPLE 115 AND COMPARATIVE EXAMPLE 45

A charge generating layer was prepared in the same manner as with Examples 48 to 51.

Further, a photoreceptor was prepared in the same manner as with Examples 48 to 51 with the exception that the example compounds in each example shown in Table 104 were used in an amount of one part in place of the compounds shown in Table 45 and one part of a bisphenol A/biphenol copolymerized polycarbonate resin represented by formula (J-1) (manufactured by Idemitsu Kosan Co., Ltd.) was used in place of the polycarbonate resin represented by formula (H-2). The electrophotographic characteristics of the photoreceptors thus obtained were measured in the same manner as with Examples 1 to 7.

In Comparative Example 45, comparative compound 1 was used in place of the triphenylamine compound of the example compounds.

Results thereof are shown in Table 105.

TABLE 104

| | Test Compound (Amount Used) | Polymer | Organic Solvent | Charge Generating Layer |
|---|---|---|---|---|
| Example 115 | Example compound 47 (0.5 part) Example compound 234 (0.5 part) | J-1 (1 part) | Dichloroethane | TiOPc Deposited |
| Comparative Example 45 | Comparative compound 1 (0.5 part) Example compound 234 (0.5 part) | J-1 (1 part) | Dichloroethane | TiOPc Deposited |

TABLE 105

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 115 | 626 | 383 | 19 | 0.49 | 1.51 |
| Comparative Example 45 | 915 | 528 | 45 | 0.66 | 4.00 |

As apparent from Table 105, it has become clear that the photoreceptor of the present invention prepared by use of the example compounds of Example 115 was low in residual potential and also low in $E_{1/2}$ and $E_{1/6}$, providing excellent electrophotographic characteristics, compared with the photoreceptor of Comparative Example 45 prepared by use of comparative compound 1.

EXAMPLES 116 TO 118 AND COMPARATIVE EXAMPLE 46

A charge generating layer was prepared in the same manner as with Examples 31 to 33.

Further, one part of the example compounds in each example shown in Table 106 and one part of a polycarbonate resin represented by formula (H-2) (trade name: Polycarbonate Z, manufactured by Mitsubishi Gas Chemical Co., Inc.) were dissolved in 8 parts of dichloroethane by mixing. This solution was applied onto the charge generating layer with a doctor blade, and dried at 80° C. for 3 hours to prepare a photoreceptor. The electrophotographic characteristics of the photoreceptors thus obtained were measured in the same manner as with Examples 1 to 7.

In Comparative Example 46, comparative compound 1 was used in place of the triphenylamine compound of the example compounds.

Results thereof are shown in Table 107.

TABLE 106

| | Test Compound (Amount Used) | Polymer | Organic Solvent | Charge Generating Layer |
|---|---|---|---|---|
| Example 116 | Example compound 47 (0.4 part) Example compound 235 (0.6 part) | H-2 (1 part) | Dichloroethane | x-$H_2$Pc |
| Example 117 | Example compound 47 (0.4 part) Example compound 241 (0.6 part) | H-2 (1 part) | Dichloroethane | x-$H_2$Pc |
| Example 118 | Example compound 41 (0.4 part) Example compound 269 (0.6 part) | H-2 (1 part) | Dichloroethane | x-$H_2$Pc |
| Comparative Example 46 | Comparative compound 1 (0.5 part) Example compound 235 (0.5 part) | H-2 (1 part) | Dichloroethane | x-$H_2$Pc |

TABLE 107

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 116 | 1152 | 1065 | 6 | 1.05 | 2.11 |
| Example 117 | 1232 | 1091 | 1 | 1.13 | 2.19 |
| Example 118 | 1030 | 911 | 2 | 1.04 | 1.96 |
| Comparative Example 46 | 1372 | 1293 | 379 | 2.48 | Unmeasurable |

As apparent from Table 107, it has become clear that the photoreceptors of the present invention prepared by use of the example compounds of Examples 116 to 118 were low in residual potential and also low in $E_{1/2}$, providing excellent electrophotographic characteristics, compared with the photoreceptor of Comparative Example 46 prepared by use of comparative compound 1.

In Comparative Example 46, it was impossible to measure $E_{1/6}$ because of insufficient light sensitivity.

EXAMPLE 119 AND COMPARATIVE EXAMPLES 47 AND 48

A charge generating layer was prepared by use of x-form metal-free phthalocyanine (x-$H_2$Pc) in the same manner as with Examples 20 to 27.

Further, one part of the example compounds in each example shown in Table 108 and one part of a bisphenol A/biphenol copolymerized polycarbonate resin represented by formula (J-1) (manufactured by Idemitsu Kosan Co., Ltd.) were dissolved in 8 parts of dichloroethane by mixing. This solution was applied onto the charge generating layer with a doctor blade, and dried at 80° C. for 3 hours to prepare a photoreceptor. The electrophotographic characteristics of the photoreceptors thus obtained were measured in the same manner as with Examples 1 to 7.

In Comparative Example 47, comparative compound 1 was used in place of the triphenylamine compound of the example compounds, and in Comparative Example 48, example compound 63 was used in place of the triphenylamine compound of the example compounds.

Results thereof are shown in Table 109.

TABLE 108

| | Test Compound (Amount Used) | Polymer | Organic Solvent | Charge Generating Layer |
|---|---|---|---|---|
| Example 119 | Example compound 52 (0.4 part) Example compound 269 (0.6 part) | J-1 (1 part) | Dichloroethane | x-$H_2$Pc |
| Comparative Example 47 | Comparative compound 1 (0.4 part) Example compound 234 (0.6 part) | J-1 (1 part) | Dichloroethane | x-$H_2$Pc |
| Comparative Example 48 | Example compound 63 (0.5 part) Example compound 234 (0.5 part) | J-1 (1 part) | Dichloroethane | x-$H_2$Pc |

TABLE 109

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 119 | 964 | 868 | 4 | 1.22 | 2.51 |
| Comparative Example 47 | 1184 | 1077 | 40 | 1.65 | 4.20 |
| Comparative Example 48 | 1024 | 923 | 63 | 1.51 | 4.52 |

As apparent from Table 109, it has become clear that the photoreceptor of the present invention prepared by use of the example compounds of Example 119 was low in residual potential and also low in $E_{1/2}$ and $E_{1/6}$, providing excellent electrophotographic characteristics, compared with the photoreceptor of Comparative Example 47 prepared by use of comparative compound 1 and the photoreceptor of Comparative Example 48 prepared by use of example compound 63 (0.5 part) and example compound 234 (0.5 part).

EXAMPLES 120 AND 121 AND COMPARATIVE EXAMPLE 49

A charge generating layer was prepared in the same manner as with Example 41.

Further, one part of the example compounds in each example shown in Table 110 and one part of a polycarbonate resin represented by formula (H-2) (trade name: Polycarbonate Z, manufactured by Mitsubishi Gas Chemical Co., Inc.) were dissolved in 8 parts of dichloroethane by mixing. This solution was applied onto the charge generating layer with a doctor blade, and dried at 80° C. for 3 hours to prepare a photoreceptor. The electrophotographic characteristics of the photoreceptors thus obtained were measured in the same manner as with Examples 1 to 7.

In Comparative Example 49, comparative compound 1 was used in place of the triphenylamine compound of the example compounds.

Results thereof are shown in Table 111.

TABLE 110

| | Test Compound (Amount Used) | Polymer | Organic Solvent | Charge Generating Layer |
|---|---|---|---|---|
| Example 120 | Example compound 14 (0.4 part) Example compound 235 (0.6 part) | H-2 (1 part) | Dichloroethane | Bisazo (O) |
| Example 121 | Example compound 47 (0.4 part) Example compound 269 (0.6 part) | H-2 (1 part) | Dichloroethane | Bisazo (O) |
| Comparative Example 49 | Comparative compound 1 (0.5 part) Example compound 235 (0.5 part) | H-2 (1 part) | Dichloroethane | Bisazo (O) |

TABLE 111

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 120 | 804 | 585 | 53 | 5.11 | 10.71 |
| Example 121 | 921 | 696 | 85 | 7.56 | 15.22 |
| Comparative Example 49 | 806 | 542 | 108 | 4.07 | Unmeasurable |

As apparent from Table 111, it has become clear that the photoreceptors of the present invention prepared by use of the example compounds of Examples 120 and 121 were low in residual potential, providing excellent electrophotographic characteristics, compared with the photoreceptor of Comparative Example 49 prepared by use of comparative compound 1.

In Comparative Example 49, it was impossible to measure $E_{1/6}$ because of insufficient light sensitivity.

EXAMPLES 122 AND 123 AND COMPARATIVE EXAMPLE 50

A charge generating layer was prepared by use of a bisazo pigment represented by formula (O) in the same manner as with Example 41.

Further, one part of the example compounds in each example shown in Table 112 and one part of a bisphenol A/biphenol copolymerized polycarbonate resin represented by formula (J-1) (manufactured by Idemitsu Kosan Co., Ltd.) were dissolved in 8 parts of an organic solvent by mixing. This solution was applied onto the charge generating layer with a doctor blade, and dried at 80° C. for 3 hours to prepare a photoreceptor. The electrophotographic characteristics of the photoreceptors thus obtained were measured in the same manner as with Examples 1 to 7.

In Comparative Example 50, comparative compound 1 was used in place of the triphenylamine compound of the example compounds.

Results thereof are shown in Table 113.

TABLE 112

| | Test Compound (Amount Used) | Polymer | Organic Solvent | Charge Generating Layer |
|---|---|---|---|---|
| Example 122 | Example compound 1 (0.4 part) Example compound 241 (0.6 part) | J-1 (1 part) | Dichloroethane | Bisazo (O) |
| Example 123 | Example compound 14 (0.4 part) Example compound 235 (0.6 part) | J-1 (1 part) | Dichloroethane | Bisazo (O) |
| Comparative Example 50 | Comparative compound 1 (0.5 part) Example compound 234 (0.5 part) | J-1 (1 part) | Dichloroethane | Bisazo (O) |

TABLE 113

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Example 122 | 882 | 697 | 46 | 4.72 | 10.24 |
| Example 123 | 785 | 604 | 12 | 4.56 | 8.36 |

TABLE 113-continued

| | $V_0$ (−V) | $V_1$ (−V) | $V_{R10}$ (−V) | $E_{1/2}$ (lux · s) | $E_{1/6}$ (lux · s) |
|---|---|---|---|---|---|
| Comparative Example 50 | 924 | 717 | 94 | 3.79 | 12.62 |

As apparent from Table 113, it has become clear that the photoreceptors of the present invention prepared by use of the example compounds of Examples 122 and 123 were low in residual potential and also low in $E_{1/6}$, providing excellent electrophotographic characteristics, compared with the photoreceptor of Comparative Example 50 prepared by use of comparative compound 1.

EXAMPLE 124

A mixture of 0.4 part of example compound 47 and 0.6 part of example compound 234 was dissolved by heating at various ratios in 2.0 g of a polymer solution comprising one part of a polycarbonate resin represented by formula (H-2) (trade name: Polycarbonate Z, manufactured by Mitsubishi Gas Chemical Co., Inc.) and 8 parts of tetrahydrofuran. After dissolution, it was observed whether crystals were precipitated or not when the solution was allowed to stand in the dark at room temperature. When the mixture of example compound 47 and example compound 234 was added in an amount of 0.4 g or more, the precipitation of crystals was observed.

COMPARATIVE EXAMPLE 51

Only example compound 47 was dissolved by heating in 2.0 g of a polymer solution comprising one part of a polycarbonate resin represented by formula (H-2) (trade name: Polycarbonate Z, manufactured by Mitsubishi Gas Chemical Co., Inc.) and 8 parts of tetrahydrofuran, similarly to Example 124. After dissolution, it was observed whether crystals were precipitated or not when the solution was allowed to stand in the dark at room temperature. When example compound 47 was added in an amount of 0.15 g or more, the precipitation of crystals was observed.

Example 124 and Comparative Example 51 have proved that the solubility in the binder polymer was improved in the case where example compound 234 was mixed with example compound 47, compared with the case where only example compound 47 was used.

EXAMPLES 125 AND 126 AND COMPARATIVE EXAMPLES 52 AND 53

An underlayer, a charge generating layer and a charge transporting layer are successively formed on an aluminum drum by a dip coating method to prepare a photoreceptor drum having a film thickness of 20 $\mu$m.

For the charge generating layer, a dispersion was used which was obtained by adding 40 parts of crystalline oxytitanyl phthalocyanine to a binder resin solution obtained by dissolving 35 parts of a butyral resin (trade name: Polyvinyl Butyral BL-1, manufactured by Sekisui Chemical Co., Ltd.) in 1,425 parts of tetrahydrofuran, and dispersing it together with glass beads by use of a vibrating mill for 2 hours, according to the method described in JP-A-1-291256.

For the charge generating layer, in Example 125, a solution was used which was obtained by dissolving 0.2 part of example compound 47, 0.8 part of example compound 63 and one part of a polycarbonate resin represented by formula (H-2) (trade name: Polycarbonate Z, manufactured by Mitsubishi Gas Chemical Co., Inc.) in 8 parts of dichloroethane by mixing, and further dissolving 0.1 part of $\alpha$-tocopherol therein by mixing as an antioxidant.

In Example 126, a solution was used which was obtained by dissolving a mixture of 0.4 part of example compound 47 and 0.6 part of example compound 63, one part of a polycarbonate resin represented by formula (H-2) (trade name: Polycarbonate Z, manufactured by Mitsubishi Gas Chemical Co., Inc.) in 9 parts of dichloroethane by mixing.

After standing of this coating solution in the dark for 2 months, a photoreceptor was prepared similarly.

The electrophotographic characteristics were measured with a Cynthia 99HC (manufactured by Gentec Co., Ltd.).

The retention was determined from the ratio of a reduced amount of charge potential from an initial charge potential to a surface potential after 5 seconds in the dark to the initial charge potential, when a photoreceptor was charged by corona discharge. The half-exposure $E_{1/2}$ ($\mu$J/cm$^2$) was calculated by determining a time taken until a surface potential reached one-half (−300 V) of an initial surface potential (−600 V). Further, $E_{100}$ is an irradiation energy necessary for attenuating the initial surface potential (−600 V) to −100 V.

In Comparative Example 52, a solution was used which was obtained by dissolving one part of example compound 63 and one part of a polycarbonate resin represented by formula (H-2) (trade name: Polycarbonate Z. manufactured by Mitsubishi Gas Chemical Co., Inc.) in 8 parts of dichloroethane by mixing, and further dissolving 0.1 part of $\alpha$-tocopherol therein by mixing as an antioxidant.

In Comparative Example 53, a solution was used which was obtained by dissolving one part of example compound 47 and one part of a polycarbonate resin represented by formula (H-2) (trade name: Polycarbonate Z, manufactured by Mitsubishi Gas Chemical Co., Inc.) in 8 parts of dichloroethane by mixing Results thereof are shown in Table 114.

TABLE 114

| | | Initial Characteristics | | | After Standing for 2 Months | | |
|---|---|---|---|---|---|---|---|
| | | Retention (%) | $E_{1/2}$ ($\mu$J/cm$^2$) | $E_{100}$ ($\mu$J/cm$^2$) | Retention (%) | $E_{1/2}$ ($\mu$J/cm$^2$) | $E_{100}$ ($\mu$J/cm$^2$) |
| Example 125 | Antioxidant Used | 95.3 | 0.14 | 0.60 | 95.6 | 0.14 | 0.77 |
| Comparative Example 52 | Antioxidant Used | 90.1 | 0.22 | 0.60 | 94.8 | 0.16 | 1.05 |

TABLE 114-continued

| | | Initial Characteristics | | | After Standing for 2 Months | | |
|---|---|---|---|---|---|---|---|
| | | Retention (%) | $E_{1/2}$ ($\mu J/cm^2$) | $E_{100}$ ($\mu J/cm^2$) | Retention (%) | $E_{1/2}$ ($\mu J/cm^2$) | $E_{100}$ ($\mu J/cm^2$) |
| Example 12 | Antioxidant Not used | 95.9 | 0.13 | 0.56 | 95.4 | 0.13 | 0.60 |
| Comparative Example 52 | Antioxidant Not used | 94.0 | 0.14 | 0.67 | 95.1 | 0.14 | 0.78 |

As apparent from Table 114, the photoreceptors of the present invention obtained in Examples 125 and 126 was small in changes in characteristics before and after standing of the coating solutions, compared with the photoreceptors obtained by use of example compound 63 alone in Comparative Example 52 and example compound 47 alone in Comparative Example 53. Thus, the photoreceptors of Examples 125 and 126 in which example compound 47 was mixed with example compound 63 could increase the stability of the coating solution.

EXAMPLES 127 TO 133 AND COMPARATIVE EXAMPLES 54 TO 64

One part of a mixed charge transporting material in which the example compounds in each of Examples 127 to 133 shown in Table 115 were mixed at 8 to 11 kinds of ratios and one part of a polycarbonate resin represented by structural formula (H-2) were dissolved in 8 parts of dichloroethane by mixing. Each of these solutions was applied with a doctor blade onto a sheet in which aluminum was deposited over a polyethylene terephthalate (PET) film, and dried at 80° C. for 3 hours. When one part of example compound 47 alone was used, cracks developed in a photoreceptor film on standing after film formation.

Further, a translucent gold electrode was deposited over each of these 8 kinds of charge transporting layers, and the charge carrier mobility was measured for each layer. The measurement of the carrier mobility was made by the time-of-flight method (Toshiaki Tanaka, Yasuhiro Yamaguchi and Masaaki Yokoyama, *Denshi Shashin* (Electrophotography) 29, 366 (1990)) using a nitrogen gas laser having a pulse half width of 0.9 nsec. and a wavelength of 337 nm as a light source. Results measured at 25° C. at 25 V/$\mu$m are shown in FIGS. 2 to 8.

Figure 9:
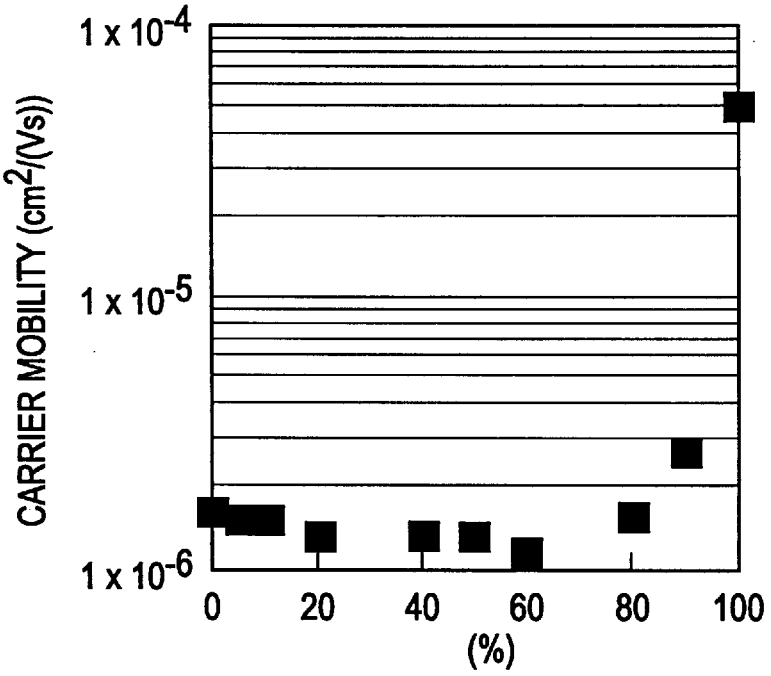
FIG. 9 is a graph showing the carrier mobility of electrophotographic photoreceptors in Comparative Example 54.
Figure 10:
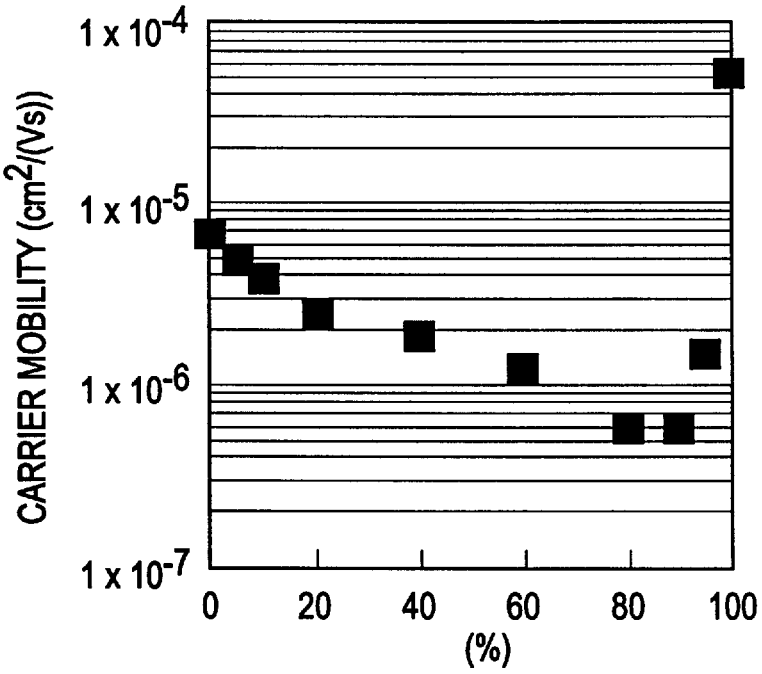
FIG. 10 is a graph showing the carrier mobility of electrophotographic photoreceptors in Comparative Example 55.
Figure 11:
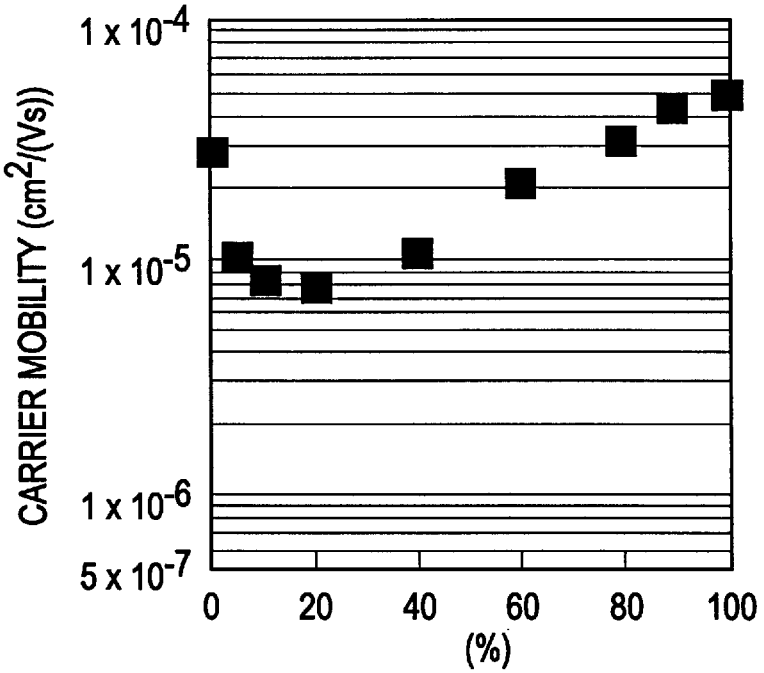
FIG. 11 is a graph showing the carrier mobility of electrophotographic photoreceptors in Comparative Example 56.

Similarly, in each of Comparative Examples 54 to 56 in Table 116, the measurement was made in the same manner as with Examples 127 to 133, using one part of a charge transporting material in which each of comparative compounds 1 to 3 was mixed with example compound 47 at 9 or 10 kinds of ratios. Results thereof are shown in FIGS. 9 to 11.

Figure 12:
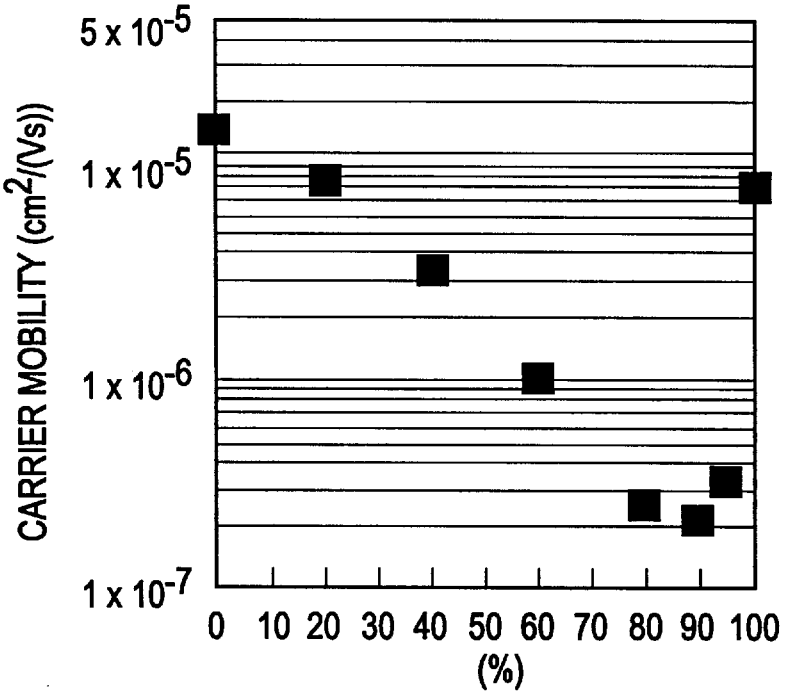
FIG. 12 is a graph showing the carrier mobility of electrophotographic photoreceptors in Comparative Example 57.

Further, in Comparative Example 57, the measurement was made in the same manner as with Examples 127 to 133, using one part of a charge transporting material in which comparative compound 4 was mixed with example compound 81 at 8 kinds of ratios. Results thereof are shown in FIG. 12.

Figure 13:
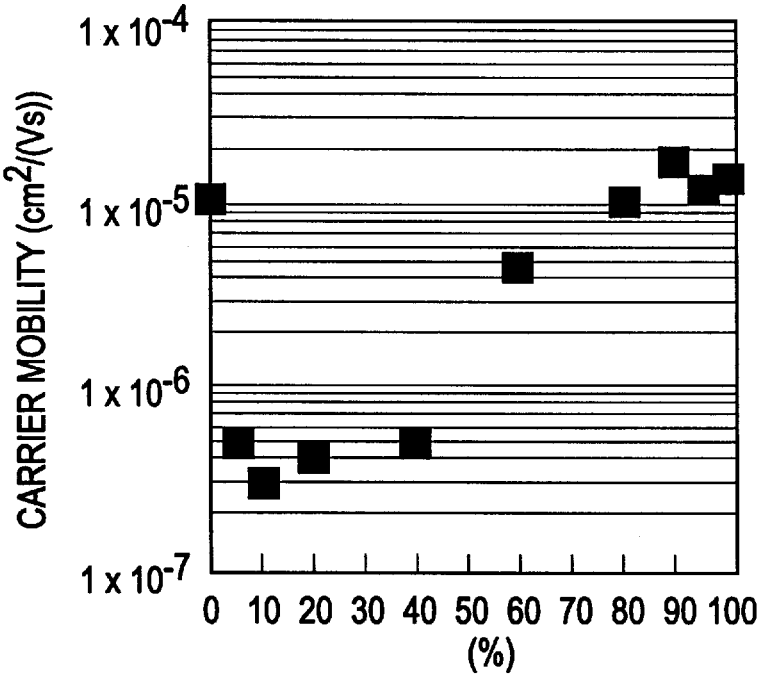
FIG. 13 is a graph showing the carrier mobility of electrophotographic photoreceptors in Comparative Example 58.

Furthermore, in Comparative Example 58, the measurement was made in the same manner as with Examples 127 to 133, using one part of a charge transporting material in which comparative compound 4 was mixed with example compound 131 at 10 kinds of ratios. Results thereof are shown in FIG. 13.

Figure 14:
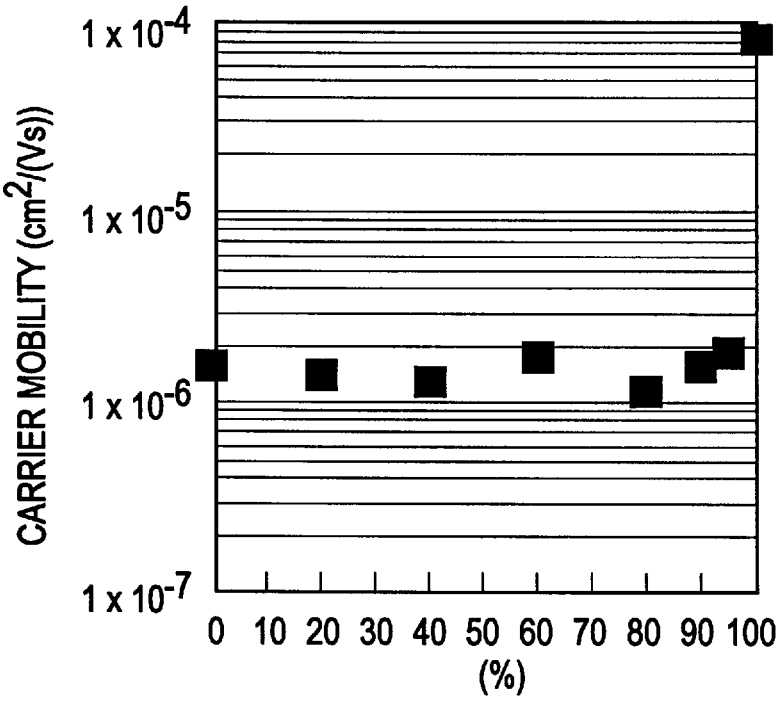
FIG. 14 is a graph showing the carrier mobility of electrophotographic photoreceptors in Comparative Example 59.

Still further, in Comparative Example 59, the measurement was made in the same manner as with Examples 127 to 133, using one part of a charge transporting material in which comparative compound 1 was mixed with example compound 195 at 8 kinds of ratios. Results thereof are shown in FIG. 14.

The term "carrier mobility" means the moving speed of a carrier per unit electric field (V/cm). That the carrier mobility is high is that a carrier rapidly moves in a charge transporting layer. The carrier mobility is inherent in a charge transporting material, and indicated by $cm^2/V \cdot s$.

TABLE 115

| | Mixing Ratio of Example Compounds (unit: part by weight) | | | | | | | | | | |
|---|---|---|---|---|---|---|---|---|---|---|---|
| Example 127 | (8 kinds) | | | | | | | | | | |
| Example compound 47 | 0 | 0.2 | 0.4 | 0.6 | 0.8 | 0.9 | 0.95 | 1.0 | | | |
| Example compound 63 | 1 | 0.8 | 0.6 | 0.4 | 0.2 | 0.1 | 0.05 | 0.0 | | | |
| Example 128 | (10 kinds) | | | | | | | | | | |
| Example compound 47 | 0 | 0.05 | 0.1 | 0.2 | 0.4 | 0.6 | 0.8 | 0.9 | 0.95 | 1.0 | |
| Example compound 81 | 1 | 0.95 | 0.9 | 0.8 | 0.6 | 0.4 | 0.2 | 0.1 | 0.05 | 0.0 | |
| Example 129 | (10 kinds) | | | | | | | | | | |
| Example compound 47 | 0 | 0.05 | 0.1 | 0.2 | 0.4 | 0.6 | 0.8 | 0.9 | 0.95 | 1.0 | |
| Example compound 82 | 1 | 0.95 | 0.9 | 0.8 | 0.6 | 0.4 | 0.2 | 0.1 | 0.05 | 0.0 | |
| Example 130 | (11 kinds) | | | | | | | | | | |
| Example compound 47 | 0 | 0.05 | 0.1 | 0.2 | 0.4 | 0.6 | 0.7 | 0.8 | 0.9 | 0.95 | 1.0 |
| Example compound 93 | 1 | 0.95 | 0.9 | 0.8 | 0.6 | 0.4 | 0.3 | 0.2 | 0.1 | 0.05 | 0.0 |
| Example 131 | (10 kinds) | | | | | | | | | | |
| Example compound 47 | 0 | 0.05 | 0.1 | 0.2 | 0.4 | 0.6 | 0.8 | 0.9 | 0.95 | 1.0 | |
| Example compound 109 | 1 | 0.95 | 0.9 | 0.8 | 0.6 | 0.4 | 0.2 | 0.1 | 0.05 | 0.0 | |
| Example 132 | (10 kinds) | | | | | | | | | | |
| Example compound 47 | 0 | 0.05 | 0.1 | 0.2 | 0.4 | 0.6 | 0.8 | 0.9 | 0.95 | 1.0 | |
| Example compound 132 | 1 | 0.95 | 0.9 | 0.8 | 0.6 | 0.4 | 0.2 | 0.1 | 0.05 | 0.0 | |
| Example 133 | (10 kinds) | | | | | | | | | | |

TABLE 115-continued

| | Mixing Ratio of Example Compounds (unit: part by weight) | | | | | | | | | |
|---|---|---|---|---|---|---|---|---|---|---|
| Example compound 47 | 0 | 0.05 | 0.1 | 0.2 | 0.4 | 0.6 | 0.8 | 0.9 | 0.95 | 1.0 |
| Example compound 195 | 1 | 0.95 | 0.9 | 0.8 | 0.6 | 0.4 | 0.2 | 0.1 | 0.05 | 0.0 |

TABLE 116

| | Mixing Ratio of Example Compounds (unit: part by weight) | | | | | | | | | |
|---|---|---|---|---|---|---|---|---|---|---|
| Comparative Example 54 | (10 kinds) | | | | | | | | | |
| Example compound 47 | 0 | 0.05 | 0.1 | 0.2 | 0.4 | 0.6 | 0.8 | 0.9 | 0.95 | 1.0 |
| Comparative compound 1 | 1 | 0.95 | 0.9 | 0.8 | 0.6 | 0.4 | 0.2 | 0.1 | 0.05 | 0.0 |
| Comparative Example 55 | (10 kinds) | | | | | | | | | |
| Example compound 47 | 0 | 0.05 | 0.1 | 0.2 | 0.4 | 0.6 | 0.8 | 0.9 | 0.95 | 1.0 |
| Comparative compound 2 | 1 | 0.95 | 0.9 | 0.8 | 0.6 | 0.4 | 0.2 | 0.1 | 0.05 | 0.0 |
| Comparative Example 56 | (9 kinds) | | | | | | | | | |
| Example compound 47 | 0 | 0.05 | 0.2 | 0.4 | 0.6 | 0.8 | 0.9 | 0.95 | 1.0 | |
| Comparative compound | 1 | 0.95 | 0.8 | 0.6 | 0.4 | 0.2 | 0.1 | 0.05 | 0.0 | |
| Comparative Example 57 | (8 kinds) | | | | | | | | | |
| Example compound 81 | 0 | 0.2 | 0.4 | 0.6 | 0.8 | 0.9 | 0.95 | 1.0 | | |
| Comparative compound 4 | 1 | 0.8 | 0.6 | 0.4 | 0.2 | 0.1 | 0.05 | 0.0 | | |
| Comparative Example 58 | (10 kinds) | | | | | | | | | |
| Example compound 131 | 0 | 0.05 | 0.1 | 0.2 | 0.4 | 0.6 | 0.8 | 0.9 | 0.95 | 1.0 |
| Comparative compound 4 | 1 | 0.95 | 0.9 | 0.8 | 0.6 | 0.4 | 0.2 | 0.1 | 0.05 | 0.0 |
| Comparative Example 59 | (8 kinds) | | | | | | | | | |
| Example compound 195 | 0 | 0.2 | 0.4 | 0.6 | 0.8 | 0.9 | 0.95 | 1.0 | | |
| Comparative compound 1 | 1 | 0.8 | 0.5 | 0.4 | 0.2 | 0.1 | 0.05 | 0.0 | | |

Figure 2:
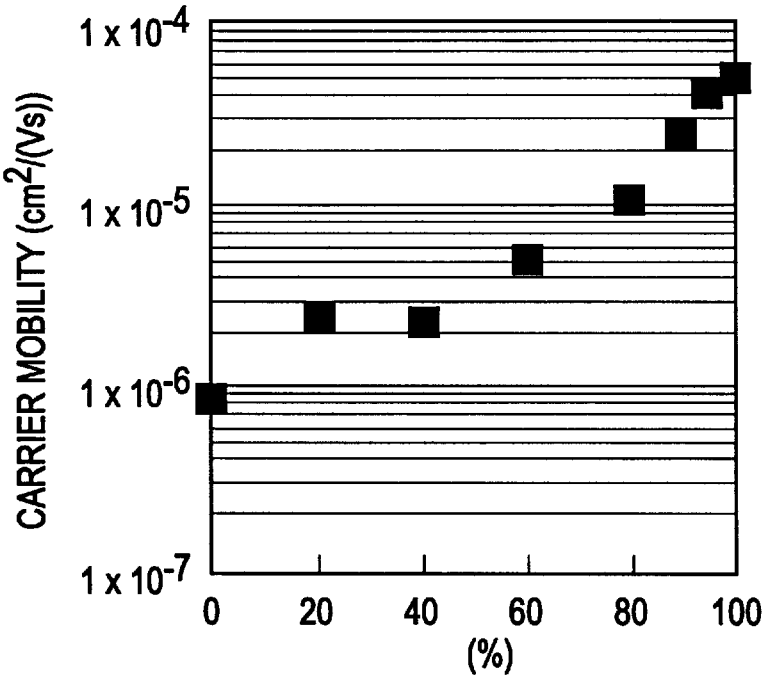
FIG. 2 is a graph showing the carrier mobility of electrophotographic photoreceptors in Example 127.
Figure 3:
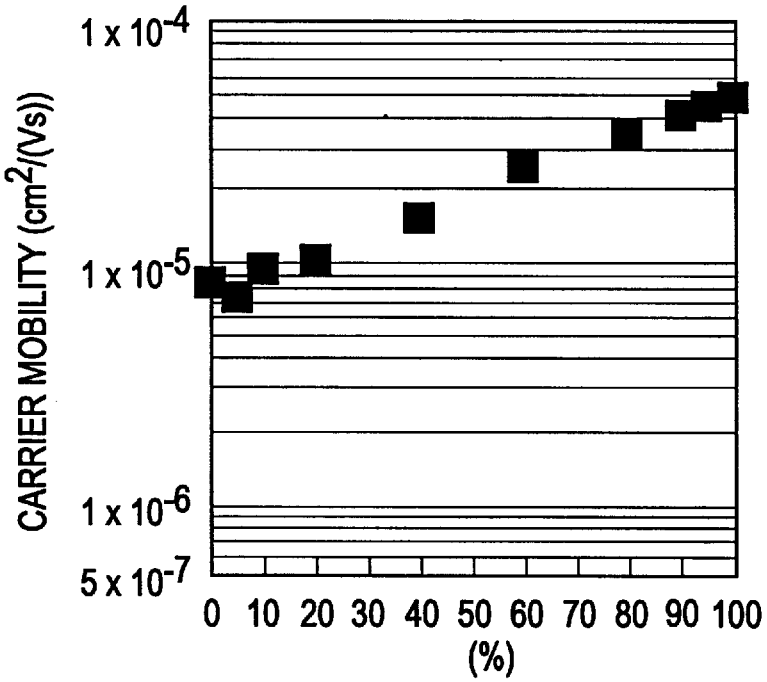
FIG. 3 is a graph showing the carrier mobility of electrophotographic photoreceptors in Example 128.
Figure 4:
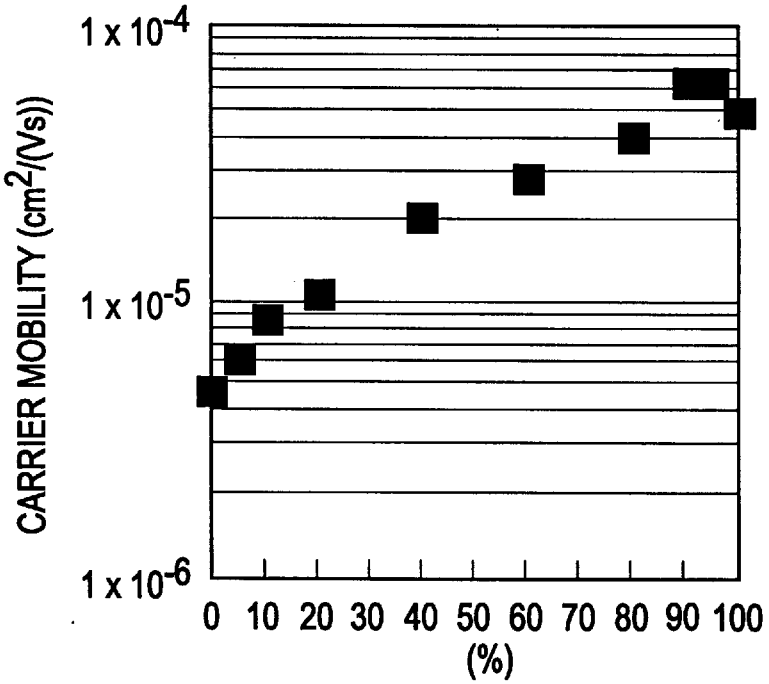
FIG. 4 is a graph showing the carrier mobility of electrophotographic photoreceptors in Example 129.
Figure 5:
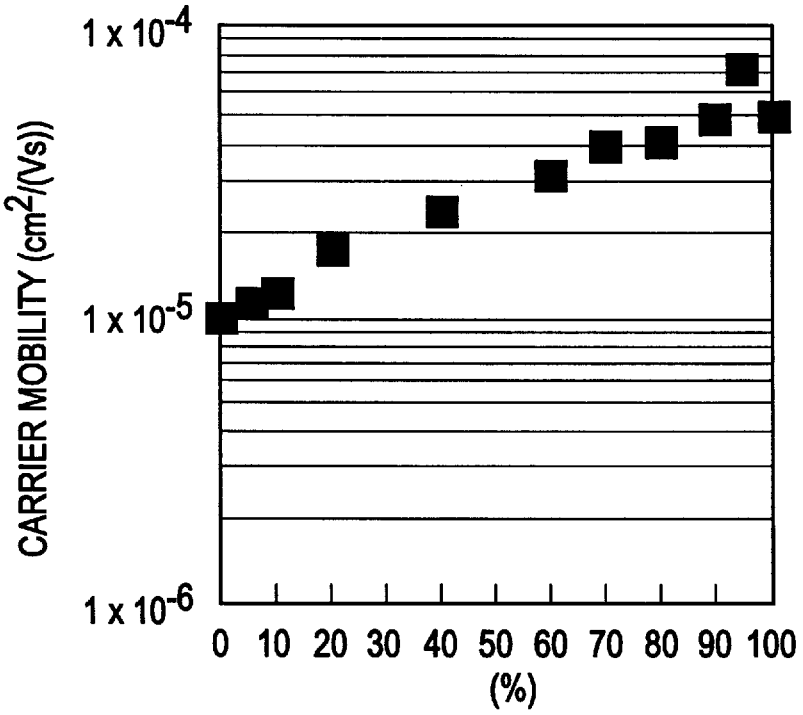
FIG. 5 is a graph showing the carrier mobility of electrophotographic photoreceptors in Example 130.
Figure 6:
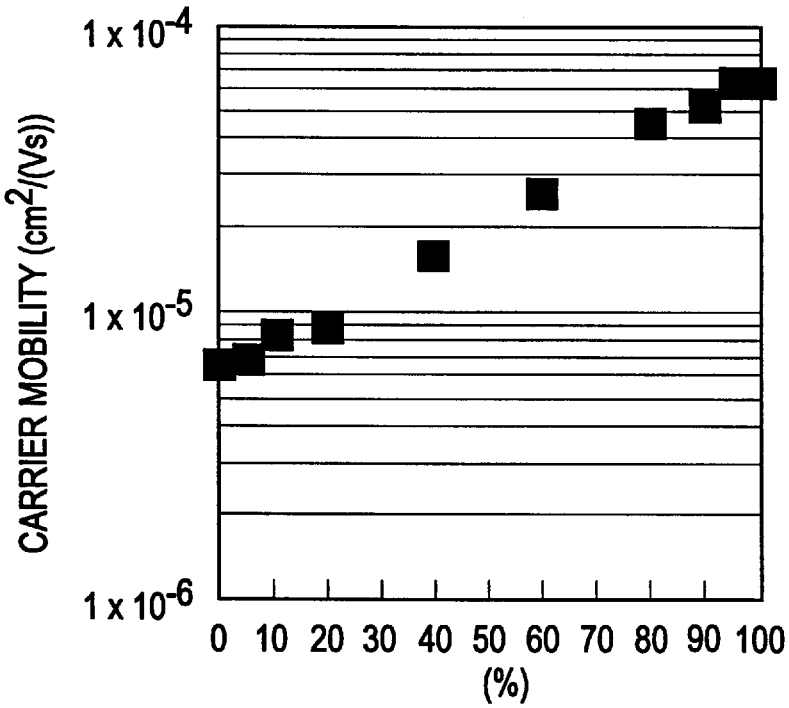
FIG. 6 is a graph showing the carrier mobility of electrophotographic photoreceptors in Example 131.

FIG. 2 shows that a combination of the triphenylamine compound represented by general formula (1) and the hydrazone compound represented by general formula (2) according to the present invention exhibited a high mobility value of $10^{-6}$ $cm^2/V\cdot s$ or more without a lowering, even when the content of the triphenylamine compound was 5 to 95% by weight.

On the other hand, as apparent from FIG. 9, a combination of the triphenylamine compound represented by general formula (1) and comparative compound 1 only exhibited a mobility value similar to that of comparative compound 1 low in mobility, when the content of the triphenylamine compound was 5 to 95% by weight.

As apparent from FIGS. 10 and 11, when the triphenylamine compound represented by general formula (1) was combined with comparative compound 2 or comparative compound 3, the curves were convex downward, showing that the mobility of the mixtures was lower than that of the triphenylamine compound and the comparative compounds almost all over the regions, although the mobility of the comparative compounds was high.

From the results described above, it has become clear that only a combination of the triphenylamine compound represented by general formula (1) and the hydrazone compound represented by general formula (2) gave a charge transporting material having high mobility.

Further, FIGS. 3 to 6 show that combinations of the triphenylamine compounds represented by general formula (1) and the hydrazone compounds represented by general formula (3) according to the present invention exhibited a high mobility value of $10^{-6}$ $cm^2/V\cdot s$ or more without a lowering, even when the content of the triphenylamine compounds was 5 to 95% by weight.

On the other hand, as apparent from FIG. 9, a combination of the triphenylamine compound represented by general formula (1) and comparative compound 1 only exhibited a mobility value similar to that of comparative compound 1 low in mobility, when the contest of the triphenylamine compound was 5 to 95% by weight.

As apparent from FIGS. 10 and 11, when the triphenylamine compound represented by general formula (1) was combined with comparative compound 2 or comparative compound 3, the curves were convex downward, showing that the mobility of the mixtures was lower than that of the triphenylamine compound and the comparative compounds almost all over the regions, although the mobility of the comparative compounds was high.

FIG. 12 shows that even when the hydrazone compound represented by general formula (2) was combined with comparative compound 4, the mobility of the mixture was significantly lowered by mixing, although the mobility of each compound was high.

From the results described above, it has become clear that only a combination of the triphenylamine compound represented by general formula (1) and the hydrazone compound represented by general formula (3) gave a charge transporting material having high mobility.

Figure 7:
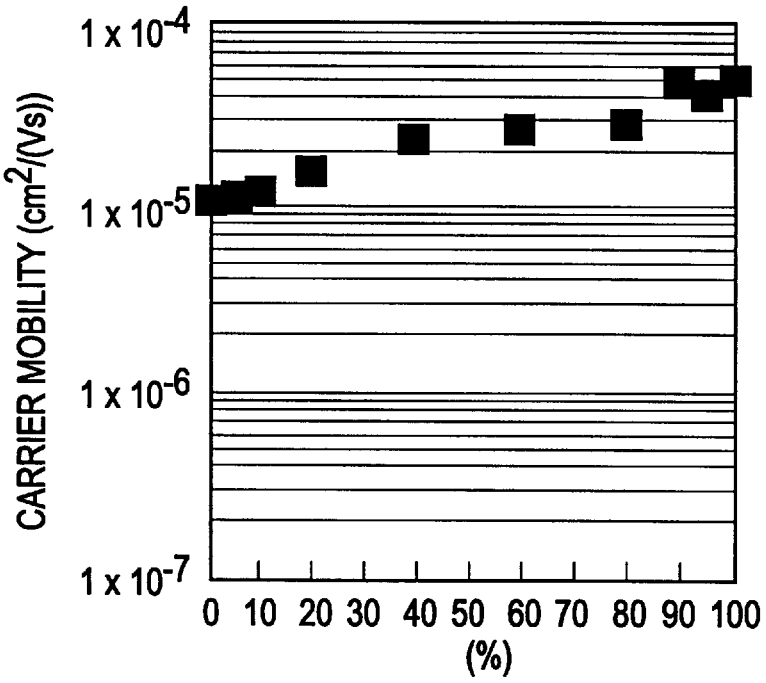
FIG. 7 is a graph showing the carrier mobility of electrophotographic photoreceptors in Example 132.

Furthermore, FIG. 7 shows that a combination of the triphenylamine compound represented by general formula (1) and the triphenylamine diner compound represented by general formula (4) according to the present invention exhibited a high mobility value of $10^{-5}$ $cm^2/V\cdot s$ or more without a lowering, even when the content of the triphenylamine compound was 5 to 95% by weight.

On the other hand, as apparent from FIG. 9, a combination of the triphenylamine compound represented by general formula (1) and comparative compound 1 only exhibited a mobility value similar to that of comparative compound 1 low in mobility, when the content of the triphenylamine compound was 5 to 95% by weight.

As apparent from FIGS. 10 and 11, when the triphenylamine compound represented by general formula (1) was combined with comparative compound 2 or comparative compound 3, the curves were convex downward, showing that the mobility of the mixtures was lower than that of the triphenylamine compound and the comparative compounds almost all over the regions, although the mobility of the comparative compounds was high.

From the results described above, it has become clear that only a combination of the triphenylamine compound represented by general formula (1) and the triphenylamine dimer compound represented by general formula (4) gave a charge transporting material having high mobility.

Figure 8:
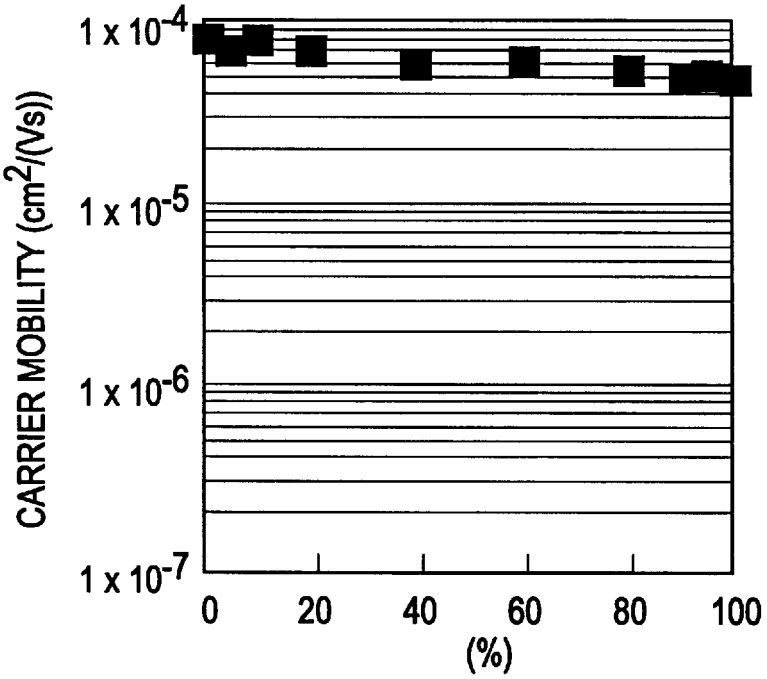
FIG. 8 is a graph showing the carrier mobility of electrophotographic photoreceptors in Example 133.

FIG. 8 shows that a combination of the triphenylamine compound represented by general formula (1) and the distyryl compound represented by general formula (5) according to the present invention exhibited a high mobility value of $10^{-5}$ $cm^2/V\cdot s$ or more without a lowering, all over the content regions of the triphenylamine compound.

On the other hand, as apparent from FIG. 9, a combination of the triphenylamine compound represented by general formula (1) and comparative compound 1 only exhibited a mobility value similar to that of comparative compound 1 low in mobility, when the content of the triphenylamine compound was 5 to 95% by weight.

As apparent from FIGS. 10 and 11, when the triphenylamine compound represented by general formula (1) was combined with comparative compound 2 or comparative compound 3, the curves were convex downward, showing that the mobility of the mixtures was lower than that of the triphenylamine compound and the comparative compounds almost all over the regions, although the mobility of the comparative compounds was high.

As apparent from FIG. 14, when the distyryl compound represented by general formula (5) was combined with comparative compound 1, a mobility value similar to that of comparative compound 1 low in mobility was only obtained all over the regions.

From the results described above, it has become clear that only a combination of the triphenylamine compound represented by general formula (1) and the distyryl compound represented by general formula (5) gave a charge transporting material having high mobility.

The charge transporting materials obtained by the present invention can improve the carrier mobility without an increase in concentration, and the electrophotographic photoreceptors comprising said charge transporting materials have excellent electrophotographic characteristics such as good sensitivity and low residual potential. Accordingly, they are very useful.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor comprising a charge transporting material containing at least one triphenylamine compound represented by general formula (1) and at least one compound selected from the group consisting of a hydrazone compound represented by general formula (2), a hydrazone compound represented by general formula (3), a triphenylamine dimer compound (N,N,N',N'-tetraphenylbenzidine compound) represented by general formula (4) and a distyryl compound represented by general formula (5):

(1)

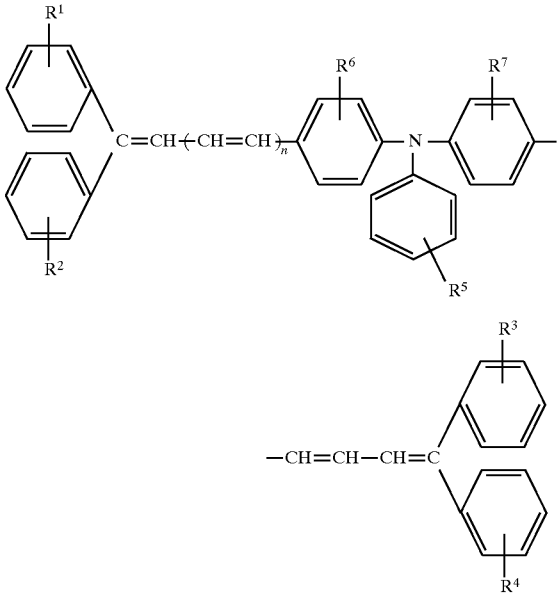

wherein $R^1$, $R^2$, $R^3$, $R^4$, $R^5$, $R^6$ and $R^7$, which may be the same or different, each represents a hydrogen atom, a lower alkyl group having 1 to 4 carbon atoms, a lower alkoxyl group having 1 to 4 carbon atoms, a halogen atom or a phenyl group which may be substituted by a lower alkyl group having 1 to 4 carbon atoms, a lower alkoxyl group having 1 to 4 carbon atoms or a halogen atom; and n represents 0 or 1;

(2)

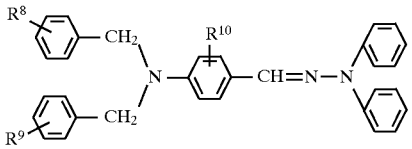

wherein $R^8$, $R^9$ and $R^{10}$, which may be the same or different, each represents a hydrogen atom, a lower alkyl group having 1 to 4 carbon atoms, a lower alkoxyl group having 1 to 4 carbon atoms or a halogen atom;

(3)

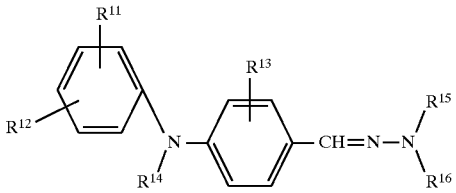

wherein $R^{11}$, $R^{12}$ and $R^{13}$, which may be the same or different, each represents a hydrogen atom, a lower alkyl group having 1 to 4 carbon atoms, a lower alkoxyl group having 1 to 4 carbon atoms or a halogen atom, and $R^{11}$ or $R^{12}$ may form a nitrogen-containing heterocycle unsubstituted or substituted by a lower alkyl group having 1 to 4 carbon atoms, a lower alkoxyl group having 1 to 4 carbon atoms, an aryl group or a halogen atom, together with $R^{13}$; $R^{14}$ represents a lower alkyl group having 1 to 4 carbon atoms, a phenyl group which may be substituted by a lower alkyl group having 1 to 4 carbon atoms, a lower alkoxyl group having 1 to 4 carbon atoms or a halogen atom, a benzyl group which may be substituted by a lower alkyl group having 1 to 4 carbon atoms, a lower alkoxyl group having 1 to 4 carbon atoms or a halogen atom, or a naphthylmethyl group which may be substituted by a lower alkyl group having 1 to 4 carbon atoms, a lower alkoxyl group having 1 to 4 carbon atoms or a halogen atom, and may form a nitrogen-containing heterocycle unsubstituted or substituted by a lower alkyl group having 1 to 4 carbon atoms, a lower alkoxyl group having 1 to 4 carbon atoms, an aryl group or a halogen atom, together with $R^{11}$, $R^{12}$ or $R^{13}$; and $R^{15}$ and $R^{16}$ each represents a lower alkyl group having 1 to 4 carbon atoms, a phenyl group which may be substituted by a lower alkyl group having 1 to 4 carbon atoms, a lower alkoxyl group having 1 to 4 carbon atoms or a halogen atom, a naphthyl group which may be substituted by a lower alkyl group having 1 to 4 carbon atoms, a lower alkoxyl group having 1 to 4 carbon atoms or a halogen atom, or a benzyl group which may be substituted by a lower alkyl group having 1 to 4 carbon atoms, a lower alkoxyl group having 1 to 4 carbon atoms or a halogen atom, and $R^{15}$ and $R^{16}$ may form together a nitrogen-containing heterocycle unsubstituted or substituted by a lower alkyl group having 1 to 4 carbon atoms, a lower alkoxyl group having 1 to 4 carbon atoms, an aryl group or a halogen atom;

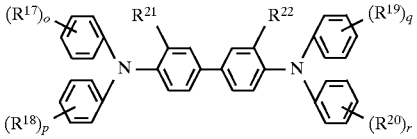

(4)

wherein $R^{17}$, $R^{18}$, $R^{19}$ and $R^{20}$, which may be the same or different, each represents a lower alkyl group having 1 to 4 carbon atoms, a lower alkoxyl group having 1 to 4 carbon atoms or a halogen atom; o, p, q and r each represents 0, 1 or 2; and $R^{21}$ and $R^{22}$, which may be the same or different, each represents a hydrogen atom, a lower alkyl group having 1 to 4 carbon atoms, a lower alkoxyl group having 1 to 4 carbon atoms or a halogen atom;

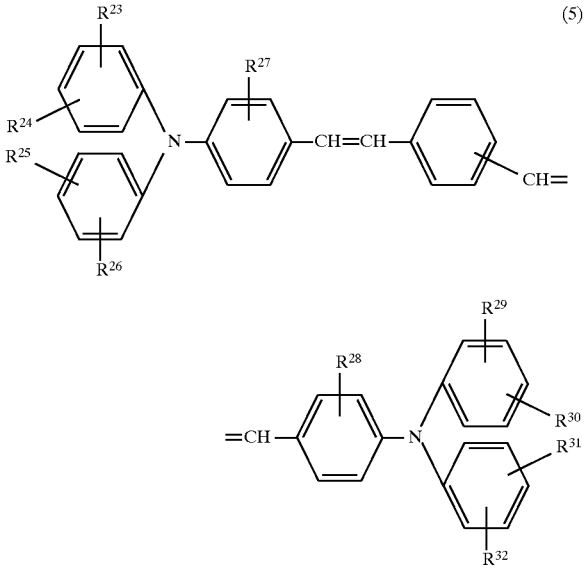

(5)

wherein $R^{23}$, $R^{24}$, $R^{25}$, $R^{26}$, $R^{27}$, $R^{28}$, $R^{29}$, $R^{30}$, $R^{31}$ and $R^{32}$, which may be the same or different, each represents a hydrogen atom, a lower alkyl group having 1 to 4 carbon atoms, a lower alkoxyl group having 1 to 4 carbon atoms or a halogen atom, and the central phenyl group may be substituted by two ethylene groups at the o-, p- or m-positions.

2. The electrophotographic photoreceptor as claimed in claim 1, wherein said triphenylamine compound represented by general formula (1) is contained in the charge-transporting material in an amount of 5–50 % by weight.

* * * * *